United States Patent [19]

Shimada et al.

[11] Patent Number: 4,931,350

[45] Date of Patent: Jun. 5, 1990

[54] ELECTROPHOTOGRAPHIC PHOTOCONDUCTOR HAVING AN ARYLALKYLENEARYLAMINO PHOTOCONDUCTOR

[75] Inventors: Tomoyuki Shimada, Numazu; Masaomi Sasaki, Susono; Mitsuru Hashimoto, Numazu, all of Japan

[73] Assignee: Ricoh Company, Ltd., Tokyo, Japan

[21] Appl. No.: 259,555

[22] Filed: Oct. 18, 1988

Related U.S. Application Data

[63] Continuation-in-part of Ser. No. 144,811, Jan. 15, 1988, abandoned.

[30] Foreign Application Priority Data

| | | | |
|---|---|---|---|
| Jan. 20, 1987 | [JP] | Japan | 62-009073 |
| Jan. 20, 1987 | [JP] | Japan | 62-009074 |
| Jan. 20, 1987 | [JP] | Japan | 62-009075 |
| Jan. 21, 1987 | [JP] | Japan | 62-012967 |
| Oct. 20, 1987 | [JP] | Japan | 62-265663 |

[51] Int. Cl.[5] ..... G03G 5/10

[52] U.S. Cl. ..... 430/59; 430/73

[58] Field of Search ..... 430/58, 70, 71, 72, 430/73, 74, 59

[56] References Cited

U.S. PATENT DOCUMENTS

| | | | |
|---|---|---|---|
| 4,515,883 | 5/1985 | Sasaki | 430/74 |
| 4,603,097 | 7/1986 | Shoshi et al. | 430/74 |

*Primary Examiner*—John L. Goodrow

*Attorney, Agent, or Firm*—Flynn, Thiel, Boutell & Tanis

[57] ABSTRACT

An electrophotographic photoconductor is disclosed, which comprises an electroconductive support and a photoconductive layer formed thereon comprising at least one amino compound of the formula:

wherein A represents a substituted or unsubstituted aromatic hydrocarbon group; $R^1$ and $R^2$ each represent hydrogen, a substituted or unsubstituted alkyl group, a substituted or unsubstituted aryl group, or a substituted or unsubstituted aralkyl group; Ar represents a substituted or unsubstituted aromatic hydrocarbon group, or a substituted or unsubstituted heterocyclic ring; $R^3$ and $R^4$ each represent a substituted or unsubstituted alkyl group, a substituted or unsubstituted aralkyl group, a substituted or unsubstituted aryl group, and n is an integer of 0, 1 or 2.

15 Claims, 1 Drawing Sheet

ELECTROPHOTOGRAPHIC PHOTOCONDUCTOR HAVING AN ARYLALKYLENEARYLAMINO PHOTOCONDUCTOR

This is a continuation-in-part of Ser. No. 144 811, filed Jan. 15, 1988, now abandoned.

BACKGROUND OF THE INVENTION

The present invention relates to an electrophotographic photoconductor, and more particularly to an electrophotographic photoconductor comprising a photoconductive layer containing a particular amino compound overlayed on an electroconductive support.

Conventionally, a variety of inorganic and organic electrophotographic photoconductors are known. As inorganic photoconductors for use in electrophotography, there are known types, in which the photoconductive material is, for instance, selenium, cadmium sulfide, and zinc oxide. In an electrophotographic process, a photoconductor is first exposed to corona charges in the dark, so that the surface of the photoconductor is electrically charged uniformly. The thus uniformly charged photoconductor is then exposed to original light images and the portions exposed to the original light images selectively become electroconductive so that electric charges dissipate from the exposed portions of the photoconductor, whereby latent electrostatic images corresponding to the original light images are formed on the surface of the photoconductor. The latent electrostatic images are then developed by the so-called toner which comprises a colorant, such as a dye or a pigment, and a binder agent made, for instance, of a polymeric material; thus, visible developed images can be obtained on the photoconductor. It is necessary that photoconductors for use in electrophotography have at least the following fundamental properties: (1) chargeability to a predetermined potential in the dark; (2) minimum electric charge dissipation in the dark; and (3) quick dissipation of electric charges upon exposure to light.

While the above-mentioned inorganic electrophotographic photoconductors have many advantages over other conventional electrophotographic photoconductors, at the same time they have several shortcomings from the viewpoint of practical use.

For instance, a selenium photoconductor, which is widely used at present and sufficiently meets the above-mentioned requirements (1) to (3), has the shortcoming that its production is difficult and, accordingly, its production cost is high. Further, it is difficult to work it into the form of a belt due to its poor flexibility, and it is so vulnerable to heat and mechanical shocks that it must be handled with the utmost care.

Cadmium sulfide photoconductors and zinc oxide photoconductors are prepared by dispersing cadmium sulfide or zinc oxide in a binder resin. They can be produced inexpensively compared with selenium photoconductors and are also used commonly in practice. However, the cadmium sulfide and zinc oxide photoconductors are poor in surface smoothness, hardness, tensile strength and wear resistance. Therefore, they are not suitable as photoconductors for use in plain paper copiers in which the photoconductors are used in quick repetition.

Recently, organic electrophotographic photoconductors, which are said not to have such shortcomings of the inorganic electrophotographic photoconductors, have been proposed, and some of them are in fact employed for practical use. Representative examples of such organic electrophotographic photoconductors are an electrophotographic photoconductor comprising poly-N-vinylcarbazole and 2,4,7-trinitro-fluorene-9-one (U.S. Pat. No. 3,484,237), a photoconductor in which poly-N-vinylcarbazole is sensitized by a pyrylium salt type dyestuff (Japanese Patent Publication No. 48-25658), a photoconductor containing as the main component an organic pigment (Japanese Laid-Open Patent Application No. 47-37543), and a photoconductor containing as the main component an eutectic crystaline complex (Japanese Laid-Open Patent Application No. 47-10735).

Although the above-mentioned organic electrophotographic photoconductors have many advantages over other conventional electrophotographic photoconductors, they still have several shortcomings from the viewpoint of practical use, in particular, in terms of cost, production, durability and electrophotographic photosensitivity.

SUMMARY OF THE INVENTION

It is therefore an object of the present invention to provide an electrophotographic photoconductor or element comprising a photoconductive layer containing a particular amino compound and an electroconductive support for supporting the photoconductive layer thereon, with high photosensitivity, which does not give rise to difficulties in producing the electrophotographic photoconductor, and which is comparatively inexpensive and excellent in durability.

The particular amino compound employed in the present invention is represented by the following general formula (I):

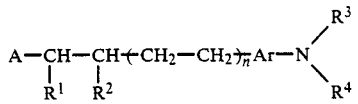

(I)

wherein A represents a substituted or unsubstituted aromatic hydrocarbon group; $R^1$ and $R^2$ each represent hydrogen, a substituted or unsubstituted alkyl group, a substituted or unsubstituted aryl group, or a substituted or unsubstituted aralkyl group; Ar represents a substituted or unsubstituted aromatic hydrocarbon group, or a substituted or unsubstituted heterocyclic ring such as a thiophene group; $R^3$ and $R^4$ each represent a substituted or unsubstituted alkyl group, a substituted or unsubstituted aralkyl group, or a substituted or unsubstituted aryl group; and n is 0, 1 or 2.

DETAILED DESCRIPTION OF THE PREFERRED EMBODIMENTS

Figure 1:
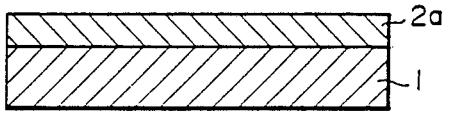
FIG. 1 is an enlarged schematic cross-sectional view of an embodiment of an electrophotographic photoconductor according to the present invention.

The electrophotographic photoconductor according to the present invention is characterized by having a photoconductive layer which comprises at least one amino compound of the following general formula (I):

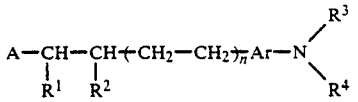

(I)

wherein A represents a substituted or unsubstituted aromatic hydrocarbon group; $R^1$ and $R^2$ each represent hydrogen, a substituted or unsubstituted alkyl group, a substituted or unsubstituted aryl group, or a substituted or unsubstituted aralkyl group; Ar represents a substituted or unsubstituted aromatic hydrocarbon group, or a heterocyclic ring such as a thiophene group; $R^3$ and $R^4$ each represent a substituted or unsubstituted alkyl group, a substituted or unsubstituted aralkyl group, or a substituted or unsubstituted aryl group; and n is an integer of 0, 1 or 2.

In the above general formula (I), it is preferable that the aromatic hydrocarbon group represented by A be a phenyl group which may have a substituent or an anthracene group which may have a substituent and that the aromatic hydrocarbon group represented by Ar also be a phenyl group which may have a substituent. In the formula (I), examples of the substituent of the aromatic hydrocarbon group such as the phenyl group and the anthracene group are an alkyl group having 1 to 4 carbon atoms, an alkoxy group having 1 to 4 carbon atoms, a phenoxy group, and halogen.

Examples of the amino compound represented by the above general formula (I) are as follows:

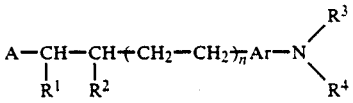

| Amino Compound | n | A | $R^1$ | $R^2$ | Ar | $R^3$, $R^4$ |
|---|---|---|---|---|---|---|
| (I)-1 | 0 | 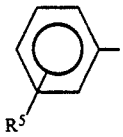 | H | H, alkyl, sub. or unsub. phenyl | sub. or unsub. aromatic hydrocarbon | sub. or unsub. alkyl, sub. or unsub. aralkyl, sub. or unsub. aryl |
| (I)-2 | 0 | 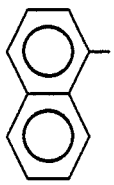 | H | H, sub. or unsub. phenyl | 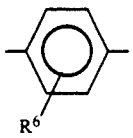 | sub. or unsub. alkyl, sub. or unsub. aralkyl, sub. or unsub. aryl |
| (I)-3 | 0 | sub. or unsub. aromatic hydrocarbon | H, sub. or unsub. alkyl, sub. or unsub. phenyl | H | 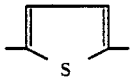 | sub. or unsub. alkyl, sub, or unsub. aralkyl, sub. or unsub. aryl |
| (I)-4 | 0 or 1 | sub. or unsub. phenyl | sub. or unsub. alkyl, sub. or unsub. aryl, sub. or unsub. aralkyl | H | sub. or unsub. aromatic hydrocarbon | sub. or unsub. alkyl, sub. or unsub. aralkyl, sub. or unsub. aryl |
| (I)-5 | 1 or 2 | 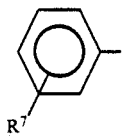 | H | H | sub. or unsub. aromatic hydrocarbon, or sub. or unsub. heterocyclic ring | sub. or unsub. alkyl, or sub. or unsub. aryl |

In amino compound (I)-1, $R^5$ represents hydrogen, an alkyl group, an alkoxy group, an aryloxy group or halogen.

In amino compound (I)-2, $R^6$ represents hydrogen, an alkyl group, an alkoxy group or halogen.

In amino compound (I)-5, $R^7$ represents hydrogen, an alkyl group, preferably an alkyl group having 1 to 4 carbon atoms, an alkoxy group, preferably an alkoxy group having 1 to 4 carbon atoms, an aryloxy group, a dialkylamino group, a diarylamino group or halogen; and $R^3$ and $R^4$ each represents an alkyl group having 1 to 4 carbon atoms, an aralkyl group, or a substituted or unsubstituted aryl group.

Referring to the accompanying drawing, embodiments of an electrophotographic photoconductor according to the present invention will now be explained.

Figure 2:
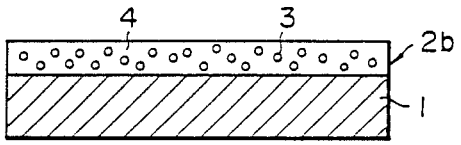
FIG. 2 is an enlarged schematic cross-sectional view of another embodiment of an electrophotographic photoconductor according to the present invention.
Figure 3:
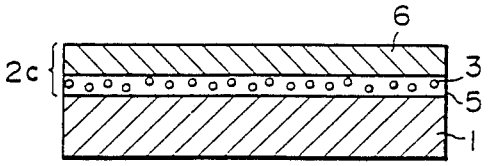
FIG. 3 is an enlarged schematic cross-sectional view of a further embodiment of an electrophotographic photoconductor according to the present invention.

In FIGS. 1 to 3, reference numeral 1 indicates an electroconductive support; reference numerals 2*a*, 2*b* and 2*c* each indicate a photoconductive layer; reference numeral 3, a charge generating material; reference numeral 4, a charge transporting medium; reference numeral 5, a charge generating layer; and reference numeral 6, a charge transporting layer.

The amino compound (I)-1 can be prepared by catalytic hydrogenation of the stilbene compounds described in Japanese Laid-Open Patent Applications Nos. 57-73076, 57-178799, 57-205437, 57-207252, 58-24696 and 58-69202. Specific examples of the amino compound (I)-1 are shown in Table 1.

The amino compound (I)-2 can be prepared by catalytic hydrogenation of the naphthalene compounds described in Japanese Laid-Open Patent Application No. 59-68750. Specific examples of the amino compound (I)-1 are shown in Table 2.

The amino compound (I)-3 can be prepared by catalytic hydrogenation of the thiophene compounds described in Japanese Laid-Open Patent Application No. 60-93443. Specific examples of the amino compound (I)-3 are shown in Table 3.

The amino compounds (I)-4 can be prepared by catalytic hydrogenation of the stilbene compounds described in Japanese Laid-Open Patent Applications Nos. 58-198425, 59-191057, 58-64529, 58-87624 and 58-201025. Specific examples of the amino compounds (I)-4 are respectively shown in Table 4.

The amino compound (I)-5 can be prepared by catalytic hydrogenation of the unsaturated amino compound of the following formula:

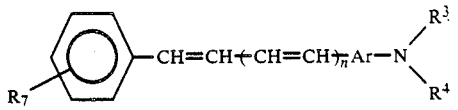

wherein $R^3$, $R^4$, $R^7$ and n are respectively the same as defined previously. Specific examples of the amino compound (I)-5 are shown in Table 5.

TABLE 1

Amino Compound (I)-1

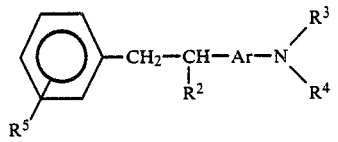

| Amino Compounds | $R^5$ | $R^2$ | Ar | $R^3$ | $R^4$ |
|---|---|---|---|---|---|
| (I)-1-1 | H | 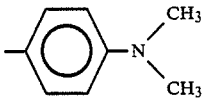 | 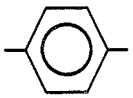 | $-CH_3$ | $-CH_3$ |
| (I)-1-2 | H | H | 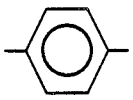 | $-C_2H_5$ | $-C_2H_5$ |
| (I)-1-3 | H | H | 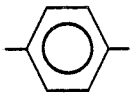 | $-CH_3$ | $-CH_3$ |
| (I)-1-4 | H | H | 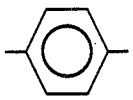 | $-CH_2$ 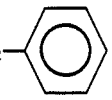 | $-CH_2$ 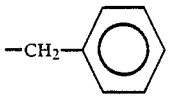 |
| (I)-1-5 | H | H | 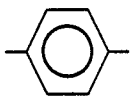 | $-CH_3$ | 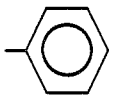 |
| (I)-1-6 | H | H | 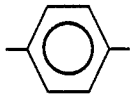 | 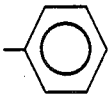 | 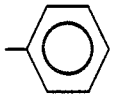 |

TABLE 1-continued
Amino Compound (I)-1
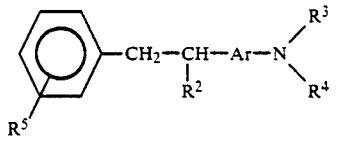
| Amino Compounds | $R^5$ | $R^2$ | Ar | $R^3$ | $R^4$ |
|---|---|---|---|---|---|
| (I)-1-7 | H | H | 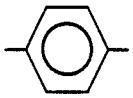 | 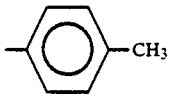 | 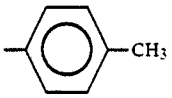 |
| (I)-1-8 | H | H | 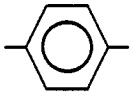 | 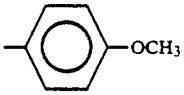 | 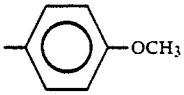 |
| (I)-1-9 | H | H | 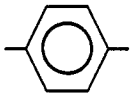 | 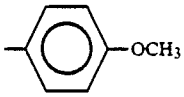 | 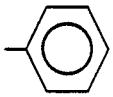 |
| (I)-1-10 | H | H | 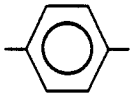 | 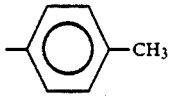 | 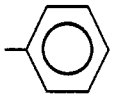 |
| (I)-1-11 | H | H | 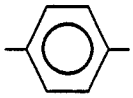 | 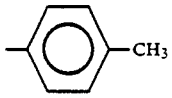 | 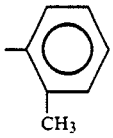 |
| (I)-1-12 | H | H | 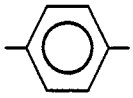 | 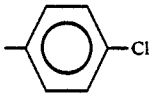 | 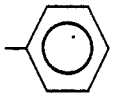 |
| (I)-1-13 | H | H | 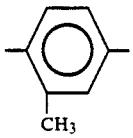 | 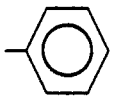 | 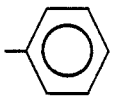 |
| (I)-1-14 | H | H | 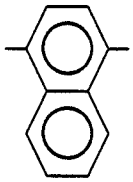 | 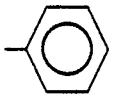 | 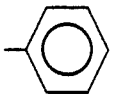 |
| (I)-1-15 | H | H | 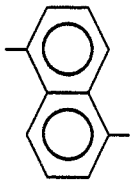 | 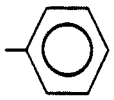 | 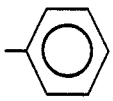 |

TABLE 1-continued
Amino Compound (I)-1
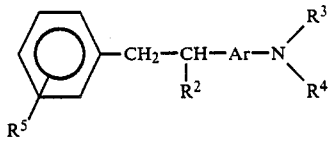
| Amino Compounds | $R^5$ | $R^2$ | Ar | $R^3$ | $R^4$ |
|---|---|---|---|---|---|
| (I)-1-16 | H | H | 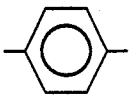 | 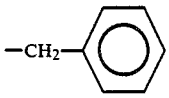 | 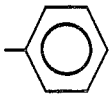 |
| (I)-1-17 | H | H | 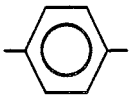 | 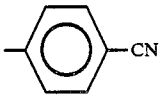 | 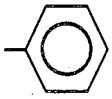 |
| (I)-1-18 | 4-$CH_3$ | H | 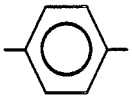 | 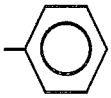 | 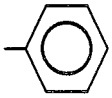 |
| (I)-1-19 | 4-$CH_3$ | H | 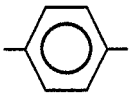 | 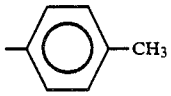 | 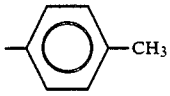 |
| (I)-1-20 | 4-$CH_3$ | H | 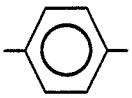 | 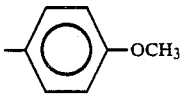 | 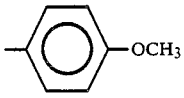 |
| (I)-1-21 | 4-$CH_3$ | H | 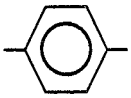 | 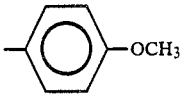 | 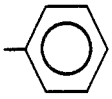 |
| (I)-1-22 | 4-$CH_3$ | H | 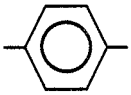 | 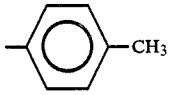 | 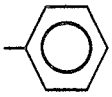 |
| (I)-1-23 | 4-$CH_3$ | H | 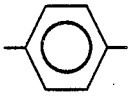 | 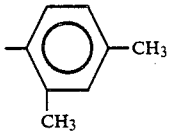 | 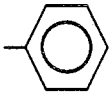 |
| (I)-1-24 | 4-$CH_3$ | H | 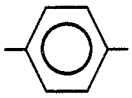 | 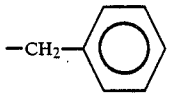 | 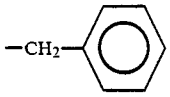 |
| (I)-1-25 | 4-$CH_3$ | H | 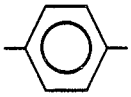 | $-C_2H_5$ | $-C_2H_5$ |
| (I)-1-26 | 4-$CH_3$ | H | 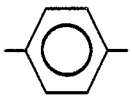 | 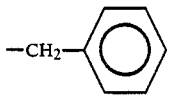 | 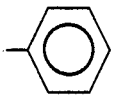 |

TABLE 1-continued
Amino Compound (I)-1
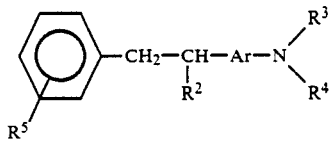
| Amino Compounds | $R^5$ | $R^2$ | Ar | $R^3$ | $R^4$ |
|---|---|---|---|---|---|
| (I)-1-27 | 4-$CH_3$ | H | 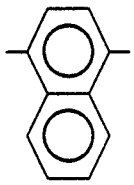 | 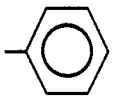 | 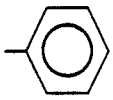 |
| (I)-1-28 | 4-$CH_3$ | H | 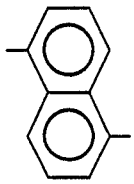 | 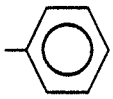 | 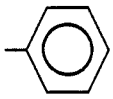 |
| (I)-1-29 | 4-$C_2H_5$ | H | 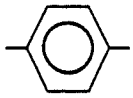 | 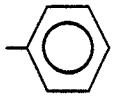 | 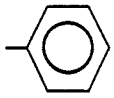 |
| (I)-1-30 | 4-$C_2H_5$ | H | 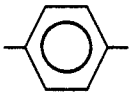 | 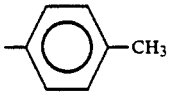 | 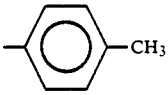 |
| (I)-1-31 | 4-$C_2H_5$ | H | 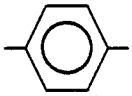 | 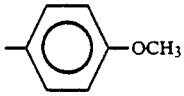 | 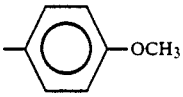 |
| (I)-1-32 | 4-$C_2H_5$ | H | 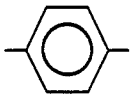 | 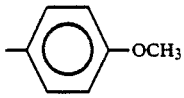 | 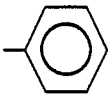 |
| (I)-1-33 | 4-$C_2H_5$ | H | 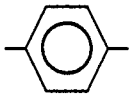 | 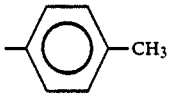 | 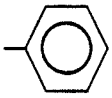 |
| (I)-1-34 | 4-$C_2H_5$ | H | 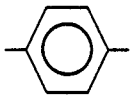 | 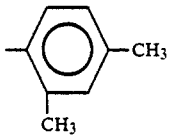 | 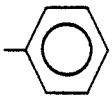 |
| (I)-1-35 | 4-$C_2H_5$ | H | 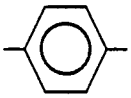 | 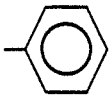 | 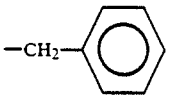 |
| (I)-1-36 | 4-$C_2H_5$ | H | 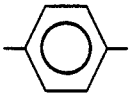 | 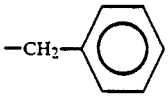 | 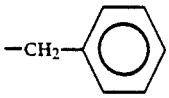 |

TABLE 1-continued
Amino Compound (I)-1
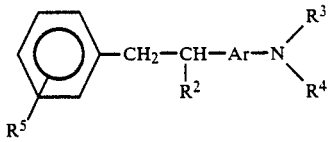
| Amino Compounds | $R^5$ | $R^2$ | Ar | $R^3$ | $R^4$ |
|---|---|---|---|---|---|
| (I)-1-37 | 4-$C_2H_5$ | H | 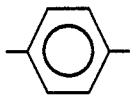 | $-CH_3$ | $-CH_3$ |
| (I)-1-38 | 4-$C_2H_5$ | H | 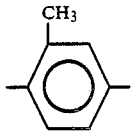  | 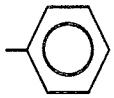 | 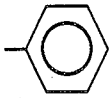 |
| (I)-1-39 | 4-$C_2H_5$ | H | 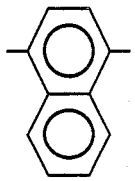 | 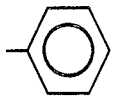 | 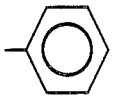 |
| (I)-1-40 | 4-Cl | H | 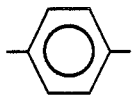 | 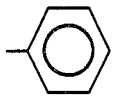 | 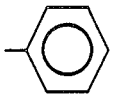 |
| (I)-1-41 | 4-Cl | H | 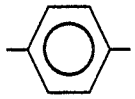 | 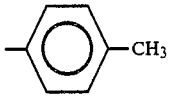  | 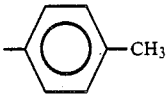  |
| (I)-1-42 | 4-Cl | H | 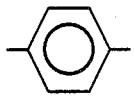 | 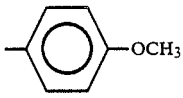  | 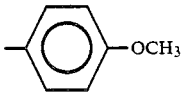  |
| (I)-1-43 | 4-Cl | H | 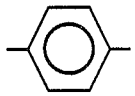 | 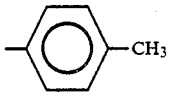  | 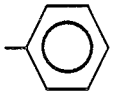 |
| (I)-1-44 | 4-Cl | H | 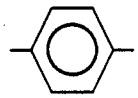 | 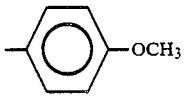  | 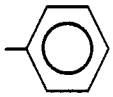 |
| (I)-1-45 | 4-Cl | H | 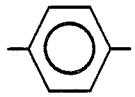 | 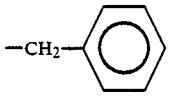  | 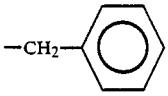  |
| (I)-1-46 | 4-Cl | H | 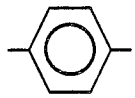 | $-CH_3$ | $-CH_3$ |
| (I)-1-47 | 2-Cl | H | 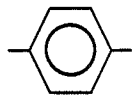 | 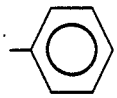 | 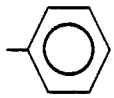 |

TABLE 1-continued
Amino Compound (I)-1
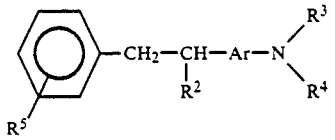
| Amino Compounds | $R^5$ | $R^2$ | Ar | $R^3$ | $R^4$ |
|---|---|---|---|---|---|
| (I)-1-48 | 2-Cl | H | 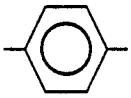 | 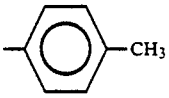 | 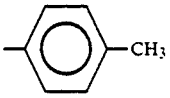 |
| (I)-1-49 | 2-Cl | H | 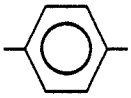 | 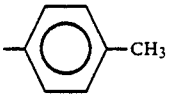 | 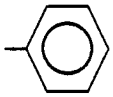 |
| (I)-1-50 | 2-Cl | H | 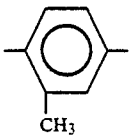 | 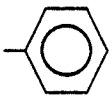 | 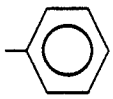 |
| (I)-1-51 | 2-Cl | H | 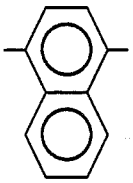 | 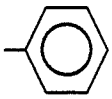 | 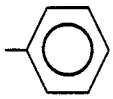 |
| (I)-1-52 | 2-Cl | H | 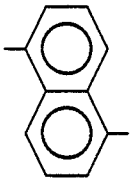 | 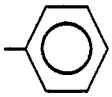 | 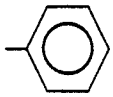 |
| (I)-1-53 | 4-$OCH_3$ | H | 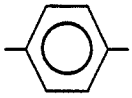 | 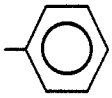 | 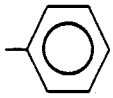 |
| (I)-1-54 | 4-$OCH_3$ | H | 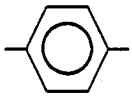 | 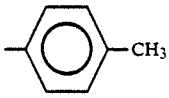 | 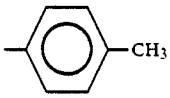 |
| (I)-1-55 | 4-$OCH_3$ | H | 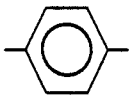 | 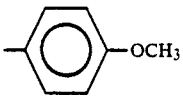 | 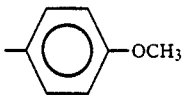 |
| (I)-1-56 | 4-$OCH_3$ | H | 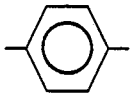 | 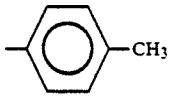 | 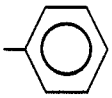 |
| (I)-1-57 | 4-$OCH_3$ | H | 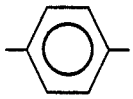 | 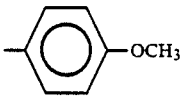 | 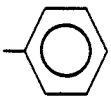 |

TABLE 1-continued
Amino Compound (I)-1
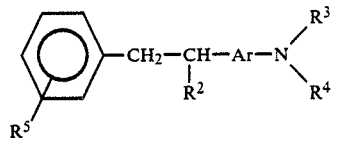
| Amino Compounds | $R^5$ | $R^2$ | Ar | $R^3$ | $R^4$ |
|---|---|---|---|---|---|
| (I)-1-58 | 4-$OCH_3$ | H | 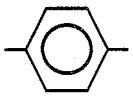 | 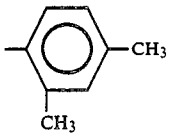 | 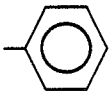 |
| (I)-1-59 | 4-$OCH_3$ | H | 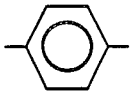 | 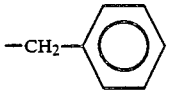 | 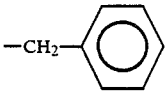 |
| (I)-1-60 | 4-$OCH_3$ | H | 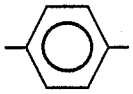 | 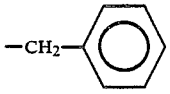 | 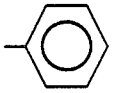 |
| (I)-1-61 | 4-$OCH_3$ | H | 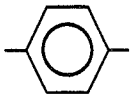 | $-CH_3$ | $-CH_3$ |
| (I)-1-62 | 4-$OCH_3$ | H | 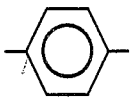 | $-C_2H_5$ | 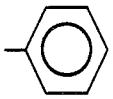 |
| (I)-1-63 | 4-$OCH_3$ | H | 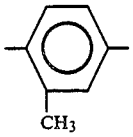 | 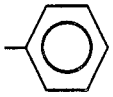 | 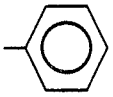 |
| (I)-1-64 | 4-$OCH_3$ | H | 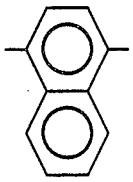 | 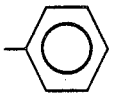 | 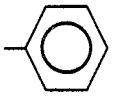 |
| (I)-1-65 | 4-$OCH_3$ | H | 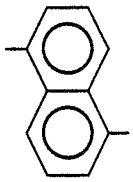 | 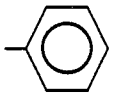 | 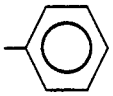 |
| (I)-1-66 | 3-O— 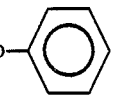 | H | 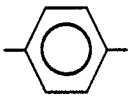 | 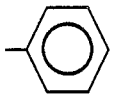 | 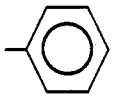 |

TABLE 1-continued
Amino Compound (I)-1
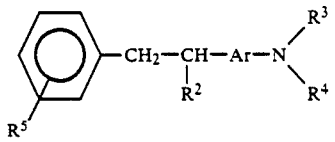
| Amino Compounds | $R^5$ | $R^2$ | Ar | $R^3$ | $R^4$ |
|---|---|---|---|---|---|
| (I)-1-67 | 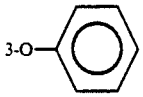 | H | 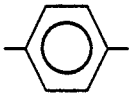 | 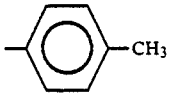 | 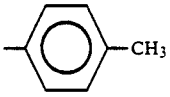 |
| (I)-1-68 | 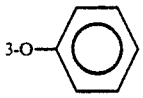 | H | 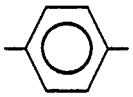 | 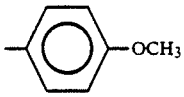 | 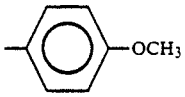 |
| (I)-1-69 | 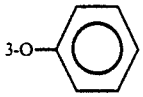 | H | 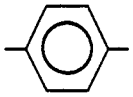 | 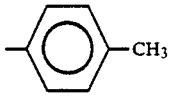 | 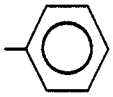 |
| (I)-1-70 | 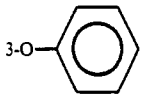 | H | 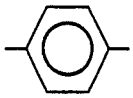 | 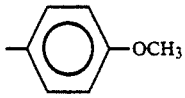 | 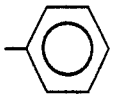 |
| (I)-1-71 | 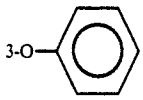 | H | 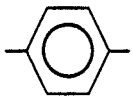 | 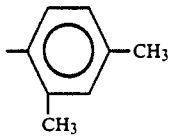 | 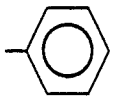 |
| (I)-1-72 | 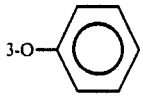 | H | 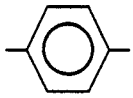 | $-CH_3$ | 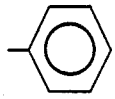 |
| (I)-1-73 | 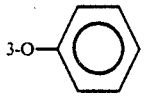 | H | 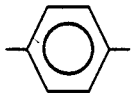 | 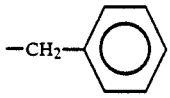 | 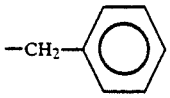 |
| (I)-1-74 | 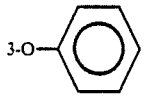 | H | 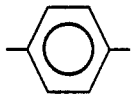 | $-C_2H_5$ | $-C_2H_5$ |
| (I)-1-75 | 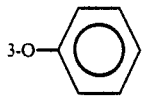 | H | 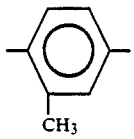 | 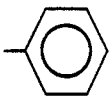 | 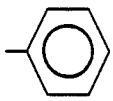 |
| (I)-1-76 | 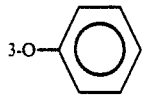 | H | 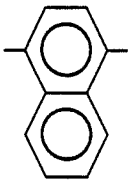 | 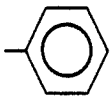 | 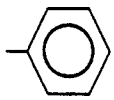 |

TABLE 1-continued
Amino Compound (I)-1
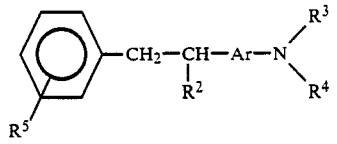
| Amino Compounds | $R^5$ | $R^2$ | Ar | $R^3$ | $R^4$ |
|---|---|---|---|---|---|
| (I)-1-77 | 3-O- | H | | | |
| (I)-1-78 | H | | | | |
| (I)-1-79 | H | $CH_3$ | | | |
TABLE 2
Amino Compound (I)-2
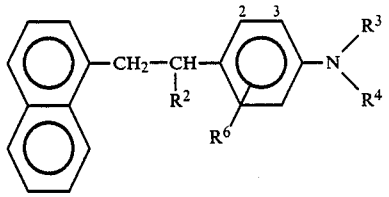
| Amino Compounds | $R^2$ | $R^6$ | $R^3$ | $R^4$ |
|---|---|---|---|---|
| (I)-2-1 | H | H | $-CH_3$ | $-CH_3$ |
| (I)-2-2 | H | H | $-C_2H_5$ | $-C_2H_5$ |
| (I)-2-3 | H | H | $-CH_3$ | |
| (I)-2-4 | H | H | $-CH_3$ | $CH_3$ |
| (I)-2-5 | H | H | $-C_2H_5$ | |
| (I)-2-6 | H | H | | |

TABLE 2-continued
Amino Compound (I)-2
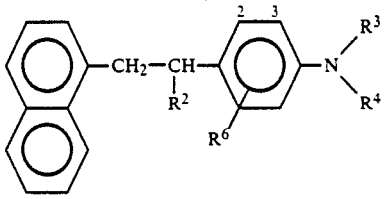
| Amino Compounds | $R^2$ | $R^6$ | $R^3$ | $R^4$ |
|---|---|---|---|---|
| (I)-2-7 | H | H | 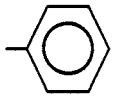 | 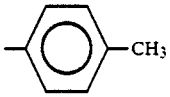 |
| (I)-2-8 | H | H | 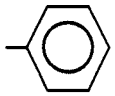 | 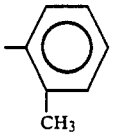 |
| (I)-2-9 | H | H | 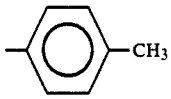 | 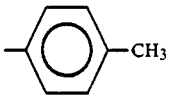 |
| (I)-2-10 | H | H | 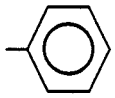 | 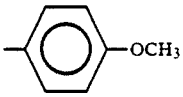 |
| (I)-2-11 | H | H | 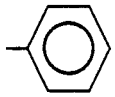 | 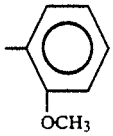 |
| (I)-2-12 | H | H | 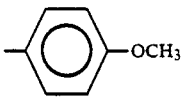 | 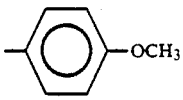 |
| (I)-2-13 | H | H | 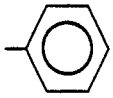 | 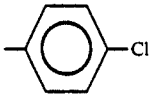 |
| (I)-2-14 | H | H | 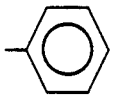 | 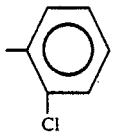 |
| (I)-2-15 | H | H | 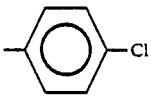 | 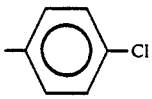 |
| (I)-2-16 | H | H | 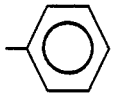 | 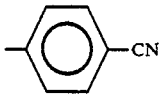 |

TABLE 2-continued
Amino Compound (I)-2
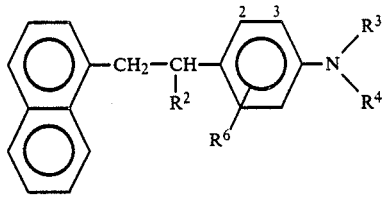
| Amino Compounds | $R^2$ | $R^6$ | $R^3$ | $R^4$ |
|---|---|---|---|---|
| (I)-2-17 | H | H | —C6H4—CN | —C6H4—CN |
| (I)-2-18 | H | H | —C6H5 | —C6H4—$N(CH_3)_2$ |
| (I)-2-19 | H | H | —C6H4—$CH_3$ | —C6H4—$OCH_3$ |
| (I)-2-20 | H | H | —C6H4—$CH_3$ | —C6H4—Cl |
| (I)-2-21 | H | H | —C6H5 | —C6H4—$C_2H_5$ |
| (I)-2-22 | H | H | —C6H4—$C_2H_5$ | —C6H4—$C_2H_5$ |
| (I)-2-23 | H | H | —C6H4—$N(CH_3)_2$ | —C6H4—$N(CH_3)_2$ |
| (I)-2-24 | H | H | —C6H5 | —C6H4—$N(C_2H_5)_2$ |
| (I)-2-25 | H | H | —C6H4—$N(C_2H_5)_2$ | —C6H4—$N(C_2H_5)_2$ |
| (I)-2-26 | H | H | —$CH_2$—C6H5 | —$CH_3$ |
| (I)-2-27 | H | H | —$CH_2$—C6H5 | —$C_2H_5$ |

TABLE 2-continued
Amino Compound (I)-2
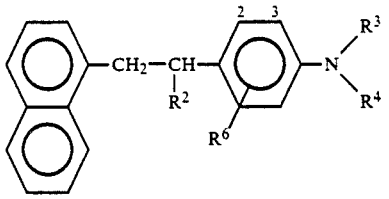
| Amino Compounds | $R^2$ | $R^6$ | $R^3$ | $R^4$ |
|---|---|---|---|---|
| (I)-2-28 | H | H | 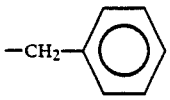 | 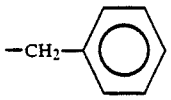 |
| (I)-2-29 | H | H | 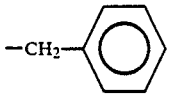 | 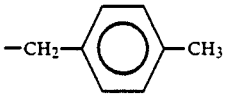 |
| (I)-2-30 | H | H | 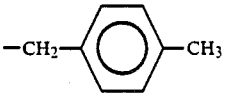 | 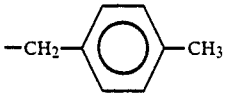 |
| (I)-2-31 | H | H | 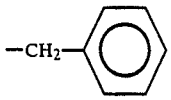 | 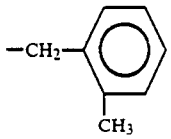 |
| (I)-2-32 | H | H | 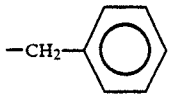 | 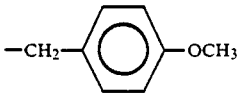 |
| (I)-2-33 | H | H | 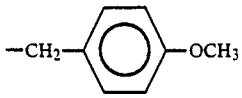 | 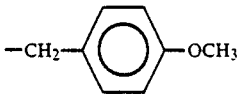 |
| (I)-2-34 | H | H | 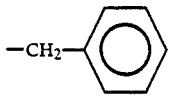 | 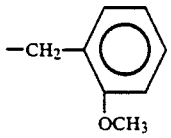 |
| (I)-2-35 | H | H | 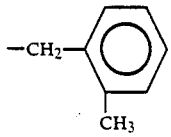 | 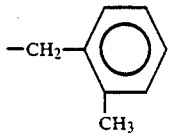 |
| (I)-2-36 | H | H | 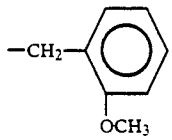 | 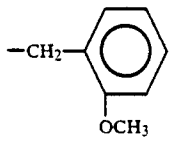 |
| (I)-2-37 | H | H | 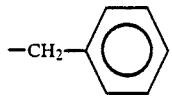 | 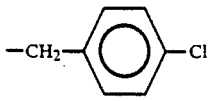 |

TABLE 2-continued
Amino Compound (I)-2
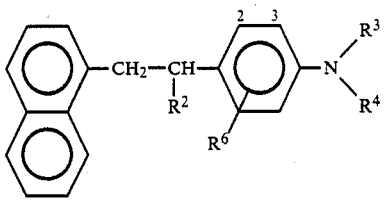
| Amino Compounds | $R^2$ | $R^6$ | $R^3$ | $R^4$ |
|---|---|---|---|---|
| (I)-2-38 | H | H | $-CH_2-C_6H_4-Cl$ | $-CH_2-C_6H_4-Cl$ |
| (I)-2-39 | H | H | $-CH_2-C_6H_5$ | $-CH_2-C_6H_4-Cl$ |
| (I)-2-40 | H | H | $-CH_2-C_6H_4-Cl$ | $-CH_2-C_6H_4-Cl$ |
| (I)-2-41 | H | H | $-CH_2-C_6H_5$ | $-CH_2-C_6H_4-CN$ |
| (I)-2-42 | H | H | $-CH_2-C_6H_4-CN$ | $-CH_2-C_6H_4-CN$ |
| (I)-2-43 | H | H | $-CH_2-C_6H_5$ | $-CH_2-C_6H_4-C_2H_5$ |
| (I)-2-44 | H | H | $-CH_2-C_6H_4-C_2H_5$ | $-CH_2-C_6H_4-C_2H_5$ |
| (I)-2-45 | H | H | $-CH_2-C_6H_5$ | $-CH_2-C_6H_4-N(CH_3)_2$ |
| (I)-2-46 | H | H | $-CH_2-C_6H_4-N(CH_3)_2$ | $-CH_2-C_6H_4-N(CH_3)_2$ |
| (I)-2-47 | H | H | $-CH_2-C_6H_5$ | $-CH_2-C_6H_4-N(C_2H_5)_2$ |

TABLE 2-continued
Amino Compound (I)-2
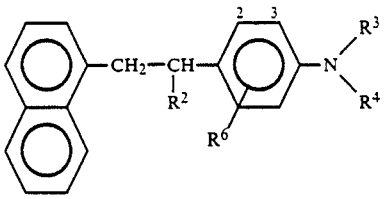
| Amino Compounds | $R^2$ | $R^6$ | $R^3$ | $R^4$ |
|---|---|---|---|---|
| (I)-2-48 | H | H | 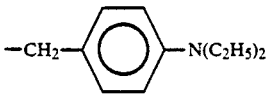 | 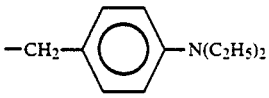 |
| (I)-2-49 | H | 2-$CH_3$ | $-CH_3$ | $-CH_3$ |
| (I)-2-50 | H | 2-$CH_3$ | $-CH_3$ | 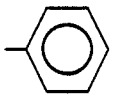 |
| (I)-2-51 | H | 2-$CH_3$ | 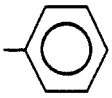 | 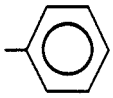 |
| (I)-2-52 | H | 2-$CH_3$ | 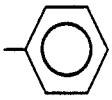 | 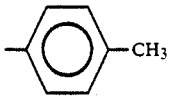 |
| (I)-2-53 | H | 2-$CH_3$ | 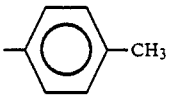 | 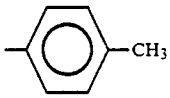 |
| (I)-2-54 | H | 2-$CH_3$ | 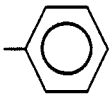 | 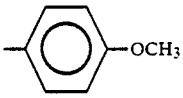 |
| (I)-2-55 | H | 2-$CH_3$ | 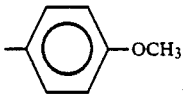 | 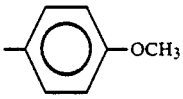 |
| (I)-2-56 | H | 2-$CH_3$ | 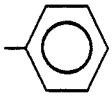 | 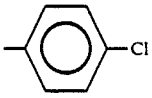 |
| (I)-2-57 | H | 2-$CH_3$ | 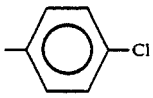 | 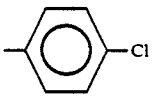 |
| (I)-2-58 | H | 2-$CH_3$ | 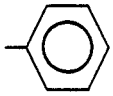 | 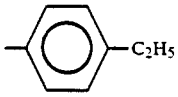 |
| (I)-2-59 | H | 2-$CH_3$ | 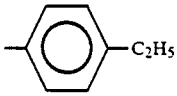 | 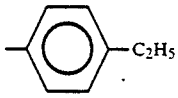 |

TABLE 2-continued
Amino Compound (I)-2
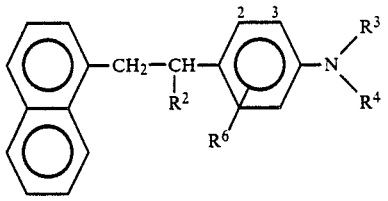
| Amino Compounds | $R^2$ | $R^6$ | $R^3$ | $R^4$ |
|---|---|---|---|---|
| (I)-2-60 | H | 2-$CH_3$ | —$C_2H_5$ | —$C_2H_5$ |
| (I)-2-61 | H | 2-$CH_3$ | —$C_2H_5$ | 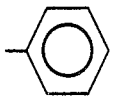 |
| (I)-2-62 | H | 2-$CH_3$ | 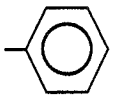 | 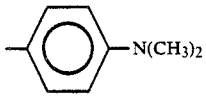  |
| (I)-2-63 | H | 2-$CH_3$ | 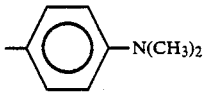  | 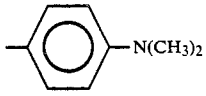  |
| (I)-2-64 | H | 2-$CH_3$ | 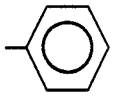 | 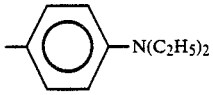  |
| (I)-2-65 | H | 2-$CH_3$ | 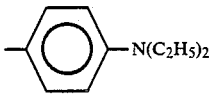  | 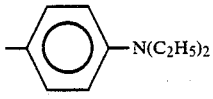  |
| (I)-2-66 | H | 2-$CH_3$ | 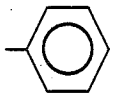 | 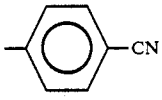  |
| (I)-2-67 | H | 2-$CH_3$ | 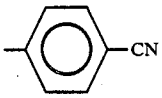  | 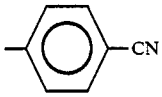  |
| (I)-2-68 | H | 3-$CH_3$ | —$CH_3$ | —$CH_3$ |
| (I)-2-69 | H | 3-$CH_3$ | —$CH_3$ | 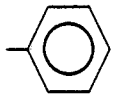 |
| (I)-2-70 | H | 3-$CH_3$ | —$C_2H_5$ | —$C_2H_5$ |
| (I)-2-71 | H | 3-$CH_3$ | —$C_2H_5$ | 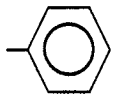 |
| (I)-2-72 | H | 3-$CH_3$ | 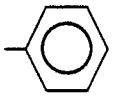 | 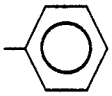 |

TABLE 2-continued
Amino Compound (I)-2
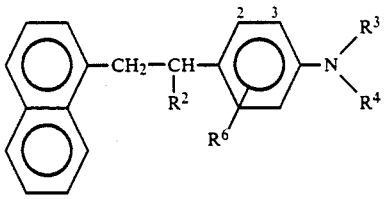
| Amino Compounds | $R^2$ | $R^6$ | $R^3$ | $R^4$ |
|---|---|---|---|---|
| (I)-2-73 | H | 3-$CH_3$ | 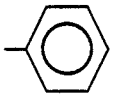 | 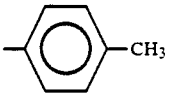 |
| (I)-2-74 | H | 3-$CH_3$ | 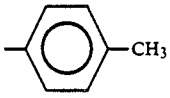 | 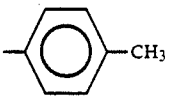 |
| (I)-2-75 | H | 3-$CH_3$ | 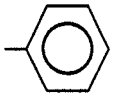 | 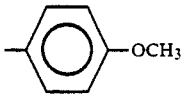 |
| (I)-2-76 | H | 3-$CH_3$ | 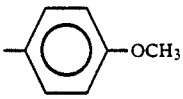 | 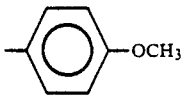 |
| (I)-2-77 | H | 3-$CH_3$ | 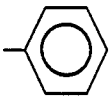 | 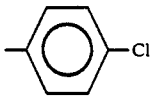 |
| (I)-2-78 | H | 3-$CH_3$ | 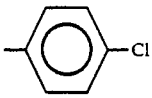 | 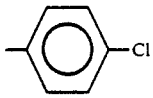 |
| (I)-2-79 | H | 3-$CH_3$ | 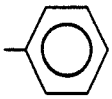 | 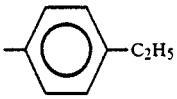 |
| (I)-2-80 | H | 3-$CH_3$ | 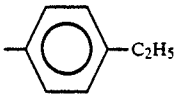 | 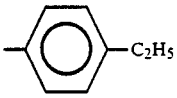 |
| (I)-2-81 | H | 3-$CH_3$ | $-C_2H_5$ | $-C_2H_5$ |
| (I)-2-82 | H | 3-$CH_3$ | $-C_2H_5$ | 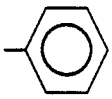 |
| (I)-2-83 | H | 3-$CH_3$ | 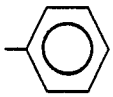 | 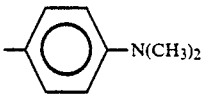 |
| (I)-2-84 | H | 3-$CH_3$ | 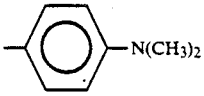 | 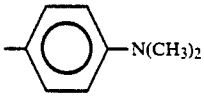 |

TABLE 2-continued
Amino Compound (I)-2
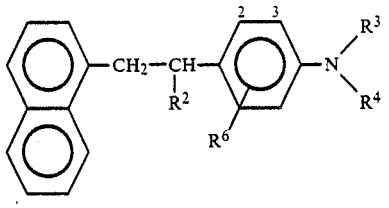
| Amino Compounds | $R^2$ | $R^6$ | $R^3$ | $R^4$ |
|---|---|---|---|---|
| (I)-2-85 | H | 3-$CH_3$ | 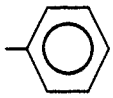 | 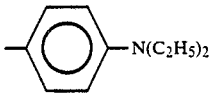 |
| (I)-2-86 | H | 3-$CH_3$ | 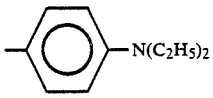 | 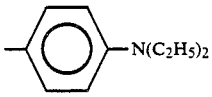 |
| (I)-2-87 | H | 3-$CH_3$ | 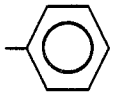 | 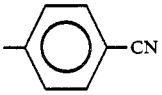 |
| (I)-2-88 | H | 3-$CH_3$ | 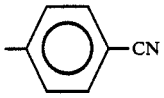 | 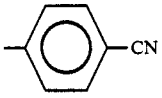 |
| (I)-2-89 | H | 2-Cl | 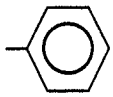 | 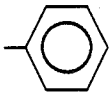 |
| (I)-2-90 | H | 2-Cl | 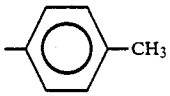 | 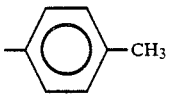 |
| (I)-2-91 | H | 2-Cl | 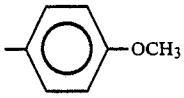 | 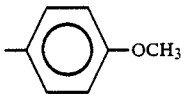 |
| (I)-2-92 | H | 2-$OCH_3$ | 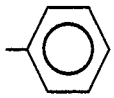 | 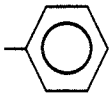 |
| (I)-2-93 | H | 2-$OCH_3$ | 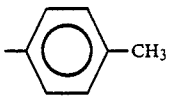 | 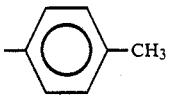 |
| (I)-2-94 | H | 2-$OCH_3$ | 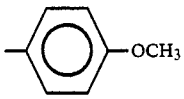 | 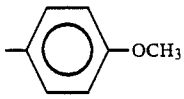 |
| (I)-2-95 | H | 2-$OCH_3$ | 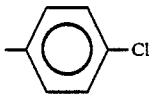 | 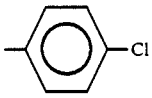 |

TABLE 2-continued
Amino Compound (I)-2
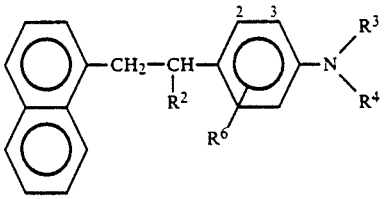
| Amino Compounds | $R^2$ | $R^6$ | $R^3$ | $R^4$ |
|---|---|---|---|---|
| (I)-2-96 | 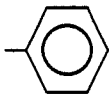 | H | $-CH_3$ | $-CH_3$ |
| (I)-2-97 | 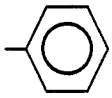 | H | 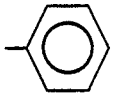 | 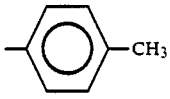 |
| (I)-2-98 | 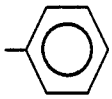 | H | 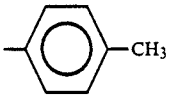 | 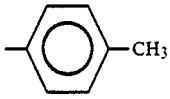 |
| (I)-2-99 | 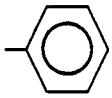 | H | 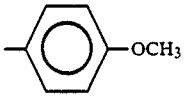 | 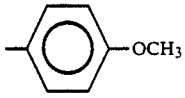 |
| (I)-2-100 | 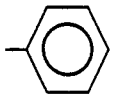 | H | 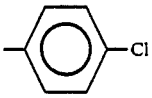 | 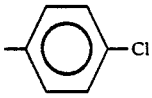 |
| (I)-2-101 | 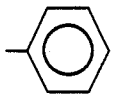 | H | 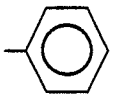 | 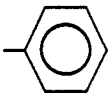 |
| (I)-2-102 | 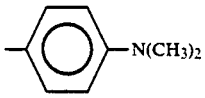 | H | $-CH_3$ | $-CH_3$ |
| (I)-2-103 | H | H | 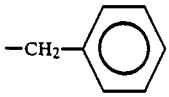 | 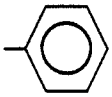 |
TABLE 3
Amino Compound (I)-3
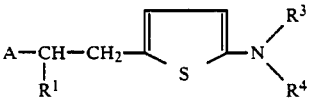
| Amino Compounds | A | $R^1$ | $R^3$ | $R^4$ |
|---|---|---|---|---|
| (I)-3-1 | 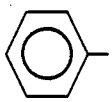 | H | 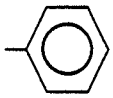 | $-CH_3$ |

TABLE 3-continued
Amino Compound (I)-3
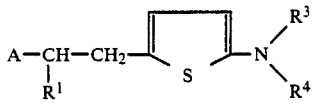
| Amino Compounds | A | $R^1$ | $R^3$ | $R^4$ |
|---|---|---|---|---|
| (I)-3-2 | 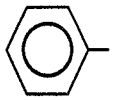 | H | 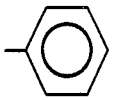 | 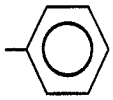 |
| (I)-3-3 | 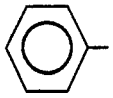 | H | 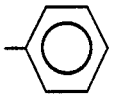 | 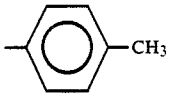 |
| (I)-3-4 | 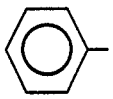 | H | 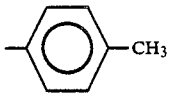 | 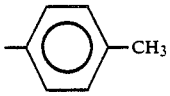 |
| (I)-3-5 | 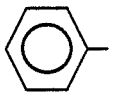 | H | 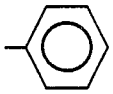 | 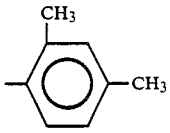 |
| (I)-3-6 | 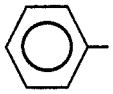 | H | 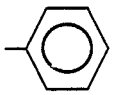 | 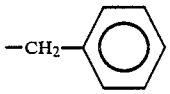 |
| (I)-3-7 | 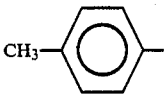 | H | 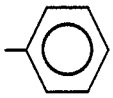 | 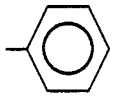 |
| (I)-3-8 | 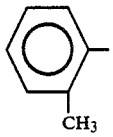 | H | 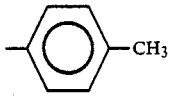 | 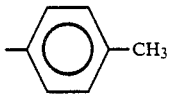 |
| (I)-3-9 | 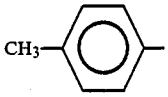 | H | 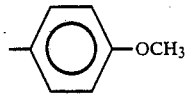 | 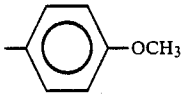 |
| (I)-3-10 | 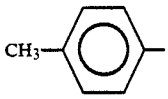 | H | 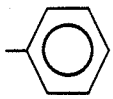 | 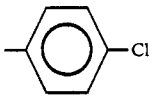 |
| (I)-3-11 | 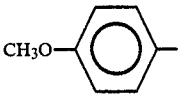 | H | 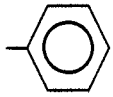 | $-C_2H_5$ |
| (I)-3-12 | 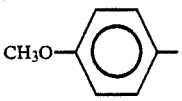 | H | 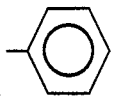 | 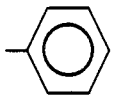 |

TABLE 3-continued
Amino Compound (I)-3
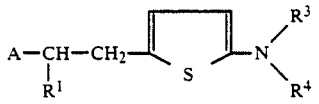
| Amino Compounds | A | $R^1$ | $R^3$ | $R^4$ |
|---|---|---|---|---|
| (I)-3-13 | $CH_3O$- | H | -$CH_3$ | -$CH_3$ |
| (I)-3-14 | -$OCH_3$ | H | | -$CH_3$ |
| (I)-3-15 | -$OCH_3$ | H | | -CN |
| (I)-3-16 | Cl- | H | | |
| (I)-3-17 | Cl- | H | -$CH_3$ | -$CH_3$ |
| (I)-3-18 | -Cl | H | -$OCH_3$ | -$OCH_3$ |
| (I)-3-19 | Cl- | H | | -$OCH_3$ |
| (I)-3-20 | Cl- | H | | -Cl |
| (I)-3-21 | | $-CH_3$ | | $-C_2H_5$ |
| (I)-3-22 | | $-CH_3$ | | |
| (I)-3-23 | | $-CH_3$ | -$OCH_3$ | -$OCH_3$ |

TABLE 3-continued
Amino Compound (I)-3
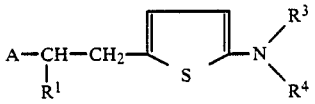
| Amino Compounds | A | $R^1$ | $R^3$ | $R^4$ |
|---|---|---|---|---|
| (I)-3-24 | 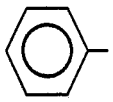 | $-CH_3$ | 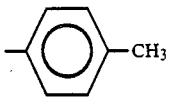 | 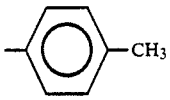 |
| (I)-3-25 | 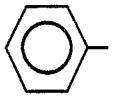 | $-CH_3$ | 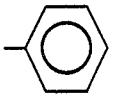 | 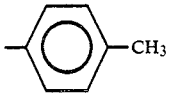 |
| (I)-3-26 | 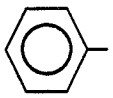 | $-CH_3$ | 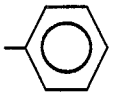 | 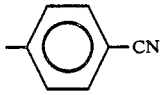 |
| (I)-3-27 | 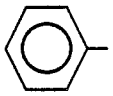 | $-CH_3$ | 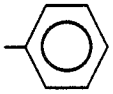 | 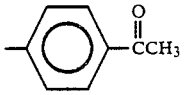 |
| (I)-3-28 | 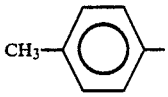 | $-CH_3$ | 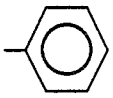 | 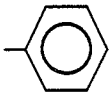 |
| (I)-3-29 | 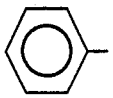 | 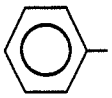 | 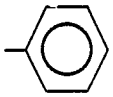 | 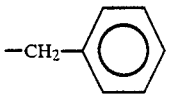 |
| (I)-3-30 | 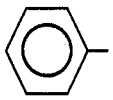 | 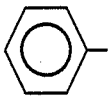 | 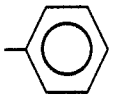 | 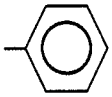 |
| (I)-3-31 | 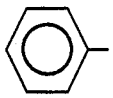 | 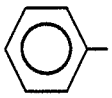 | 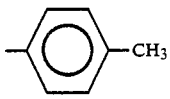 | 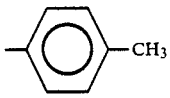 |
| (I)-3-32 | 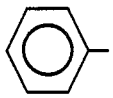 | 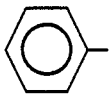 | 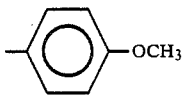 | 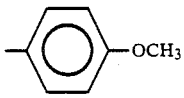 |
| (I)-3-33 | 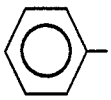 | 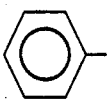 | 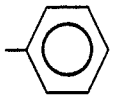 | 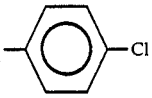 |
| (I)-3-34 | 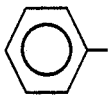 | 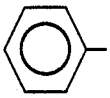 | 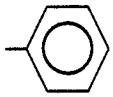 | 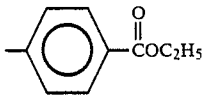 |
| (I)-3-35 | 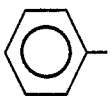 | 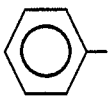 | 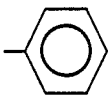 | 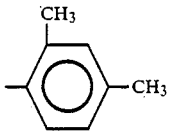 |

TABLE 3-continued
Amino Compound (I)-3
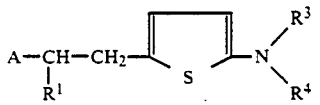
| Amino Compounds | A | $R^1$ | $R^3$ | $R^4$ |
|---|---|---|---|---|
| (I)-3-36 | 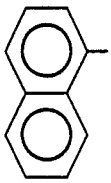 | H | 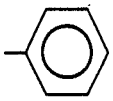 | 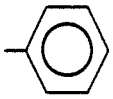 |
| (I)-3-37 | 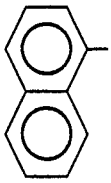 | H | 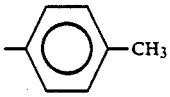 | 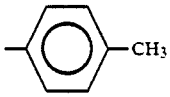 |
| (I)-3-38 | 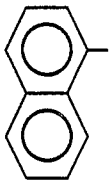 | H | 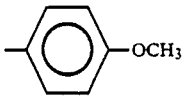 | 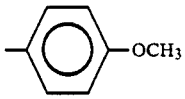 |
| (I)-3-39 | 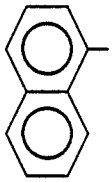 | H | 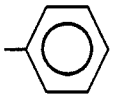 | 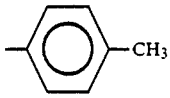 |
| (I)-3-40 | 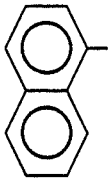 | H | 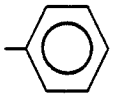 | 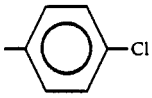 |
| (I)-3-41 | 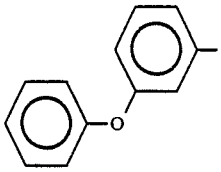 | H | 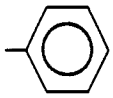 | 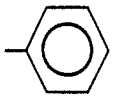 |
| (I)-3-42 | 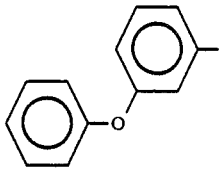 | H | 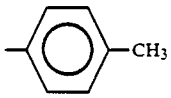 | 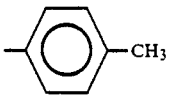 |

TABLE 3-continued
Amino Compound (I)-3
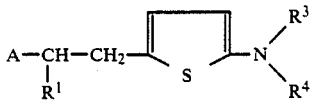
| Amino Compounds | A | $R^1$ | $R^3$ | $R^4$ |
|---|---|---|---|---|
| (I)-3-43 | 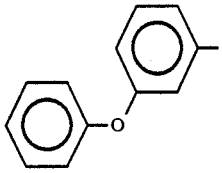 | H | 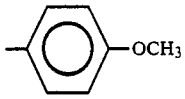 | 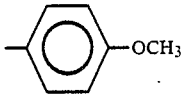 |
| (I)-3-44 | 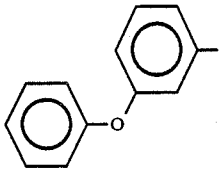 | H | 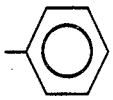 | 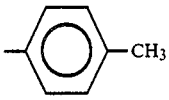 |
| (I)-3-45 | 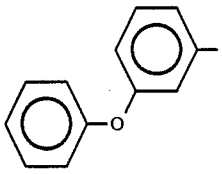 | H | 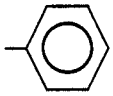 | 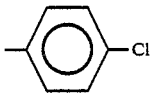 |
| (I)-3-46 | 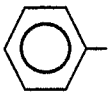 | H | 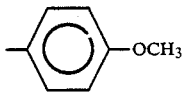 | 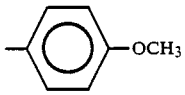 |
| (I)-3-47 | 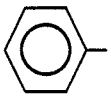 | 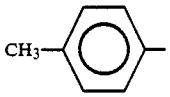 | 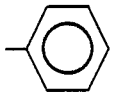 | 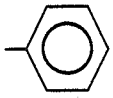 |
TABLE 4
Amino Compound (I)-4
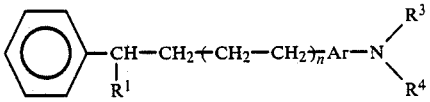
| Amino Compounds | $R^1$ | n | Ar | $R^3$ | $R^4$ |
|---|---|---|---|---|---|
| (I)-4-1 | $-CH_3$ | 0 | 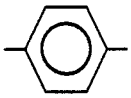 | $-CH_3$ | $-CH_3$ |
| (I)-4-2 | $-CH_3$ | 0 | 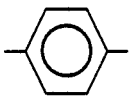 | $-C_2H_5$ | $-C_2H_5$ |
| (I)-4-3 | $-CH_3$ | 0 | 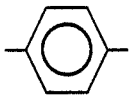 | 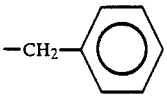 | 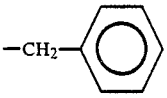 |

TABLE 4-continued
Amino Compound (I)-4
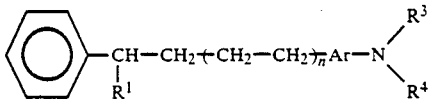
| Amino Compounds | $R^1$ | n | Ar | $R^3$ | $R^4$ |
|---|---|---|---|---|---|
| (I)-4-4 | $-CH_3$ | 0 | 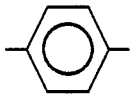 | 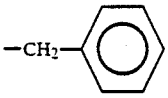 | 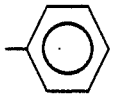 |
| (I)-4-5 | $-CH_3$ | 0 | 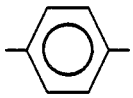 | 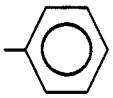 | 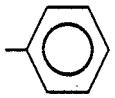 |
| (I)-4-6 | $-CH_3$ | 0 | 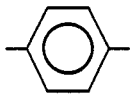 | 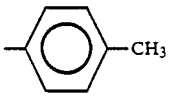 | 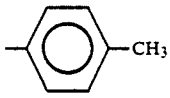 |
| (I)-4-7 | $-CH_3$ | 0 | 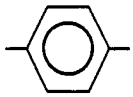 | 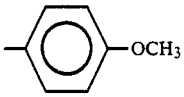 | 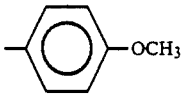 |
| (I)-4-8 | $-CH_3$ | 0 | 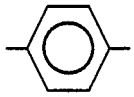 | 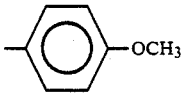 | 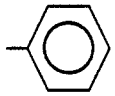 |
| (I)-4-9 | $-CH_3$ | 0 | 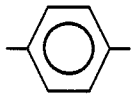 | 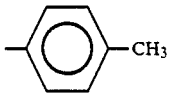 | 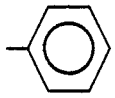 |
| (I)-4-10 | $-CH_3$ | 0 | 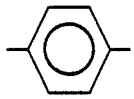 | 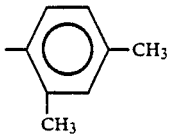 | 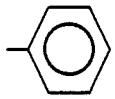 |
| (I)-4-11 | $-CH_3$ | 0 | 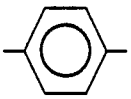 | 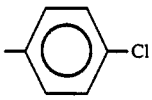 | 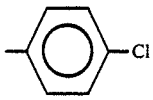 |
| (I)-4-12 | $-CH_3$ | 0 | 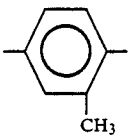 | 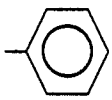 | 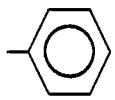 |
| (I)-4-13 | $-CH_3$ | 0 | 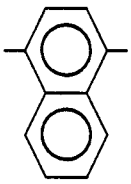 | 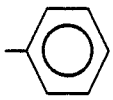 | 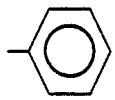 |

TABLE 4-continued
Amino Compound (I)-4
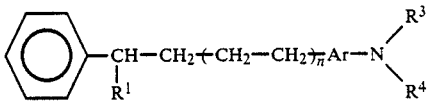
| Amino Compounds | $R^1$ | n | Ar | $R^3$ | $R^4$ |
|---|---|---|---|---|---|
| (I)-4-14 | $-CH_3$ | 0 | 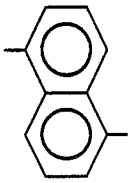 | 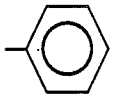 | 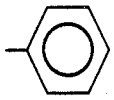 |
| (I)-4-15 | 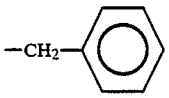 | 0 | 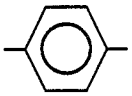 | $-CH_3$ | $-CH_3$ |
| (I)-4-16 | 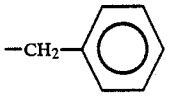 | 0 | 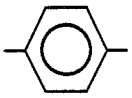 | $-C_2H_5$ | $-C_2H_5$ |
| (I)-4-17 | 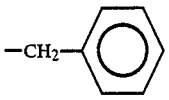 | 0 | 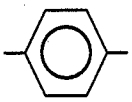 | 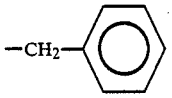 | 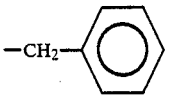 |
| (I)-4-18 | 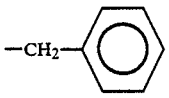 | 0 | 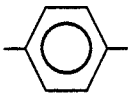 | 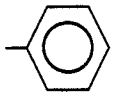 | 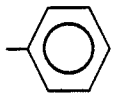 |
| (I)-4-19 | 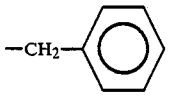 | 0 | 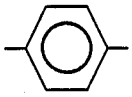 | 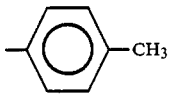 | 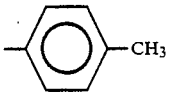 |
| (I)-4-20 | 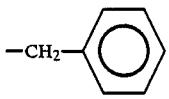 | 0 | 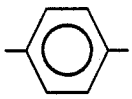 | 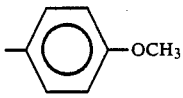 | 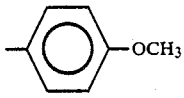 |
| (I)-4-21 | 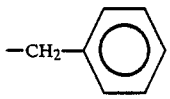 | 0 | 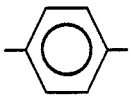 | 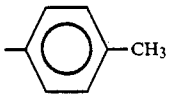 | 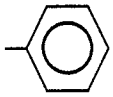 |
| (I)-4-22 | 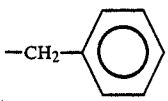 | 0 | 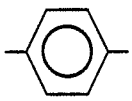 | 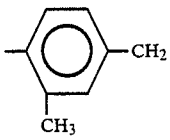 | 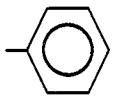 |
| (I)-4-23 | 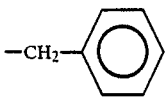 | 0 | 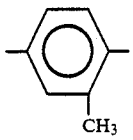 | 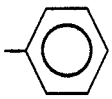 | 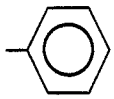 |

TABLE 4-continued
Amino Compound (I)-4
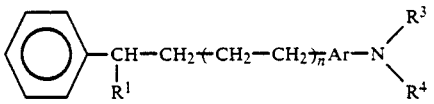
| Amino Compounds | $R^1$ | n | Ar | $R^3$ | $R^4$ |
|---|---|---|---|---|---|
| (I)-4-24 | 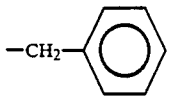 | 0 | 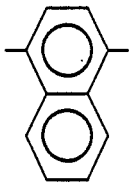 | 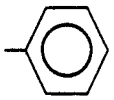 | 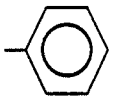 |
| (I)-4-25 | 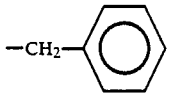 | 0 | 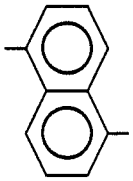 | 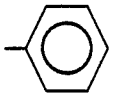 | 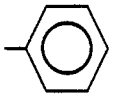 |
| (I)-4-26 | 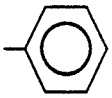 | 0 | 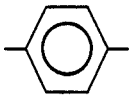 | 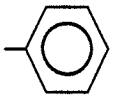 | 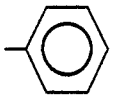 |
| (I)-4-27 | 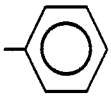 | 0 | 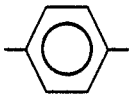 | 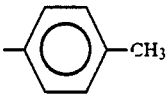 | 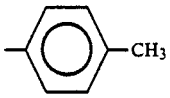 |
| (I)-4-28 | 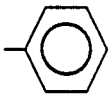 | 0 | 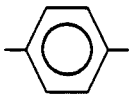 | 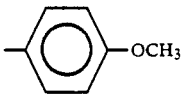 | 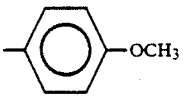 |
| (I)-4-29 | 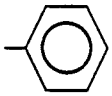 | 0 | 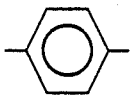 | 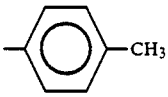 | 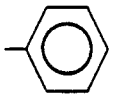 |
| (I)-4-30 | 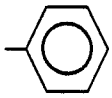 | 0 | 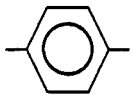 | 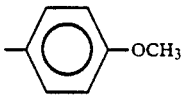 | 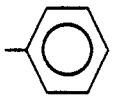 |
| (I)-4-31 | 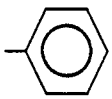 | 0 | 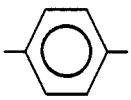 | 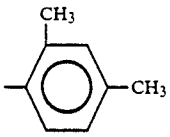 | 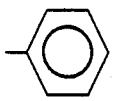 |
| (I)-4-32 | 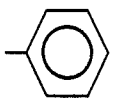 | 0 | 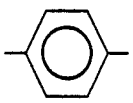 | $-CH_3$ | $-CH_3$ |
| (I)-4-33 | 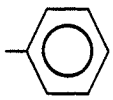 | 0 | 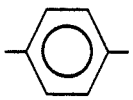 | $-C_2H_5$ | $-C_2H_5$ |

TABLE 4-continued
Amino Compound (I)-4
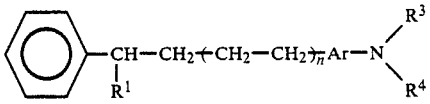
| Amino Compounds | $R^1$ | n | Ar | $R^3$ | $R^4$ |
|---|---|---|---|---|---|
| (I)-4-34 | 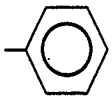 | 0 | 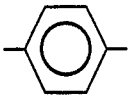 | 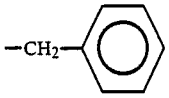 | 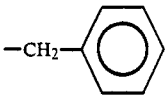 |
| (I)-4-35 | 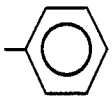 | 0 | 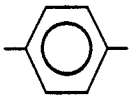 | 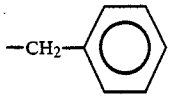 | 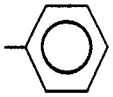 |
| (I)-4-36 | 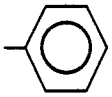 | 0 | 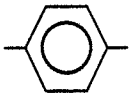 | $-CH_3$ | 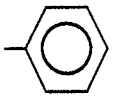 |
| (I)-4-37 | 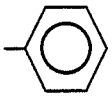 | 0 | 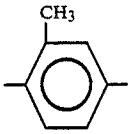 | 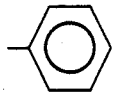 | 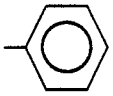 |
| (I)-4-38 | 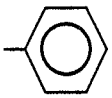 | 0 | 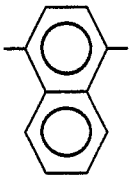 | 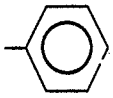 | 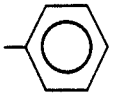 |
| (I)-4-39 | 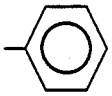 | 0 | 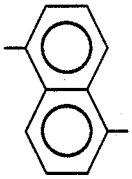 | 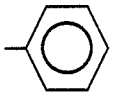 | 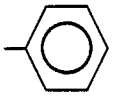 |
| (I)-4-40 | 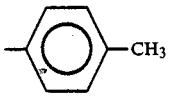 | 0 | 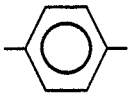 | 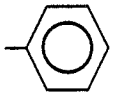 | 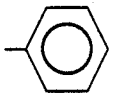 |
| (I)-4-41 | 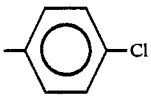 | 0 | 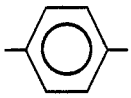 | 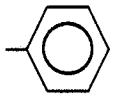 | 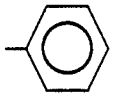 |
| (I)-4-42 | $-CH_3$ | 1 | 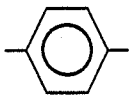 | 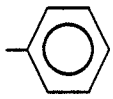 | 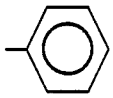 |
| (I)-4-43 | $-CH_3$ | 1 | 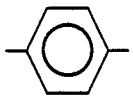 | 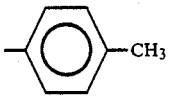 | 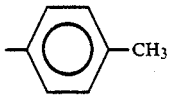 |

TABLE 4-continued
Amino Compound (I)-4
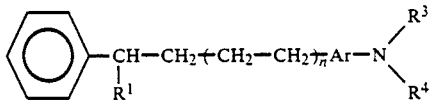
| Amino Compounds | $R^1$ | n | Ar | $R^3$ | $R^4$ |
|---|---|---|---|---|---|
| (I)-4-44 | 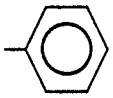 | 1 | 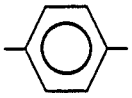 | $-CH_3$ | $-CH_3$ |
| (I)-4-45 | 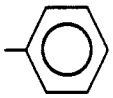 | 1 | 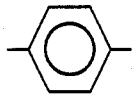 | 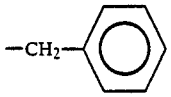 | 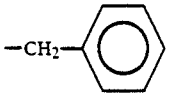 |
| (I)-4-46 | 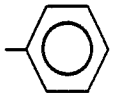 | 1 | 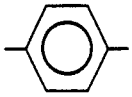 | 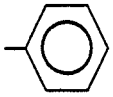 | 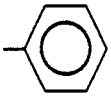 |
| (I)-4-47 | 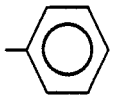 | 1 | 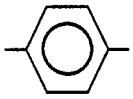 | 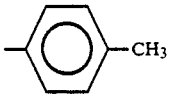 | 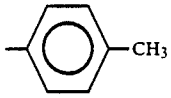 |
| (I)-4-48 | 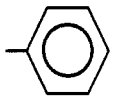 | 1 | 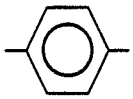 | 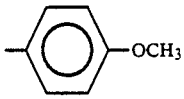 | 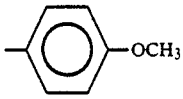 |
| (I)-4-49 | 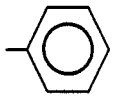 | 1 | 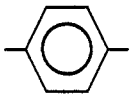 | 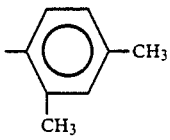 | 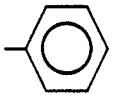 |
| (I)-4-50 | 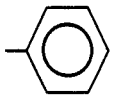 | 1 | 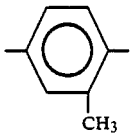 | 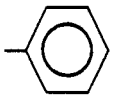 | 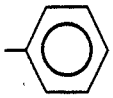 |
| (I)-4-51 | 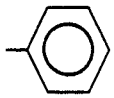 | 1 | 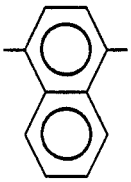 | 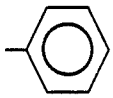 | 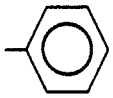 |
| (I)-4-52 | 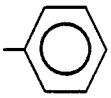 | 1 | 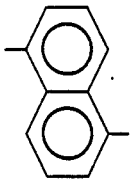 | 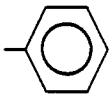 | 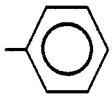 |

TABLE 5
Amino Compound (I)-5
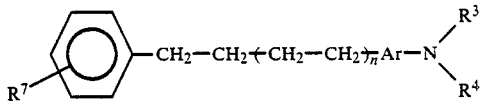
| Amino Compounds | $R^7$ | n | Ar | $R^3$ | $R^4$ |
|---|---|---|---|---|---|
| (I)-5-1 | H | 1 | 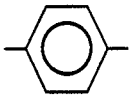 | $-CH_3$ | $-CH_3$ |
| (I)-5-2 | H | 1 | 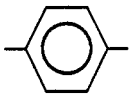 | 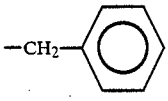 | $-CH_3$ |
| (I)-5-3 | H | 1 | 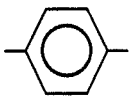 | $-CH_3$ | 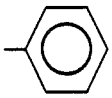 |
| (I)-5-4 | H | 1 | 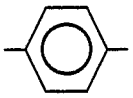 | 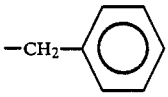 | 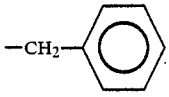 |
| (I)-5-5 | H | 1 | 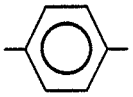 | 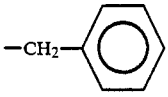 | 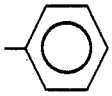 |
| (I)-5-6 | H | 1 | 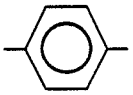 | 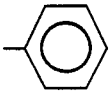 | 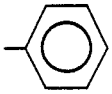 |
| (I)-5-7 | H | 1 | 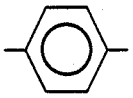 | 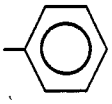 | 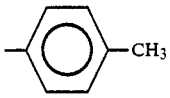 |
| (I)-5-8 | H | 1 | 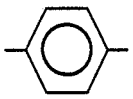 | 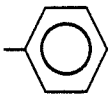 | 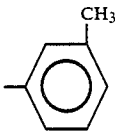 |
| (I)-5-9 | H | 1 | 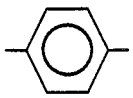 | 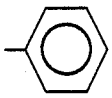 | 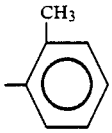 |
| (I)-5-10 | H | 1 | 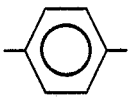 | 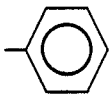 | 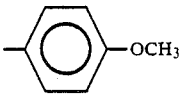 |
| (I)-5-11 | H | 1 | 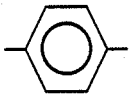 | 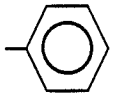 | 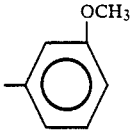 |

TABLE 5-continued
Amino Compound (I)-5
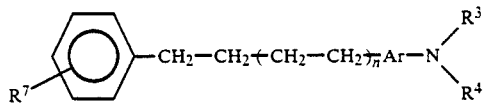
| Amino Compounds | $R^7$ | n | Ar | $R^3$ | $R^4$ |
|---|---|---|---|---|---|
| (I)-5-12 | H | 1 | 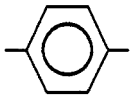 | 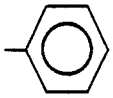 | 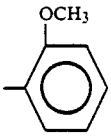 |
| (I)-5-13 | H | 1 | 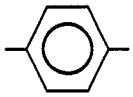 | 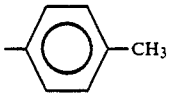 | 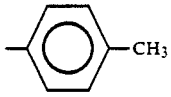 |
| (I)-5-14 | H | 1 | 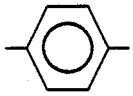 | 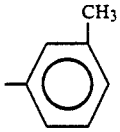 | 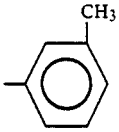 |
| (I)-5-15 | H | 1 | 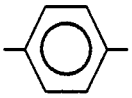 | 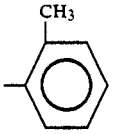 | 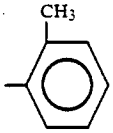 |
| (I)-5-16 | H | 1 | 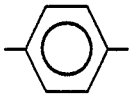 | 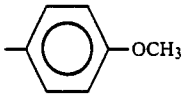 | 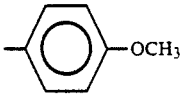 |
| (I)-5-17 | H | 1 | 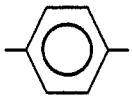 | 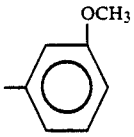 | 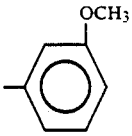 |
| (I)-5-18 | H | 1 | 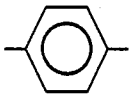 | 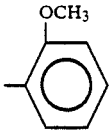 | 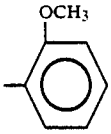 |
| (I)-5-19 | H | 1 | 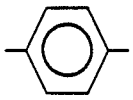 | 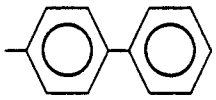 | 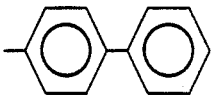 |
| (I)-5-20 | H | 1 | 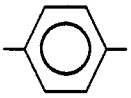 | 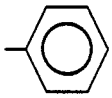 | 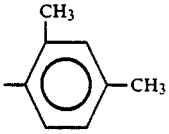 |
| (I)-5-21 | H | 1 | 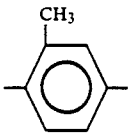 | $-CH_3$ | 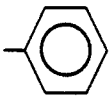 |

TABLE 5-continued
Amino Compound (I)-5
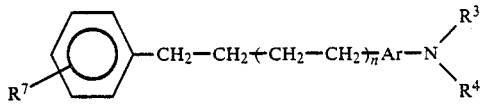
| Amino Compounds | $R^7$ | n | Ar | $R^3$ | $R^4$ |
|---|---|---|---|---|---|
| (I)-5-22 | H | 1 | 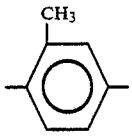 | 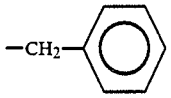 | 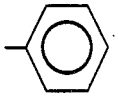 |
| (I)-5-23 | H | 1 | 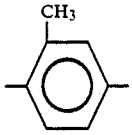 | 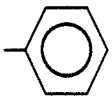 | 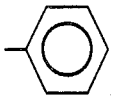 |
| (I)-5-24 | H | 1 | 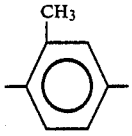 | 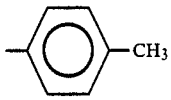 | 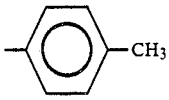 |
| (I)-5-25 | H | 1 | 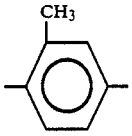 | 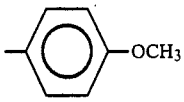 | 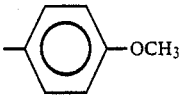 |
| (I)-5-26 | H | 1 | 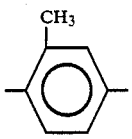 | 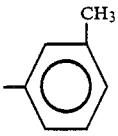 | 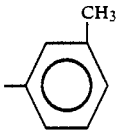 |
| (I)-5-27 | H | 1 | 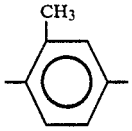 | 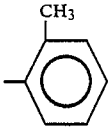 | 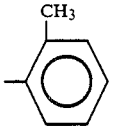 |
| (I)-5-28 | H | 1 | 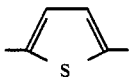 | 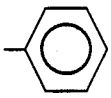 | 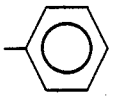 |
| (I)-5-29 | H | 1 | 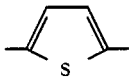 | 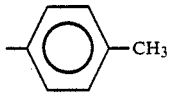 | 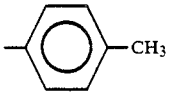 |
| (I)-5-30 | H | 1 | 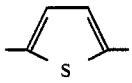 | 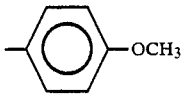 | 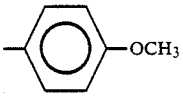 |
| (I)-5-31 | H | 1 | 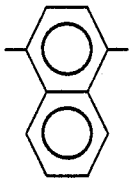 | $-CH_3$ | $-CH_3$ |

TABLE 5-continued
Amino Compound (I)-5
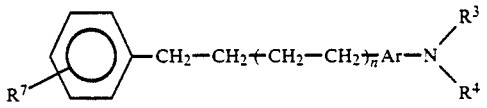
| Amino Compounds | $R^7$ | n | Ar | $R^3$ | $R^4$ |
|---|---|---|---|---|---|
| (I)-5-32 | H | 1 | 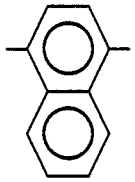 | 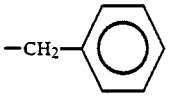 | 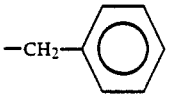 |
| (I)-5-33 | H | 1 | 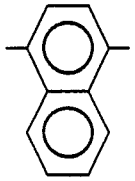 | 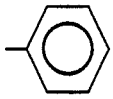 | 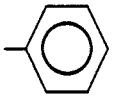 |
| (I)-5-34 | H | 1 | 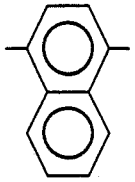 | 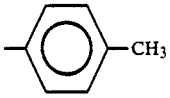 | 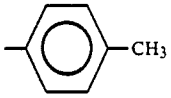 |
| (I)-5-35 | H | 1 | 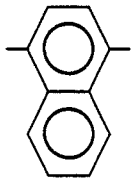 | 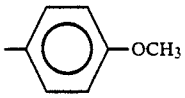 | 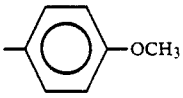 |
| (I)-5-36 | H | 1 | 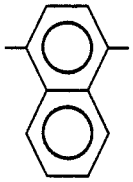 | 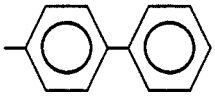 | 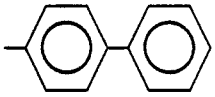 |
| (I)-5-37 | H | 2 | 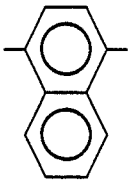 | 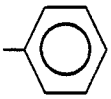 | 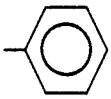 |
| (I)-5-38 | H | 2 | 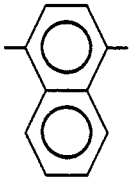 | 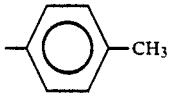 | 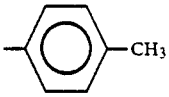 |

TABLE 5-continued
Amino Compound (I)-5
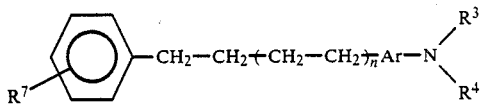
| Amino Compounds | $R^7$ | n | Ar | $R^3$ | $R^4$ |
|---|---|---|---|---|---|
| (I)-5-39 | H | 2 | 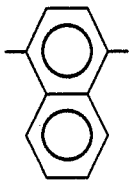 | 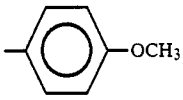 | 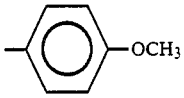 |
| (I)-5-40 | H | 2 | 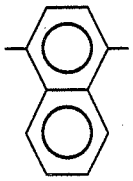 | 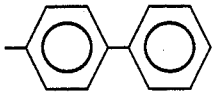 | 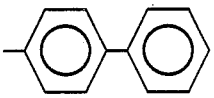 |
| (I)-5-41 | H | 2 | 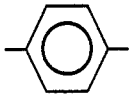 | $-CH_3$ | $-CH_3$ |
| (I)-5-42 | H | 2 | 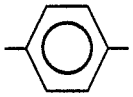 | $-CH_3$ | 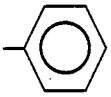 |
| (I)-5-43 | H | 2 | 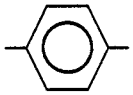 | $-CH_2-$ 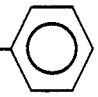 | $-CH_2-$ 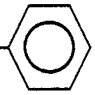 |
| (I)-5-44 | H | 2 | 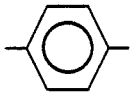 | $-CH_2-$ 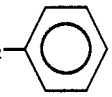 | 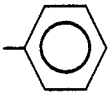 |
| (I)-5-45 | H | 2 | 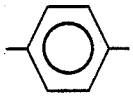 | 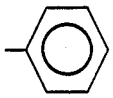 | 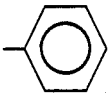 |
| (I)-5-46 | H | 2 | 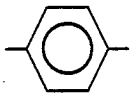 | 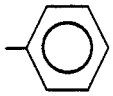 | 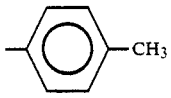 |
| (I)-5-47 | H | 2 | 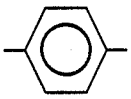 | 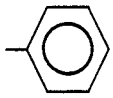 | 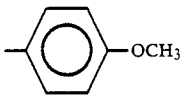 |
| (I)-5-48 | H | 2 | 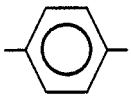 | 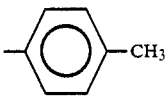 | 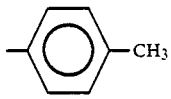 |

TABLE 5-continued
Amino Compound (I)-5
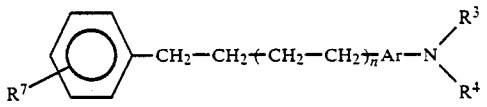
| Amino Compounds | $R^7$ | n | Ar | $R^3$ | $R^4$ |
|---|---|---|---|---|---|
| (I)-5-49 | H | 2 | 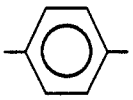 | 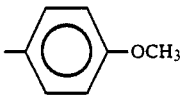 | 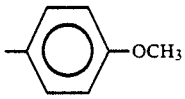 |
| (I)-5-50 | H | 2 | 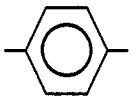 | 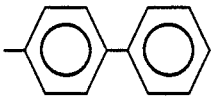 | 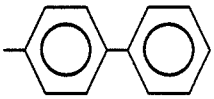 |
| (I)-5-51 | H | 2 | 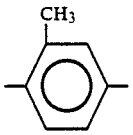 | 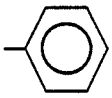 | 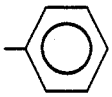 |
| (I)-5-52 | H | 2 | 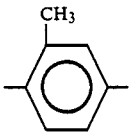 | 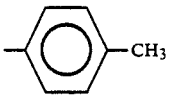 | 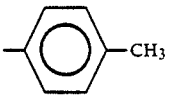 |
| (I)-5-53 | H | 2 | 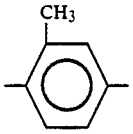 | 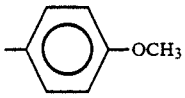 | 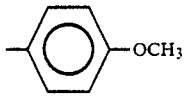 |
| (I)-5-54 | H | 2 | 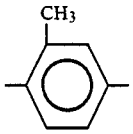 | 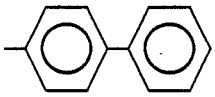 | 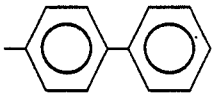 |
| (I)-5-55 | H | 2 | 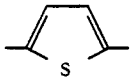 | 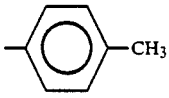 | 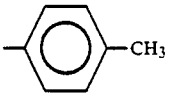 |
| (I)-5-56 | H | 2 | 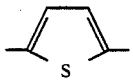 | 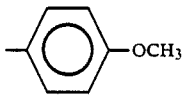 | 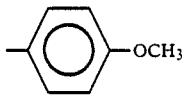 |
| (I)-5-57 | H | 2 | 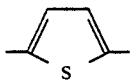 | 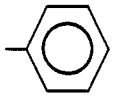 | 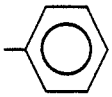 |
| (I)-5-58 | p-$CH_3$ | 1 | 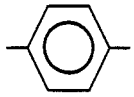 | 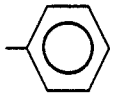 | 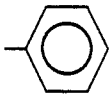 |
| (I)-5-59 | p-$CH_3$ | 1 | 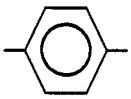 | 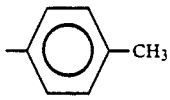 | 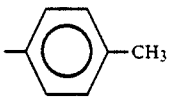 |

TABLE 5-continued
Amino Compound (I)-5
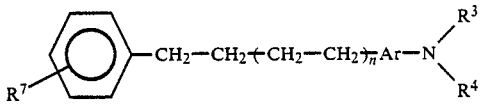
| Amino Compounds | $R^7$ | n | Ar | $R^3$ | $R^4$ |
|---|---|---|---|---|---|
| (I)-5-60 | p-$CH_3$ | 1 | 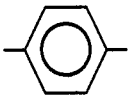 | 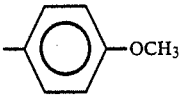 | 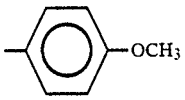 |
| (I)-5-61 | p-$CH_3$ | 1 | 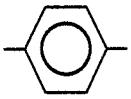 | 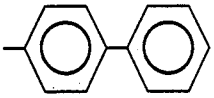 | 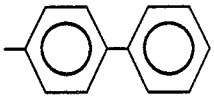 |
| (I)-5-62 | p-$CH_3$ | 1 | 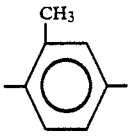 | 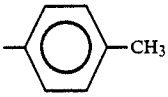 | 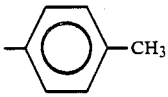 |
| (I)-5-63 | p-$CH_3$ | 2 | 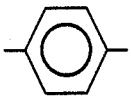 | 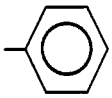 | 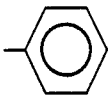 |
| (I)-5-64 | p-$CH_3$ | 2 | 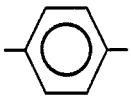 | 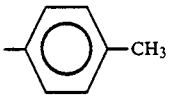 | 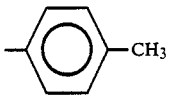 |
| (I)-5-65 | p-$CH_3$ | 2 | 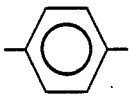 | 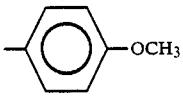 | 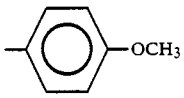 |
| (I)-5-66 | p-$CH_3$ | 2 | 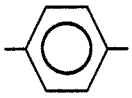 | 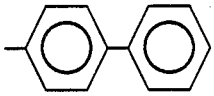 | 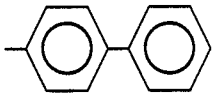 |
| (I)-5-67 | p-$CH_3$ | 1 | 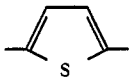 | 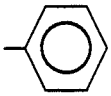 | 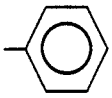 |
| (I)-5-68 | p-$CH_3$ | 1 | 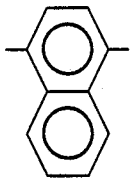 | 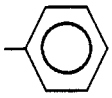 | 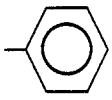 |
| (I)-5-69 | p-$CH_3$ | 1 | 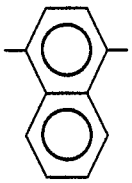 | 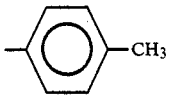 | 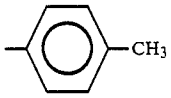 |

TABLE 5-continued
Amino Compound (I)-5
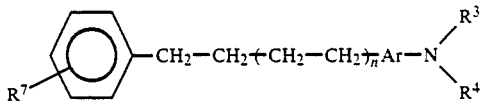
| Amino Compounds | $R^7$ | n | Ar | $R^3$ | $R^4$ |
|---|---|---|---|---|---|
| (I)-5-70 | p-$CH_3$ | 1 | 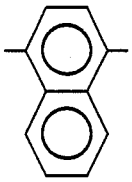 | 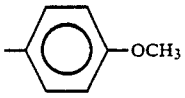 | 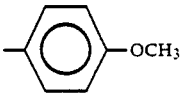 |
| (I)-5-71 | p-$OCH_3$ | 1 | 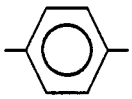 | 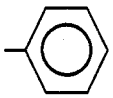 | 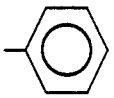 |
| (I)-5-72 | p-$OCH_3$ | 1 | 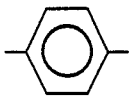 | 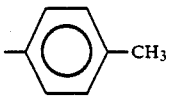 | 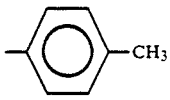 |
| (I)-5-73 | p-$OCH_3$ | 1 | 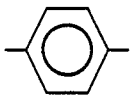 | 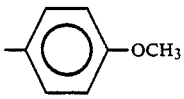 | 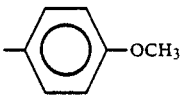 |
| (I)-5-74 | p-$OCH_3$ | 2 | 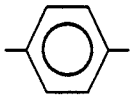 | 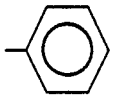 | 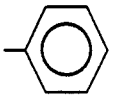 |
| (I)-5-75 | p-Cl | 1 | 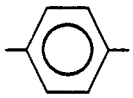 | 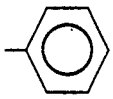 | 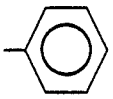 |
| (I)-5-76 | p-Cl | 1 | 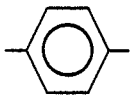 | 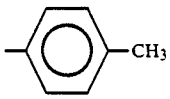 | 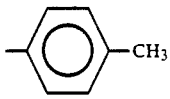 |
| (I)-5-77 | p-Cl | 1 | 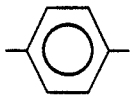 | 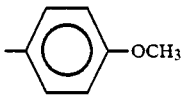 | 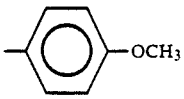 |
| (I)-5-78 | p-Cl | 2 | 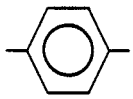 | 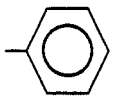 | 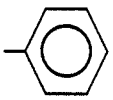 |
| (I)-5-79 | p-Cl | 2 | 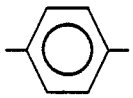 | 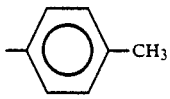 | 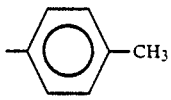 |
| (I)-5-80 | m-$OC_6H_5$ | 1 | 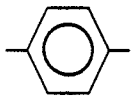 | 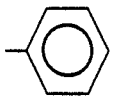 | 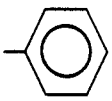 |

TABLE 5-continued
Amino Compound (I)-5
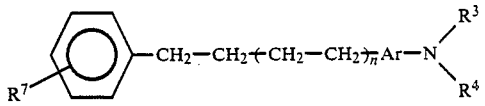
| Amino Compounds | $R^7$ | n | Ar | $R^3$ | $R^4$ |
|---|---|---|---|---|---|
| (I)-5-81 | m-$OC_6H_5$ | 1 | 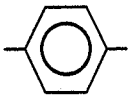 | 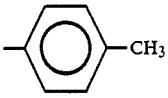 | 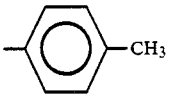 |
| (I)-5-82 | m-$OC_6H_5$ | 1 | 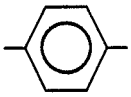 | 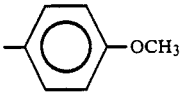 | 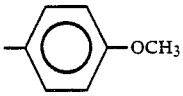 |
| (I)-5-83 | m-$OC_6H_5$ | 1 | 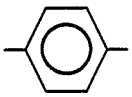 | 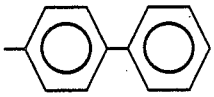 | 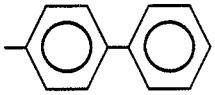 |
| (I)-5-84 | m-$OC_6H_5$ | 2 | 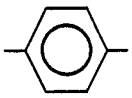 | 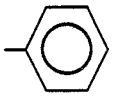 | 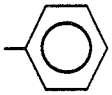 |
| (I)-5-85 | m-$OC_6H_5$ | 2 | 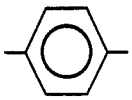 | 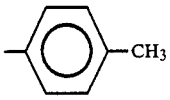 | 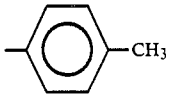 |
| (I)-5-86 | m-$OC_6H_5$ | 2 | 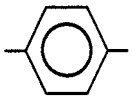 | 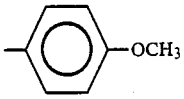 | 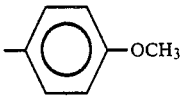 |
| (I)-5-87 | m-$OC_6H_5$ | 2 | 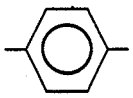 | 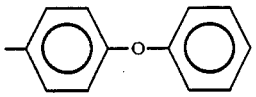 | 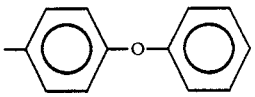 |
| (I)-5-88 | m-$OC_6H_5$ | 2 | 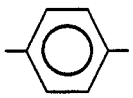 | 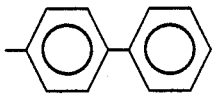 | 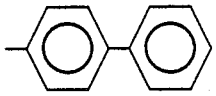 |
| (I)-5-89 | p-Cl | 2 | 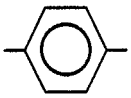 | 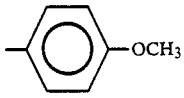 | 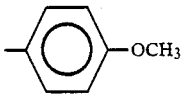 |
| (I)-5-90 | m-$CH_3$ | 1 | 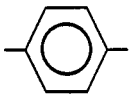 | 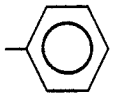 | 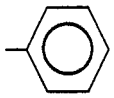 |
| (I)-5-91 | m-$CH_3$ | 1 | 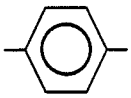 | 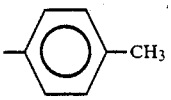 | 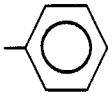 |
| (I)-5-92 | 4-$N(CH_3)_2$ | 1 | 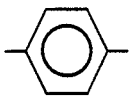 | 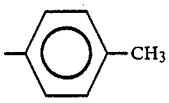 | 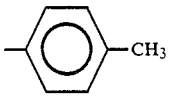 |

TABLE 5-continued

Amino Compound (I)-5

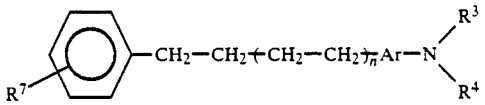

| Amino Compounds | $R^7$ | n | Ar | $R^3$ | $R^4$ |
|---|---|---|---|---|---|
| (I)-5-93 | 4-$N(C_2H_5)_2$ | 1 | 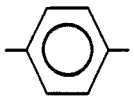 | 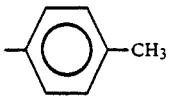 | 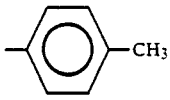 |
| (I)-5-94 | 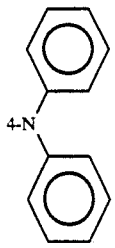 | 1 | 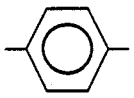 | 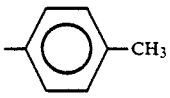 | 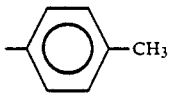 |
| (I)-5-95 | 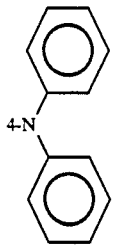 | 1 | 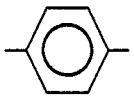 | 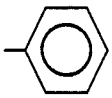 | 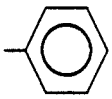 |
| (I)-5-96 | 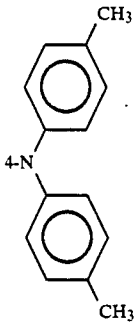 | 1 | 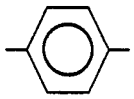 | 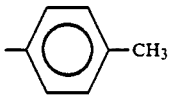 | 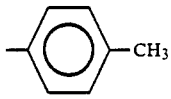 |

In the photoconductors according to the present invention, at least one amino compound of the formula (I) is contained in the photoconductive layers 2a, 2b and 2c. The amino compounds can be employed in different ways, for example, as shown in FIG. 1, FIG. 2 and FIG. 3.

In the photoconductor as shown in FIG. 1, a photoconductive layer 2a is formed on an electroconductive support 1, which photoconductive layer 2a comprises an amino compound, a sensitizer dye and a binder agent. In this photoconductor, the amino compound works as a photoconductor material, through which charge carriers which are necessary for the light decay of the photoconductor are generated and transported. However, the amino compound itself scarcely absorbs light in the visible light range and, therefore, it is necessary to add a sensitizer dye which absorbs light in the visible light range in order to form latent electrostatic images by use of visible light.

Referring to FIG. 2, there is shown an enlarged cross-sectional view of another embodiment of an electrophotographic photoconductor according to the present invention. In the figure, reference numeral 1 indicates an electroconductive support. On the electroconductive support 1, there is formed a photoconductive layer 2b comprising a charge generating material 3 dispersed in a charge transporting medium 4 comprising an amino compound and a binder agent. In this embodiment, the amino compound works as a charge transporting material; and the amino compound and the binder agent in combination constitute the charge transporting medium 4. The charge generating material 3, which is, for example, an inorganic or organic pigment, generates charge carriers. The charge transporting medium 4 accepts the charge carriers generated by the charge generating material 3 and transports those charge carriers.

In this electrophotographic photoconductor, it is basically necessary that the light-absorption wavelength regions of the charge generating material 3 and the amino compound do not overlap in the visible light range. This is because, in order that the charge generating material 3 produce charge carriers efficiently, it is necessary that light pass through the charge transporting medium 4 and reach the surface of the charge generating material 3. Since the amino compounds of the above described general formula do not substantially absorb light in the visible range, they can work effectively as charge transporting materials in combination with the charge generating material 3 which absorbs the light in the visible region and generates charge carriers.

Referring to FIG. 3, there is shown an enlarged cross-sectional view of a further embodiment of an electrophotographic photoconductor according to the present invention. In the figure, there is formed on the electroconductive support 1 a two-layered photoconductive layer 2c comprising a charge generating layer 5 consisting essentially of the charge generating material 3, and a charge transporting layer 6 containing an amino compound of the previously described formula.

In this photoconductor, light which has passed through the charge transporting layer 6 reaches the charge generating layer 5, and charge carriers are generated within the charge generating layer 5. The charge carriers which are necessary for the light decay for latent electrostatic image formation are generated by the charge generating material 3 and accepted and transported by the charge transporting layer 6. In the charge transporting layer 6, the amino compound mainly works for transporting charge carriers. The generation and transportation of the charge carriers are performed by the same mechanism as that in the photoconductor shown in FIG. 2.

When an electrophotographic photoconductor according to the present invention as shown in FIG. 1 is prepared, at least one amino compound of the previously described formula (I) is dispersed in a binder resin solution, and a sensitizer dye is then added to the mixture, so that a photoconductive layer coating liquid is prepared. The thus prepared photoconductive layer coating liquid is coated on an electroconductive support 1 and dried, so that a photoconductive layer 2a is formed on the electroconductive support 1.

It is preferable that the thickness of the photosensitive layer 2a be in the range of 3 μm to 50 μm, more preferably in the range of 5 μm to 20 μm. It is preferable that the amount of the amino compound contained in the photoconductive layer 2a be in the range of 30 wt.% to 70 wt.% of the total weight of the photoconductive layer 2a, more preferably about 50 wt.% of the total weight of the photoconductive layer 2a. Further, it is preferable that the amount of the sensitizer dye contained in the photoconductive layer 2a be in the range of 0.1 wt.% to 5 wt.% of the total weight of the photoconductive layer 2a, more preferably in the range of 0.5 wt.% to 3 wt.%, of the total weight of the photoconductive layer 2a.

As the sensitizer dye, the following can be employed in the present invention: Triarylmethane dyes, such as Brilliant Green, Victoria Blue B, Methyl Violet, Crystal Violet, and Acid Violet 6B; xanthene dyes, such as Rhodamine B, Rhodamine 6G, Rhodamine G Extra, Eosin S, Erythrosin, Rose Bengale, and Fluorescein; thiazine dyes, such as Methylene Blue; cyanin dyes, such as cyanin; and pyrylium dyes, such as 2,6-diphenyl-4-(N,N-dimethylaminophenyl) thiapyrylium perchlorate and benzopyrylium salt (Japanese Patent Publication No. 48-25658). These sensitizer dyes can be used alone or in combination.

An electrophotographic photoconductor according to the present invention as shown in FIG. 2 can be prepared, for example, as follows. A charge generating material in the form of small particles is dispersed in a solution of one or more amino compounds and a binder agent. The thus prepared dispersion is coated on the electroconductive support 1 and is then dried, whereby a photoconductive layer 2b is formed on the electroconductive support 1.

It is preferable that the thickness of the photoconductive layer 2b be in the range of 3 μm to 50 μm, more preferably in the range of 5 μm to 20 μm. It is preferable that the amount of the amino compound contained in the photoconductive layer 2b be in the range of 10 wt.% to 95 wt.% of the total weight of the photoconductive layer 2b. Further, it is preferable that the amount of the charge generating material 3 contained in the photoconductive layer 2b be in the range of 0.1 wt.% to 50 wt.%, more preferably in the range of 1 wt.% to 20 wt.%, of the total weight of the photoconductive layer 2b.

As the charge generating material 3, the following can be employed in the present invention: Inorganic pigments, such as selenium, a selenium-tellurium alloy, cadmium sulfide, a cadmium sulfide - selenium alloy, and α-silicon; and organic pigments, for example, C.I. Pigment Blue 25 (C.I. 21180), C.I. Pigment Red 41 (C.I. 21200), C.I. Acid Red 52 (C.I. 45100), and C.I. Basic Red 3 (C.I. 45210); azo pigments having a carbazole skeleton (Japanese Laid-Open Patent Application No. 53-95033), azo pigments having a distyrylbenzene skeleton (Japanese Laid-Open Patent Application No. 53-133445), azo pigments having a triphenylamine skeleton (Japanese Laid-Open Patent Application No. 53-132347), azo pigments having a dibenzothiophene skeleton (Japanese Laid-Open Patent Application No. 54-21728), azo pigments having an oxazole skeleton (Japanese Laid-Open Patent Application No. 54-12742), azo pigments having a fluorenone skeleton (Japanese Laid-Open Patent Application No. 54-22834), azo pigments having a bisstilbene skeleton (Japanese Laid-Open Patent Application No. 54-17733), azo pigments having a distyryl oxadiazole skeleton (Japanese Laid-Open Patent Application No. 54-2129), azo pigments having a distyryl carbazole skeleton (Japanese Laid-Open Patent Application No. 54-14967); phthalocyanine-type pigments such as C.I. Pigment Blue 16 (C.I. 74100); Indigo-type pigments such as C.I. Vat Brown 5 (C.I. 73410) and C.I. Vat Dye (C.I. 73030); and perylene-type pigments, such as Algo Scarlet B (made by Bayer Co., Ltd.) and Indanthrene Scarlet R (made by Bayer Co., Ltd). These charge generating materials can be used alone or in combination.

An electrophotographic photoconductor according to the present invention as shown in FIG. 3 can be prepared, for example, as follows. A charge generating material 3 is vacuum-evaporated on the electroconductive support 1, whereby a charge generating layer 5 is formed. Alternatively, a charge generating material 3 in the form of fine particles is dispersed in a solution of a binder agent, and this dispersion is applied to the electroconductive support material 1 and then dried, and, if necessary, the applied layer is subjected to buffing to make the surface smooth or to adjust the thickness of the layer to a predetermined thickness, whereby a charge generating layer 5 is formed. A charge transporting layer 6 is then formed on the charge generating layer 5 by applying a solution of one or more amino compounds and a binder agent to the charge generating layer 5 and then drying. In this photoconductor, the charge generating material employed is the same as that employed in the photoconductor shown in FIG. 2.

It is preferable that the thickness of the charge generating layer 5 be 5 μm or less, more preferably 2 μm or less. It is preferable that the thickness of the charge transporting layer 6 be in the range of 3 μm to 50 μm, more preferably in the range of 5 μm to 20 μm. In the case where the charge generating layer 5 comprises a charge generating material in the form of fine particles, dispersed in a binder agent, it is preferable that the amount of the charge generating material in the charge generating layer 5 be in the range of 10 wt.% to 95 wt.% of the entire weight of the charge generating layer 5, more preferably in the range of about 50 wt.% to 90 wt.%. Further, it is preferable that the amount of the amino compound contained in the charge transporting layer 6 be in the range of 10 wt.% to 95 wt.%, more preferably in the range of 30 wt.% to 90 wt.% of the total weight of the charge transporting layer 6.

As the electroconductive support 1 for use in the present invention, a metal plate or metal foil, for example, made of aluminum, a plastic film on which a metal, for example, aluminum, is evaporated, or paper which has been treated so as to be electroconductive, can be employed.

As the binder agent for use in the present invention, condensation resins, such as polyamide, polyurethane, polyester, epoxy resin, polyketone and polycarbonate; and vinyl polymers such as polyvinylketone, polystyrene, poly-N-vinylcarbazole and polyacrylamide, can be used.

Other conventional electrically insulating and adhesive resins can also be used as the binder agent in the present invention. When necessary, there can be added to the binder resins a plasticizer, for example, halogenated paraffin, polybiphenyl chloride, dimethylnaphthalene and dibutyl phthalate.

In the above described photoconductors according to the present invention, if necessary, an adhesive or barrier layer can be interposed between the electroconductive support material and the photoconductive layer. The adhesive layer or the barrier layer can be made of, for example, polyamide, nitrocellulose, or aluminum oxide. It is preferable that the thickness of the adhesive layer or barrier layer be 1 μm or less.

When copying is performed by use of the photoconductors according to the present invention, the surface of the photoconductor is charged uniformly in the dark to a predetermined polarity. The uniformly charged photoconductor is exposed to a light image so that a latent electrostatic image is formed on the photoconductor. The thus formed latent electrostatic image is developed by a developer to a visible image, and, when necessary, the developed image can be transferred to a sheet of paper. The photoconductors according to the present invention have high photosensitivity and excellent flexibility.

Preparation of Amino Compound (I)-1-6 in Table 1

10.42 g of 4-N,N-diphenylaminostilbene was dissolved in 100 ml of dioxane. To this solution, 1.04 g of a 5% palladium-carbon was added and the 4-N,N-diphenylaminostilbene in the mixture was hydrogenated with hydrogen at a pressure of 1 atm at 25° C. in a shaker hydrogenation apparatus. After the hydrogenation, the reaction mixture was filtered together with sellaite to obtain a filtrate. The filtrate was distilled under reduced pressure to remove dioxane therefrom, so that a colorless oily material was obtained. The oily material was chromatographed over silica gel - toluene, whereby 9.03 g of 4-phenethyltriphenylamine, which is a colorless viscous liquid, was obtained in a 86% yield.

The results of the elemental analysis of the thus obtained amino compound (I)-1-6, 4-phenethyltriphenylamine, were as follows:

| | % C | % H | % N |
|---|---|---|---|
| Found | 89.27 | 6.61 | 4.02 |
| Calculated | 89.34 | 6.65 | 4.01 |

The above calculation was based on the formula for 4-phenethyltriphenylamine of $C_{26}H_{23}N$.

An infrared spectrum of the 4-phenethyltriphenylamine, taken by use of a KBr pellet, indicated the disappearance of the absorption based on the out-of-plane vibrations of the trans-olefin at 965 $cm^{-1}$.

Preparation of embodiments of an electrophotographic photoconductor according to the present invention will now be explained in detail by referring to the following examples.

EXAMPLE 1-1

The following components were ground and dispersed in a ball mill to prepare a charge generating layer coating liquid:

| | Parts by Weight |
|---|---|
| Diane Blue (C.I. Pigment Blue 25, C.I. 21180) (a charge generating pigment of the following formula (CG-1)) | 76 |

-continued

| | Parts by Weight |
|---|---|
| 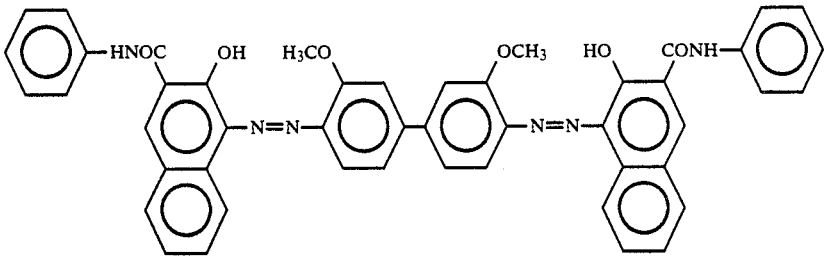 (CG-1) | |
| 2% tetrahydrofuran solution of a polyester resin (Vylon 200 made by Toyobo Co., Ltd.) | 1,260 |
| Tetrahydrofuran | 3,700 |

This charge generating layer coating liquid was coated by a doctor blade on the aluminum-evaporated surface of an aluminum-evaporated polyester base film, which served as an electroconductive support, so that a charge generating layer, with a thickness of about 1 μm when dried at room temperature, was formed on the electroconductive support.

Then the following components were mixed and dissolved, so that a charge transporting layer coating liquid was prepared:

| | Parts by Weight |
|---|---|
| Amino Compound (I)-1-7 in Table 1 | 2 |
| Polycarbonate resin (Panlite K 1300 made by Teijin Limited.) | 2 |
| Tetrahydrofuran | 16 |

The thus prepared charge transporting layer coating liquid was coated on the aforementioned charge generating layer by a doctor blade and dried at 80° C. for 2 minutes and then at 105° C. for 5 minutes, so that a charge transporting layer with a thickness of about 20 μm was formed on the charge generating layer; thus, an electrophotographic photoconductor No. 1-1 according to the present invention was prepared.

The electrophotographic photoconductor No. 1-1 was charged negatively in the dark under application of −6 KV of corona charge for 20 seconds and then allowed to stand in the dark for 20 seconds without applying any charge thereto. At this moment, the surface potential $V_{po}$ (V) of the photoconductor was measured by a Paper Analyzer (Kawaguchi Electro Works, Model SP-428). The photoconductor was then illuminated by a tungsten lamp in such a manner that the illuminance on the illuminated surface of the photoconductor was 20 lux, and the exposure $E_{1/2}$ (lux·seconds) required to reduce the initial surface potential $V_{po}$(V) to ½ the initial surface potential $V_{po}$(V) was measured. The results showed that $V_{po}(V) = -920\ V$ and $E_{1/2} = 2.9$lux·seconds.

EXAMPLES 1-2 THROUGH 1-27

Example 1-1 was repeated except that the charge generating material and the amino compound which worked as the charge transporting material employed in Example 1-1 were respectively replaced by the charge generating materials and the amino compounds as listed in Table 6, whereby electrophotographic photoconductors No. 1-2 through No. 1-27 according to the present invention were prepared.

$V_{po}$ and $E_{1/2}$ of those electrophotographic photoconductors were measured in the same manner as in Example 1-1. The results are shown in Table 7.

TABLE 6
| Photo-Conductor | Charge Generating Material | Charge Transporting Material (Amino Compound in Table 1) |
|---|---|---|
| No. 1-2 | 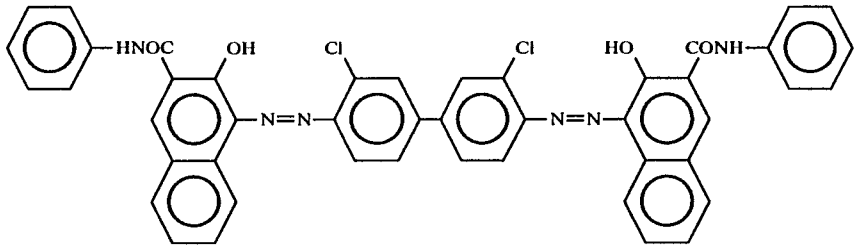 CG-2 | (I)-1-7 |
| No. 1-3 | 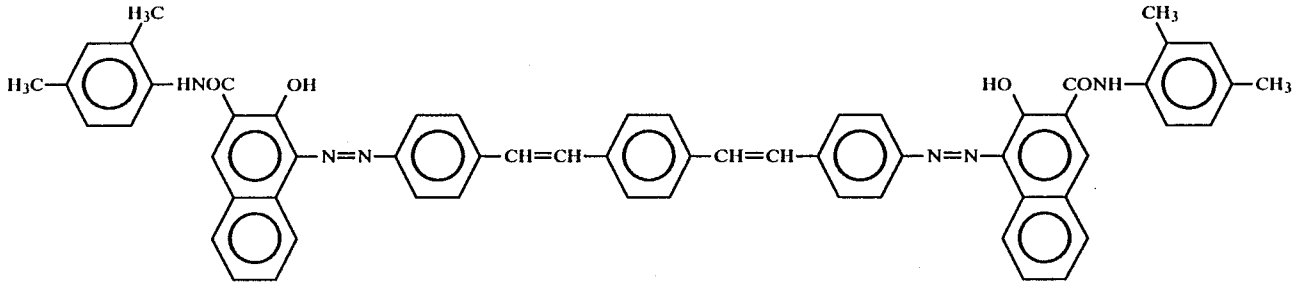 CG-3 | (I)-1-7 |
| No. 1-4 | 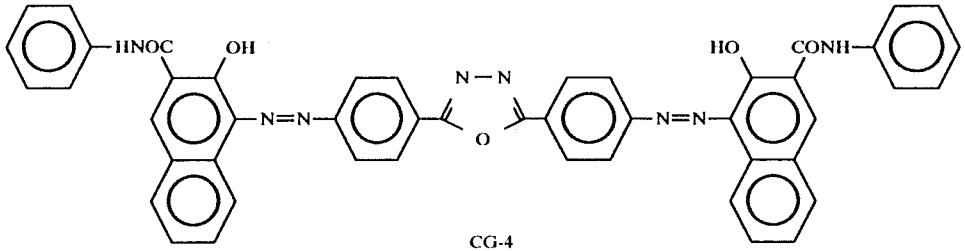 CG-4 | (I)-1-7 |

TABLE 6-continued
| Photo-Conductor | Charge Generating Material | Charge Transporting Material (Amino Compound in Table 1) |
|---|---|---|
| No. 1-5 | 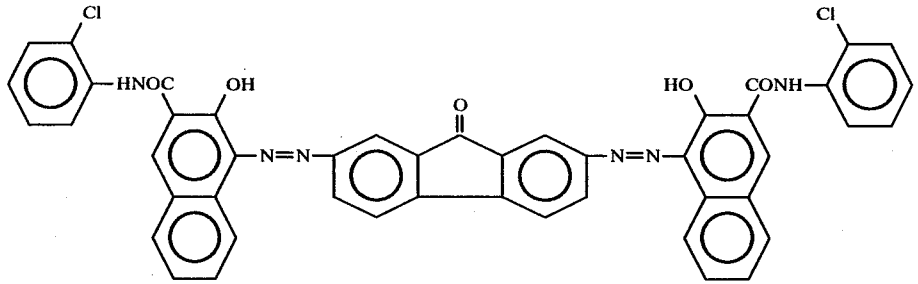 | (I)-1-7 |
| No. 1-6 | 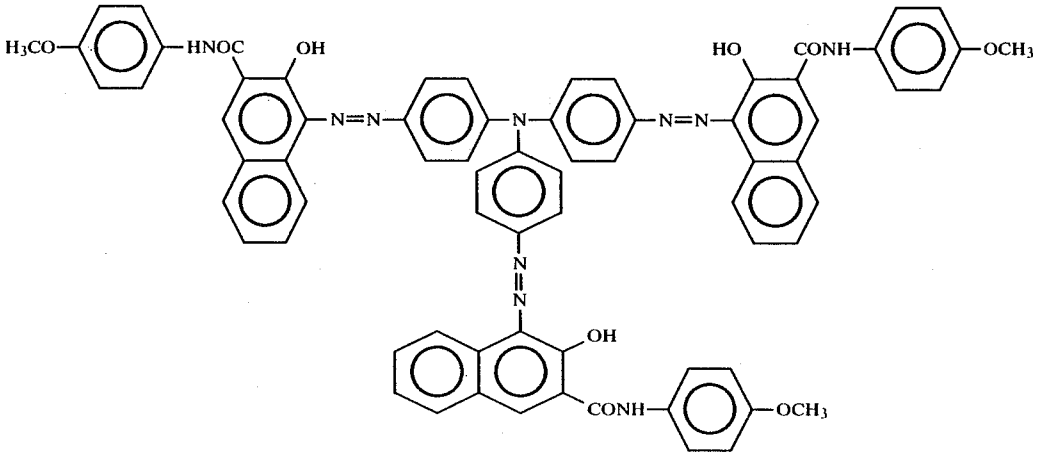 CG-6 | (I)-1-7 |
| No. 1-7 | β-type copper phthalocyanine | (I)-1-7 |

TABLE 6-continued
| Photo-Conductor | Charge Generating Material | Charge Transporting Material (Amino Compound in Table 1) |
|---|---|---|
| No. 1-8 | 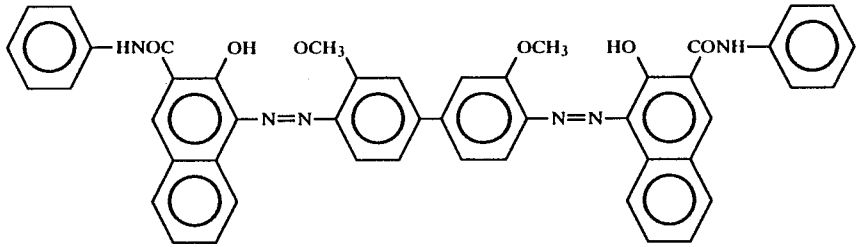 CG-7 | (I)-1-6 |
| No. 1-9 | CG-2 | (I)-1-6 |
| No. 1-10 | CG-3 | (I)-1-6 |
| No. 1-11 | CG-5 | (I)-1-6 |
| No. 1-12 | CG-3 | (I)-1-19 |
| No. 1-13 | CG-5 | (I)-1-19 |
| No. 1-14 | CG-3 | (I)-1-9 |
| No. 1-15 | CG-5 | (I)-1-9 |
| No. 1-16 | CG-3 | (I)-1-10 |
| No. 1-17 | CG-5 | (I)-1-10 |
| No. 1-18 | CG-3 | (I)-1-1 |
| No. 1-19 | CG-5 | (I)-1-1 |
| No. 1-20 | CG-3 | (I)-1-3 |
| No. 1-21 | CG-5 | (I)-1-3 |
| No. 1-22 | CG-3 | (I)-1-30 |
| No. 1-23 | CG-5 | (I)-1-30 |
| No. 1-24 | CG-3 | (I)-1-67 |
| No. 1-25 | CG-5 | (I)-1-67 |
| No. 1-26 | CG-3 | (I)-1-54 |
| No. 1-27 | CG-5 | (I)-1-54 |

EXAMPLE 1-28

Selenium was vacuum-evaporated with a thickness of about 1.0 μm on an about 300 μm thick aluminum plate so that a charge generating layer was formed on the aluminum plate.

A charge transporting layer coating liquid was prepared by mixing and dispersing the following components:

| | Parts by Weight |
|---|---|
| Amino Compound (I)-1-7 in Table 1 | 2 |
| Polyester resin (Polyester Adhesive 49000 made by Du Pont Co.) | 3 |
| Tetrahydrofuran | 45 |

The thus prepared charge transporting layer coating liquid was coated on the aforementioned selenium charge generating layer by a doctor blade, dried at room temperature and then dried under reduced pressure, so that a charge transporting layer about 10 μm thick was formed on the charge generating layer; thus, an electrophotographic photoconductor No. 1-28 according to the present invention was prepared.

$V_{po}$ and $E_{1/2}$ were measured. The results showed that $V_{po}=-720$ $V$ and $E_{1/2}=3.0$ lux·seconds.

EXAMPLE 1-29

A perylene pigment C.I. Vat Red 23 (C.I. 71130) of the following formula was vacuum-evaporated with a thickness of about 0.3 μm on an about 300 μm thick aluminum plate so that a charge generating layer was formed on the aluminum plate:

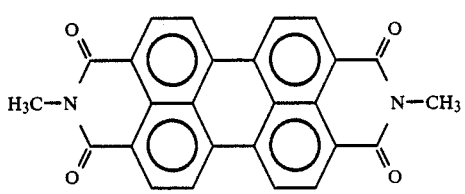

A charge transporting layer coating liquid was prepared by mixing and dispersing the following components:

| | Parts by Weight |
|---|---|
| Amino Compound (I)-1-6 in Table 1 | 2 |
| Polyester resin (Polyester Adhesive 49000 made by Du Pont Co.) | 3 |
| Tetrahydrofuran | 45 |

The thus prepared charge transporting layer coating liquid was coated on the aforementioned charge generating layer by a doctor blade, dried at room temperature and then dried under reduced pressure, so that a charge transporting layer about 10 μm thick was formed on the charge generating layer; thus, an electrophotographic photoconductor No. 1-29 according to the present invention was prepared.

$V_{po}$ and $E_{1/2}$ were measured. The results showed that $V_{po}=-1240$ $V$ and $E_{1/2}=3.2$ lux·seconds.

EXAMPLE 1-30

One part by weight of Diane Blue (C.I. Pigment Blue 25, C.I. 21180) which was the same as that employed in Example 1-1 was added to 158 parts by weight of tetrahydrofuran, and the mixture was ground and dispersed in a ball mill. To this mixture, 12 parts by weight of the amino compound (I)-1-7 in Table 1 and 18 parts by weight of a polyester resin (Polyester Adhesive 49000 made by Du Pont Co.) were added and mixed, whereby a photoconductive layer coating liquid was prepared.

The thus prepared photoconductive layer coating liquid was coated on an aluminum-evaporated polyester film by a doctor blade and dried at 100° C. for 30 minutes, so that a photoconductive layer with a thickness of about 16 μm was formed on the aluminum-evaporated polyester film, thus, an electrophotographic photoconductor No. 1-30 according to the present invention was prepared.

The electrophotographic photoconductor No. 1-30 was charged positively in the dark under application of +6 kV of corona charge for 20 seconds and was then allowed to stand in the dark for 20 seconds without applying any charge thereto. At this moment, the surface potential $V_{po}$ (V) of the photoconductor was measured by a Paper Analyzer (Kawaguchi Electro Works, Model SP-428). The photoconductor was then illuminated by a tungsten lamp in such a manner that the illuminance on the illuminated surface of the photoconductor was 20 lux, so that the exposure $E_{1/2}$ (lux·seconds) required to reduce the initial surface potential $V_{po}$ (V) to ½ the initial surface potential $V_{po}$ (V) was measured. The results showed that $V_{po}$ $(V)=+1350$ $V$ and $E_{1/2}=2.9$ lux·seconds.

The charge generating material, the charge transporting material, $V_{po}$ and $E_{1/2}$ of each of the electrophotographic photoconductors No. 1-1 through No. 1-30 are summarized in the following Table 7:

TABLE 7

| Photoconductor | $V_{po}$ (volt) | $E_{\frac{1}{2}}$ (lux · sec) |
|---|---|---|
| No. 1-1 | −920 | 2.9 |
| No. 1-2 | −1250 | 2.6 |
| No. 1-3 | −830 | 1.2 |
| No. 1-4 | −1110 | 3.9 |
| No. 1-5 | −740 | 0.9 |
| No. 1-6 | −1010 | 1.1 |
| No. 1-7 | −730 | 2.1 |
| No. 1-8 | −1215 | 3.2 |
| No. 1-9 | −1000 | 2.7 |
| No. 1-10 | −1210 | 1.3 |
| No. 1-11 | −1100 | 0.7 |
| No. 1-12 | −840 | 0.9 |
| No. 1-13 | −920 | 0.8 |
| No. 1-14 | −870 | 1.4 |
| No. 1-15 | −955 | 1.5 |
| No. 1-16 | −1200 | 0.8 |
| No. 1-17 | −1100 | 0.6 |
| No. 1-18 | −1310 | 1.7 |
| No. 1-19 | −930 | 1.9 |
| No. 1-20 | −1330 | 4.2 |
| No. 1-21 | −1295 | 5.0 |
| No. 1-22 | −925 | 1.7 |
| No. 1-23 | −1000 | 0.9 |
| No. 1-24 | −1105 | 0.7 |
| No. 1-25 | −855 | 0.7 |
| No. 1-26 | −720 | 1.3 |
| No. 1-27 | −1010 | 1.1 |
| No. 1-28 | −720 | 3.0 |
| No. 1-29 | −1240 | 3.2 |
| No. 1-30 | +1350 | 2.9 |

Each of the electrophotographic photoconductors No. 1-1 through No. 1-29 prepared in Examples 1-1 through 1-29 was negatively charged, while the electrophotographic photoconductor No. 1-30 prepared in Example 1-30 was positively charged by a commercially available copying machine, so that a latent electrostatic image was formed on each photoconductor and developed with a dry type developer. The developed images were transferred to a high quality transfer sheet and were fixed to the transfer sheet. As a result, clear images were obtained from each of the electrophotographic photoconductors. Preparation of Amino Compound (I)-2-6 in Table 2

10.40 g of 1-(4-N,N-diphenylaminostyryl)naphthalene was dissolved in 100 ml of dioxane. To this solution, 1.04 g of a 5% palladium-carbon was added and 1-(4-N,N-diphenylaminophenethyl)naphthalene in the mixture was hydrogenated with hydrogen at a pressure of 1 atm at 25° C. in a shaker hydrogenation apparatus. After the hydrogenation, the reaction mixture was filtered together with sellaite to obtain a filtrate. The filtrate was distilled under reduced pressure to remove dioxane therefrom, so that a colorless oily material was obtained. The oily material was chromatographed over silica gel - toluene, whereby 9.02 g of 1-(4-N,N-diphenylaminophenethyl)naphthalene, which is a colorless viscous liquid, was obtained in a 86.3% yield.

The results of the elemental analysis of the thus obtained amino compound (I)-2-6, 1-(4-N,N-diphenylaminophenethyl)naphthalene, were as follows:

| | % C | % H | % N |
|---|---|---|---|
| Found | 90.23 | 6.28 | 3.43 |
| Calculated | 90.19 | 6.31 | 3.50 |

The above calculation was based on the formula for 1-(4-N,N-diphenylaminostyryl)naphthalene of $C_{30}H_{25}N$.

An infrared spectrum of the 1-(4-N,N-diphenylaminophenethyl)naphthalene, taken by use of a KBr pellet, indicated the disappearance of the absorption based on the out-of-plane vibrations of the trans-olefin at 960 $cm^{-1}$.

EXAMPLE 2-1

The following components were ground and dispersed in a ball mill to prepare a charge generating layer coating liquid:

| | Parts by Weight |
|---|---|
| Diane Blue (C.I. Pigment Blue 25, C.I. 21180) (a charge generating pigment of the following formula (CG-1)) | 76 |

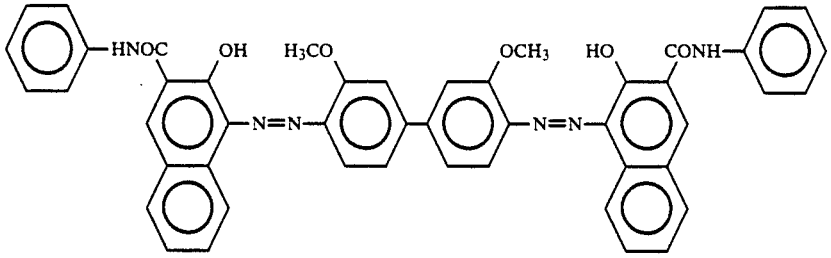

(CG-1)

| | |
|---|---|
| 2% tetrahydrofuran solution of a polyester resin (Vylon 200 made by Toyobo Co., Ltd.) | 1,260 |
| Tetrahydrofuran | 3,700 |

This charge generating layer coating liquid was coated by a doctor blade on the aluminum-evaporated surface of an aluminum-evaporated polyester base film, which served as an electroconductive support, so that a charge generating layer, with a thickness of about 1 μm when dried at room temperature, was formed on the electroconductive support.

Then the following components were mixed and dissolved, so that a charge transporting layer coating liquid was prepared:

| | Parts by Weight |
|---|---|
| Amino Compound (I)-2-9 in Table 2 | 2 |
| Polycarbonate resin (Panlite K 1300 made by Teijin Limited.) | 2 |
| Tetrahydrofuran | 16 |

The thus prepared charge transporting layer coating liquid was coated on the aforementioned charge generating layer by a doctor blade and dried at 80° C. for 2 minutes and then at 105° C. for 5 minutes, so that a charge transporting layer with a thickness of about 20 μm was formed on the charge generating layer; thus, an electrophotographic photoconductor No. 2-1 according to the present invention was prepared.

The electrophotographic photoconductor No. 2-1 was charged negatively in the dark under application of −6 kV of corona charge for 20 seconds and then allowed to stand in the dark for 20 seconds without applying any charge thereto. At this moment, the surface potential $V_{po}$ (V) of the photoconductor was measured by a Paper Analyzer (Kawaguchi Electro Works, Model SP-428). The photoconductor was then illuminated by a tungsten lamp in such a manner that the illuminance on the illuminated surface of the photoconductor was 20 lux, and the exposure $E_{1/2}$ (lux·seconds) required to reduce the initial surface potential $V_{po}$(V) to ½ the initial surface potential $V_{po}$(V) was measured. The results showed that $V_{po}$ (V) = −940 V and $E_{1/2}$ = 3.0 lux·seconds.

EXAMPLES 2-2 THROUGH 2-27

Example 2-1 was repeated except that the charge generating material and the amino compound which worked as the charge transporting material employed in Example 2-1 were replaced by the charge generating materials and the amino compounds, respectively, as listed in Table 8, whereby electrophotographic photoconductors No. 2-2 through No. 2-27 according to the present invention were prepared.

$V_{po}$ and $E_{1/2}$ of those electrophotographic photoconductors were measured in the same manner as in Example 2-1. The results are shown in Table 9.

TABLE 8
| Photo-Conductor | Charge Generating Material | Charge Transporting Material (Amino Compound in Table 2) |
|---|---|---|
| No. 2-2 | 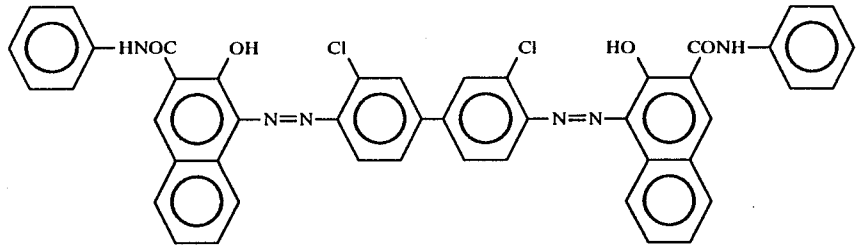 CG-2 | (I)-2-9 |
| No. 2-3 | 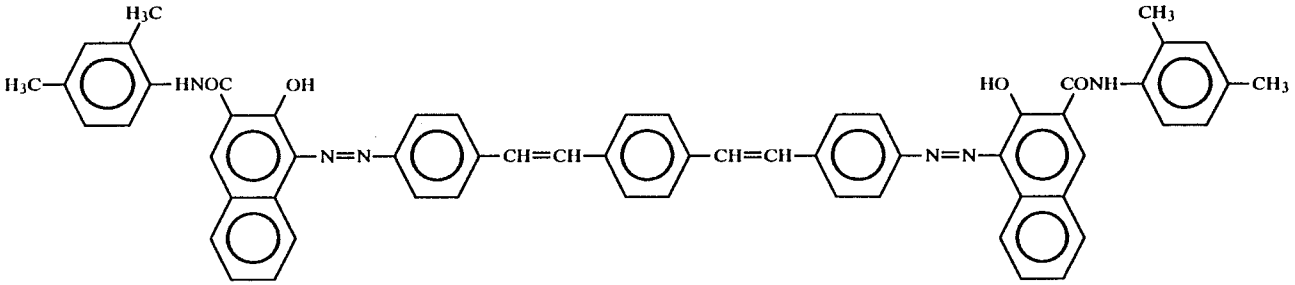 CG-3 | (I)-2-9 |
| No. 2-4 | 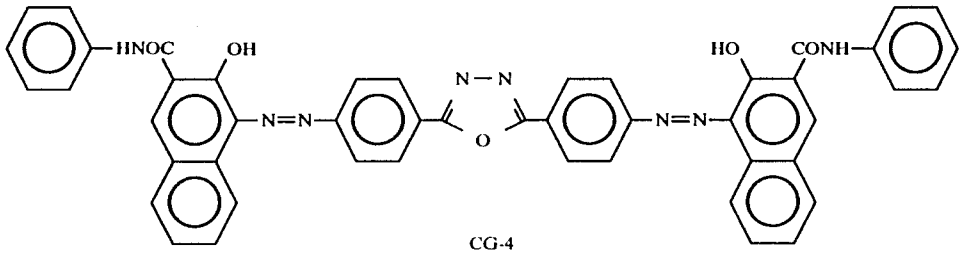 CG-4 | (I)-2-9 |

TABLE 8-continued
| Photo-Conductor | Charge Generating Material | Charge Transporting Material (Amino Compound in Table 2) |
|---|---|---|
| No. 2-5 | 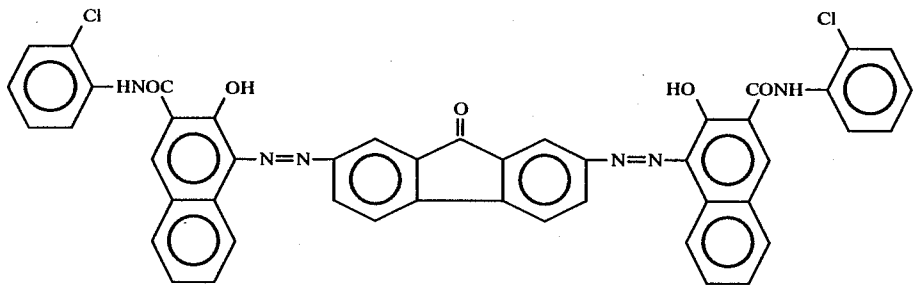 | (I)-2-9 |
| No. 2-6 | 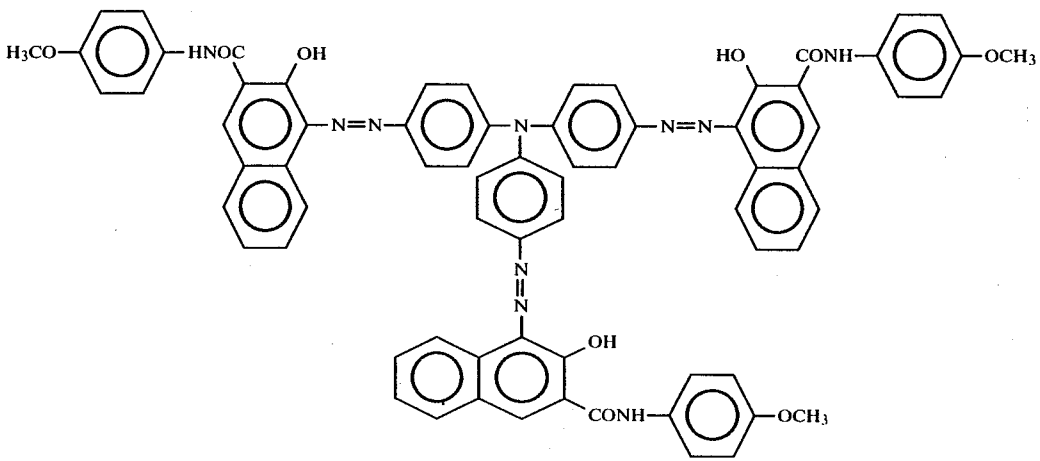 CG-6 | (I)-2-9 |
| No. 2-7 | β-type copper phthalocyanine | (I)-2-9 |

TABLE 8-continued
| Photo-Conductor | Charge Generating Material | Charge Transporting Material (Amino Compound in Table 2) |
|---|---|---|
| No. 2-8 | 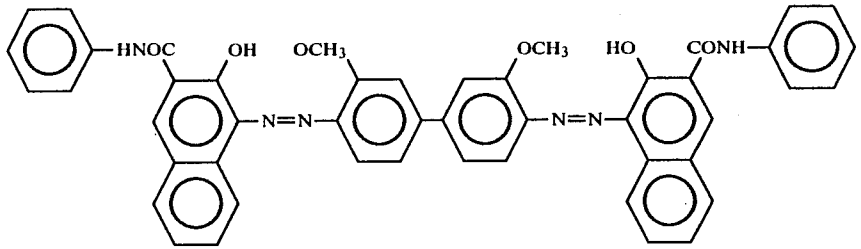 CG-7 | (I)-2-12 |
| No. 2-9 | CG-2 | (I)-2-12 |
| No. 2-10 | CG-3 | (I)-2-12 |
| No. 2-11 | CG-5 | (I)-2-12 |
| No. 2-12 | CG-3 | (I)-2-102 |
| No. 2-13 | CG-5 | (I)-2-102 |
| No. 2-14 | CG-3 | (I)-2-33 |
| No. 2-15 | CG-5 | (I)-2-33 |
| No. 2-16 | CG-3 | (I)-2-6 |
| No. 2-17 | CG-5 | (I)-2-6 |
| No. 2-18 | CG-3 | (I)-2-51 |
| No. 2-19 | CG-5 | (I)-2-51 |
| No. 2-20 | CG-3 | (I)-2-49 |
| No. 2-21 | CG-5 | (I)-2-49 |
| No. 2-22 | CG-3 | (I)-2-93 |
| No. 2-23 | CG-5 | (I)-2-93 |
| No. 2-24 | CG-3 | (I)-2-89 |
| No. 2-25 | CG-5 | (I)-2-89 |
| No. 2-26 | CG-3 | (I)-2-98 |
| No. 2-27 | CG-5 | (I)-2-98 |

EXAMPLE 2-28

Selenium was vacuum-evaporated with a thickness of about 1.0 μm on an about 300 μm thick aluminum plate so that a charge generating layer was formed on the aluminum plate.

A charge transporting layer coating liquid was prepared by mixing and dispersing the following components:

| | Parts by Weight |
|---|---|
| Amino Compound (I)-2-9 in Table 2 | 2 |
| Polyester resin (Polyester Adhesive 49000 made by Du Pont Co.) | 3 |
| Tetrahydrofuran | 45 |

The thus prepared charge transporting layer coating liquid was coated on the aforementioned selenium charge generating layer by a doctor blade, dried at room temperature and then dried under reduced pressure, so that a charge transporting layer about 10 μm thick was formed on the charge generating layer; thus, an electrophotographic photoconductor No. 2-28 according to the present invention was prepared.

$V_{po}$ and $E_{1/2}$ were measured. The results showed that $V_{po}=-885$ $V$ and $E_{1/2}=3.0$ lux·seconds.

EXAMPLE 2-29

A perylene pigment C.I. Vat Red 23 (C.I. 71130) of the following formula was vacuum-evaporated with a thickness of about 0.3 μm on an about 300 μm thick aluminum plate so that a charge generating layer was formed on the aluminum plate:

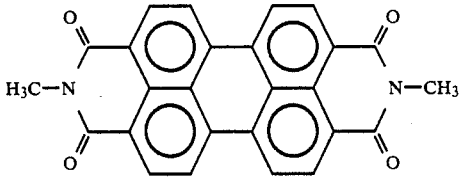

A charge transporting layer coating liquid was prepared by mixing and dispersing the following components:

| | Parts by Weight |
|---|---|
| Amino Compound (I)-2-12 in Table 2 | 2 |
| Polyester resin (Polyester Adhesive 49000 made by Du Pont Co.) | 3 |
| Tetrahydrofuran | 45 |

The thus prepared charge transporting layer coating liquid was coated on the aforementioned charge generating layer by a doctor blade, dried at room temperature and then dried under reduced pressure, so that a charge transporting layer about 10 μm thick was formed on the charge generating layer; thus, an electrophotographic photoconductor No. 2-29 according to the present invention was prepared.

$V_{po}$ and $E_{1/2}$ were measured. The results showed that $V_{po}=-1190$ $V$ and $E_{1/2}=3.1$ lux·seconds.

EXAMPLE 2-30

One part by weight of Diane Blue (C.I. Pigment Blue 25, C.I. 21180) which was the same as that employed in Example 2-1 was added to 158 parts by weight of tetrahydrofuran, and the mixture was ground and dispersed in a ball mill. To this mixture, 12 parts by weight of the amino compound (I)-2-9 in Table 2 and 18 parts by weight of a polyester resin (Polyester Adhesive 49000 made by Du Pont Co.) were added and mixed, whereby a photoconductive layer coating liquid was prepared.

The thus prepared photoconductive layer coating liquid was coated on an aluminum-evaporated polyester film by a doctor blade and dried at 100° C. for 30 minutes, so that a photoconductive layer with a thickness of about 16 μm was formed on the aluminum-evaporated polyester film, thus, an electrophotographic photoconductor No. 2-30 according to the present invention was prepared.

The electrophotographic photoconductor No. 2-30 was charged positively in the dark under application of +6 kV of corona charge for 20 seconds and was then allowed to stand in the dark for 20 seconds without applying any charge thereto. At this moment, the surface potential $V_{po}$ (V) of the photoconductor was measured by a Paper Analyzer (Kawaguchi Electro Works, Model SP-428). The photoconductor was then illuminated by a tungsten lamp in such a manner that the illuminance on the illuminated surface of the photoconductor was 20 lux, so that the exposure $E_{1/2}$ (lux·seconds) required to reduce the initial surface potential $V_{po}$ (V) to ½ the initial surface potential $V_{po}$ (V) was measured. The results showed that $V_{po}$ (V)=+1265 $V$ and $E_{1/2}=2.8$ lux·seconds.

The charge generating material, the charge transporting material, $V_{po}$ and $E_{1/2}$ of each of the electrophotographic photoconductors No. 1-1 through No. 1-30 are summarized in the following Table 9:

TABLE 9

| Photoconductor | $V_{po}$ (volt) | $E_{\frac{1}{2}}$ (lux · sec) |
|---|---|---|
| No. 2-1 | −940 | 3.0 |
| No. 2-2 | −1110 | 2.8 |
| No. 2-3 | −925 | 1.3 |
| No. 2-4 | −980 | 2.5 |
| No. 2-5 | −880 | 1.0 |
| No. 2-6 | −920 | 0.8 |
| No. 2-7 | −1025 | 1.1 |
| No. 2-8 | −1210 | 3.0 |
| No. 2-9 | −1170 | 2.5 |
| No. 2-10 | −1090 | 1.2 |
| No. 2-11 | −995 | 1.1 |
| No. 2-12 | −1010 | 0.9 |
| No. 2-13 | −950 | 1.2 |
| No. 2-14 | −925 | 1.8 |
| No. 2-15 | − 880 | 1.9 |
| No. 2-16 | −930 | 2.0 |
| No. 2-17 | −910 | 1.7 |
| No. 2-18 | −1045 | 1.5 |
| No. 2-19 | −1210 | 1.7 |
| No. 2-20 | −985 | 1.5 |
| No. 2-21 | −1050 | 1.8 |
| No. 2-22 | −1210 | 1.1 |
| No. 2-23 | −1190 | 0.9 |
| No. 2-24 | −1205 | 0.9 |
| No. 2-25 | −1170 | 1.1 |
| No. 2-26 | −990 | 1.6 |
| No. 2-27 | −1110 | 2.0 |
| No. 2-28 | −885 | 3.0 |
| No. 2-29 | −1190 | 3.1 |
| No. 2-30 | +1265 | 2.8 |

Each of the electrophotographic photoconductors No. 2-1 through No. 2-29 prepared in Examples 2-1 through 2-29 was negatively charged, while the electrophotographic photoconductor No. 2-30 prepared in Example 2-30 was positively charged by a commercially available copying machine, so that a latent electrostatic image was formed on each photoconductor and was developed with a dry type developer. The developed images were transferred to a high quality transfer sheet and were fixed to the transfer sheet. As a result, clear images were obtained from each of the electrophotographic photoconductors.

Preparation of Amino Compound (I)-3-2 in Table 3

11.00 g of 2-N,N-diphenylamino-5-styrylthiophene was dissolved in 100 ml of dioxane. To this solution, 1.10 g of a 5% palladium-carbon was added and the 2-N,N-diphenylamino-5-styrylthiophene in the mixture was hydrogenated with hydrogen at a pressure of 1 atm at 25° C. in a shaker hydrogenation apparatus. After the hydrogenation, the reaction mixture was filtered together with sellaite to obtain a filtrate. The filtrate was distilled under reduced pressure to remove dioxane therefrom, so that a colorless oily material was obtained. The oily material was chromatographed over silica gel - toluene, whereby 9.40 g of 2-N,N-diphenylamino-5-phenethylthiophene, which is a colorless viscous liquid, was obtained in a 85.4% yield.

The results of the elemental analysis of the thus obtained amino compound (I)-3-2, 2-N,N-diphenylamino-5phenethylthiophene, were as follows:

| | % C | % H | % N | % S |
|---|---|---|---|---|
| Found | 81.13 | 5.92 | 3.96 | 8.98 |
| Calculated | 81.08 | 5.96 | 3.94 | 9.02 |

The above calculation was based on the formula for 2-N,N-diphenylamino-5-phenethylthiophene of $C_{24}H_{21}NS$.

An infrared spectrum of the 2-N,N-diphenylamino-5-phenethylthiophene, taken by use of a KBr pellet, indicated the disappearance of the absorption based on the out-of-plane vibrations of the trans-olefin at 945 $cm^{-1}$.

EXAMPLE 3-1

The following components were ground and dispersed in a ball mill to prepare a charge generating layer coating liquid:

| | Parts by Weight |
|---|---|
| Diane Blue (C.I. Pigment Blue 25, C.I. 21180) (a charge generating pigment of the following formula (CG-1)) | 76 |

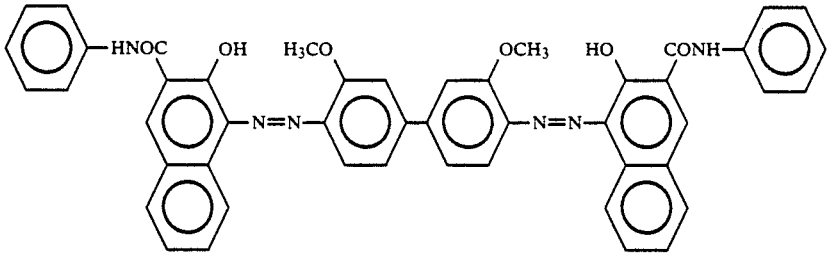

(CG-1)

| | |
|---|---|
| 2% tetrahydrofuran solution of a polyester resin (Vylon 200 made by Toyobo Co., Ltd.) | 1,260 |
| Tetrahydrofuran | 3,700 |

This charge generating layer coating liquid was coated by a doctor blade on the aluminum-evaporated surface of an aluminum-evaporated polyester base film, which served as an electroconductive support, so that a charge generating layer, with a thickness of about 1 μm when dried at room temperature, was formed on the electroconductive support.

Then the following components were mixed and dissolved, so that a charge transporting layer coating liquid was prepared:

| | Parts by Weight |
|---|---|
| Amino Compound (I)-3-4 in Table 3 | 2 |
| Polycarbonate resin (Panlite K 1300 made by Teijin Limited.) | 2 |
| Tetrahydrofuran | 16 |

The thus prepared charge transporting layer coating liquid was coated on the aforementioned charge generating layer by a doctor blade and dried at 80° C. for 2 minutes and then at 105° C. for 5 minutes, so that a charge transporting layer with a thickness of about 20 μm was formed on the charge generating layer; thus, an electrophotographic photoconductor No. 3-1 according to the present invention was prepared.

The electrophotographic photoconductor No. 3-1 was charged negatively in the dark under application of −6 kV of corona charge for 20 seconds and then allowed to stand in the dark for 20 seconds without applying any charge thereto. At this moment, the surface potential $V_{po}$ (V) of the photoconductor was measured by a Paper Analyzer (Kawaguchi Electro Works, Model SP-428). The photoconductor was then illuminated by a tungsten lamp in such a manner that the illuminance on the illuminated surface of the photoconductor was 20 lux, and the exposure $E_{1/2}$ (lux·seconds) required to reduce the initial surface potential $V_{po}$(V) to ½ the initial surface potential $V_{po}$(V) was measured. The results showed that $V_{po}$ (V) = −925 V and $E_{1/2}$ = 2.4 lux·seconds.

EXAMPLES 3-2 THROUGH 3-27

Example 3-1 was repeated except that the charge generating material and the amino compound which worked as the charge transporting material employed in Example 3-1 were replaced by the charge generating materials and the amino compounds, respectively, as listed in Table 10, whereby electrophotographic photoconductors No. 3-2 through No. 3-27 according to the present invention were prepared.

$V_{po}$ and $E_{1/2}$ of those electrophotographic photoconductors were measured in the same manner as in Example 3-1. The results are shown in Table 11.

TABLE 10
| Photo-Conductor | Charge Generating Material | Charge Transporting Material (Amino Compound in Table 3) |
|---|---|---|
| No. 3-2 | 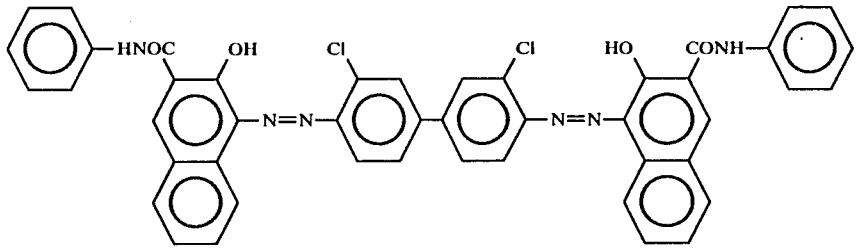 CG-2 | (I)-3-4 |
| No. 3-3 | 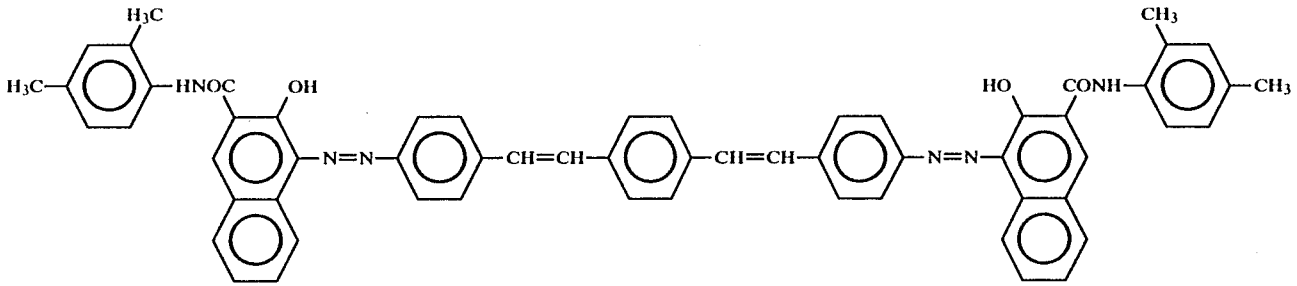 CG-3 | (I)-3-4 |
| No. 3-4 | 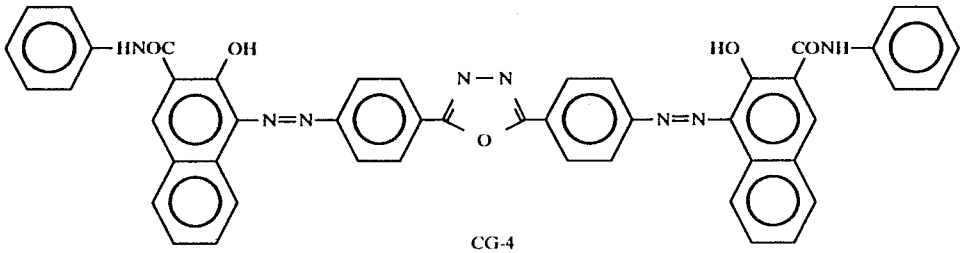 CG-4 | (I)-3-4 |

TABLE 10-continued
| Photo-Conductor | Charge Generating Material | Charge Transporting Material (Amino Compound in Table 3) |
|---|---|---|
| No. 3-5 | 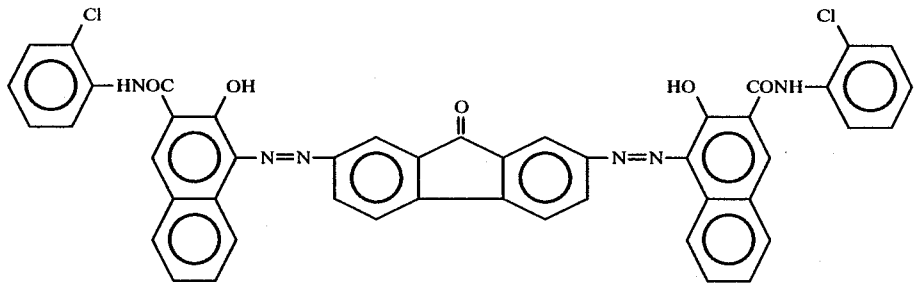 | (I)-3-4 |
| No. 3-6 | 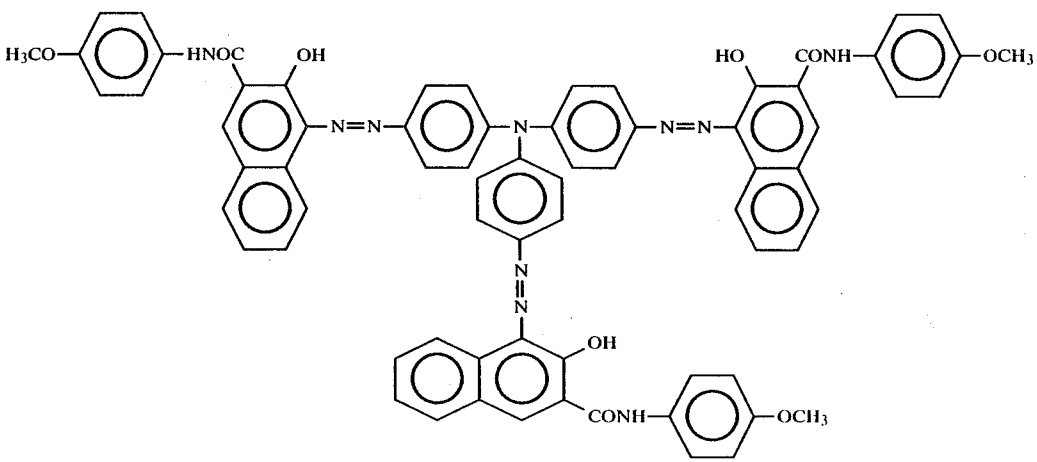 CG-6 | (I)-3-4 |
| No. 3-7 | β-type copper phthalocyanine | (I)-3-4 |

TABLE 10-continued
| Photo-Conductor | Charge Generating Material | Charge Transporting Material (Amino Compound in Table 3) |
|---|---|---|
| No. 3-8 | 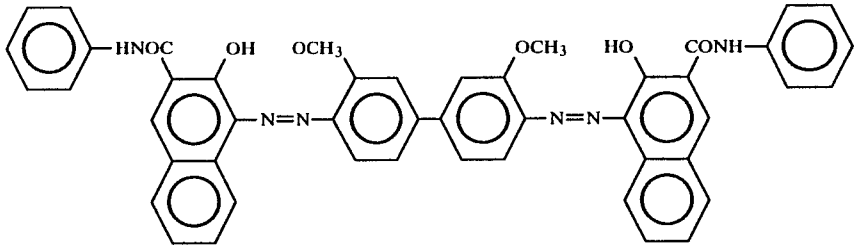 CG-7 | (I)-3-7 |
| No. 3-9 | CG-2 | (I)-3-7 |
| No. 3-10 | CG-3 | (I)-3-7 |
| No. 3-11 | CG-5 | (I)-3-7 |
| No. 3-12 | CG-3 | (I)-3-12 |
| No. 3-13 | CG-5 | (I)-3-12 |
| No. 3-14 | CG-3 | (I)-3-2 |
| No. 3-15 | CG-5 | (I)-3-2 |
| No. 3-16 | CG-3 | (I)-3-22 |
| No. 3-17 | CG-5 | (I)-3-22 |
| No. 3-18 | CG-3 | (I)-3-24 |
| No. 3-19 | CG-5 | (I)-3-24 |
| No. 3-20 | CG-3 | (I)-3-29 |
| No. 3-21 | CG-5 | (I)-3-29 |
| No. 3-22 | CG-3 | (I)-3-30 |
| No. 3-23 | CG-5 | (I)-3-30 |
| No. 3-24 | CG-3 | (I)-3-37 |
| No. 3-25 | CG-5 | (I)-3-37 |
| No. 3-26 | CG-3 | (I)-3-41 |
| No. 3-27 | CG-5 | (I)-3-41 |

EXAMPLE 3-28

Selenium was vacuum-evaporated with a thickness of about 1.0 μm on an about 300 μm thick aluminum plate so that a charge generating layer was formed on the aluminum plate.

A charge transporting layer coating liquid was prepared by mixing and dispersing the following components:

| | Parts by Weight |
|---|---|
| Amino Compound (I)-3-4 in Table 3 | 2 |
| Polyester resin (Polyester Adhesive 49000 made by Du Pont Co.) | 3 |
| Tetrahydrofuran | 45 |

The thus prepared charge transporting layer coating liquid was coated on the aforementioned selenium charge generating layer by a doctor blade, dried at room temperature and then dried under reduced pressure, so that a charge transporting layer about 10 μm thick was formed on the charge generating layer; thus, an electrophotographic photoconductor No. 3-28 according to the present invention was prepared.

$V_{po}$ and $E_{1/2}$ were measured. The results showed that $V_{po}=-1120$ V and $E_{1/2}=2.5$ lux·seconds.

EXAMPLE 3-29

A perylene pigment C.I. Vat Red 23 (C.I. 71130) of the following formula was vacuum-evaporated with a thickness of about 0.3 μm on an about 300 μm thick aluminum plate so that a charge generating layer was formed on the aluminum plate:

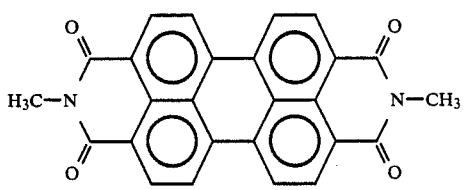

A charge transporting layer coating liquid was prepared by mixing and dispersing the following components:

| | Parts by Weight |
|---|---|
| Amino Compound (I)-3-7 in Table 3 | 2 |
| Polyester resin (Polyester Adhesive 49000 made by Du Pont Co.) | 3 |
| Tetrahydrofuran | 45 |

The thus prepared charge transporting layer coating liquid was coated on the aforementioned charge generating layer by a doctor blade, dried at room temperature and then dried under reduced pressure, so that a charge transporting layer about 10 μm thick was formed on the charge generating layer; thus, an electrophotographic photoconductor No. 3-29 according to the present invention was prepared $V_{po}$ and $E_{1/2}$ were measured. The results showed that $V_{po}=-920$ $V$ and $E_{1/2}=3.0$ lux·seconds.

EXAMPLE 3-30

One part by weight of Diane Blue (C.I. Pigment Blue 25, C.I. 21180) which was the same as that employed in Example 3-1 was added to 158 parts by weight of tetrahydrofuran, and the mixture was ground and dispersed in a ball mill. To this mixture, 12 parts by weight of the amino compound (I)-3-4 in Table 3 and 18 parts by weight of a polyester resin (Polyester Adhesive 49000 made by Du Pont Co.) were added and mixed, whereby a photoconductive layer coating liquid was prepared.

The thus prepared photoconductive layer coating liquid was coated on an aluminum-evaporated polyester film by a doctor blade and dried at 100° C. for 30 minutes, so that a photoconductive layer with a thickness of about 16 μm was formed on the aluminum-evaporated polyester film, thus, an electrophotographic photoconductor No. 3-30 according to the present invention was prepared.

The electrophotographic photoconductor No. 3-30 was charged positively in the dark under application of +6 kV of corona charge for 20 seconds and was then allowed to stand in the dark for 20 seconds without applying any charge thereto. At this moment, the surface potential $V_{po}$ (V) of the photoconductor was measured by a Paper Analyzer (Kawaguchi Electro Works, Model SP-428). The photoconductor was then illuminated by a tungsten lamp in such a manner that the illuminance on the illuminated surface of the photoconductor was 20 lux, so that the exposure $E_{1/2}$ (lux·seconds) required to reduce the initial surface potential $V_{po}$ (V) to ½ the initial surface potential $V_{po}$ (V) was measured. The results showed that $V_{po}$ $(V)=+860$ $V$ and $E_{1/2}=2.4$ lux·seconds.

The charge generating material, the charge transporting material, $V_{po}$ and $E_{1/2}$ of each of the electrophotographic photoconductors No. 3-1 through No. 3-30 are summarized in the following Table 11:

TABLE 11

| Photoconductor | $V_{po}$ (volt) | $E_{\frac{1}{2}}$ (lux · sec) |
|---|---|---|
| No. 3-1 | −925 | 2.4 |
| No. 3-2 | −760 | 2.8 |
| No. 3-3 | −810 | 1.2 |
| No. 3-4 | −625 | 2.1 |
| No. 3-5 | −1100 | 0.9 |
| No. 3-6 | −1290 | 1.1 |
| No. 3-7 | −1015 | 1.4 |
| No. 3-8 | −1150 | 2.0 |
| No. 3-9 | −1120 | 2.9 |
| No. 3-10 | −980 | 0.7 |
| No. 3-11 | −1220 | 1.2 |
| No. 3-12 | −1005 | 1.7 |
| No. 3-13 | −925 | 1.8 |
| No. 3-14 | −685 | 0.9 |
| No. 3-15 | −960 | 1.2 |
| No. 3-16 | −620 | 2.1 |
| No. 3-17 | −1010 | 2.0 |
| No. 3-18 | −790 | 1.5 |
| No. 3-19 | −980 | 1.6 |
| No. 3-20 | −1005 | 2.0 |
| No. 3-21 | −965 | 2.2 |
| No. 3-22 | −1250 | 1.5 |
| No. 3-23 | −1040 | 1.4 |
| No. 3-24 | −1005 | 0.9 |
| No. 3-25 | −890 | 1.1 |
| No. 3-26 | −560 | 1.3 |
| No. 3-27 | −990 | 1.2 |
| No. 3-28 | −1120 | 2.5 |
| No. 3-29 | −920 | 3.0 |
| No. 3-30 | +860 | 2.4 |

Each of the electrophotographic photoconductors No. 3-1 through No. 3-29 prepared in Examples 3-1 through 3-29 was negatively charged, while the electrophotographic photoconductor No. 3-30 prepared in Example 3-30 was positively charged by a commercially available copying machine, so that a latent electrostatic image was formed on each photoconductor and was developed with a dry type developer. The developed images were transferred to a high quality transfer sheet and were fixed to the transfer sheet. As a result, clear images were obtained from each of the electrophotographic photoconductors. Preparation of Amino Compound (I)-4-27 in Table 4

13.5 g of α-phenyl-4'-N,N-di(4-trylamino)stilbene was dissolved in 100 ml of dioxane. To this solution, 1.35 g of a 5% palladium-carbon was added and the α-phenyl-4'-N,N-di(4-trylamino)stilbene in the mixture was hydrogenated with hydrogen at a pressure of 1 atm at 25° C. in a shaker hydrogenation apparatus. After the hydrogenation, the reaction mixture was filtered together with sellaite to obtain a filtrate. The filtrate was distilled under reduced pressure to remove dioxane therefrom, so that a colorless oily material was obtained. The oily material was chromatographed over silica gel - toluene, whereby 12.3 g of 4,4'-ditryl-4''-(β-phenylphenethyl)tryphenylamine, which is a colorless viscous liquid, was obtained in a 91% yield.

The results of the elemental analysis of the thus obtained amino compound (I)-4-27, di(4-trylamine)stilbene, were as follows:

| | % C | % H | % N |
|---|---|---|---|
| Found | 89.92 | 6.91 | 3.11 |
| Calculated | 90.01 | 6.90 | 3.09 |

The above calculation was based on the formula for 4,4'-ditryl-4''-(β-phenylamino)stilbene of $C_{34}H_{31}N$.

An infrared spectrum of the 4,4'-ditryl-4''-(β-phenylphenethyl)triphenylamine, taken by use of a KBr pellet, indicated the disappearance of the absorption based on the out-of-plane vibrations of the trans-olefin at 960 $cm^{-1}$.

EXAMPLE 4-1

The following components were ground and dispersed in a ball mill to prepare a charge generating layer coating liquid:

| | Parts by Weight |
|---|---|
| Diane Blue (C.I. Pigment Blue 25, C.I. 21180) (a charge generating pigment of the following formula (CG-1)) | 76 |

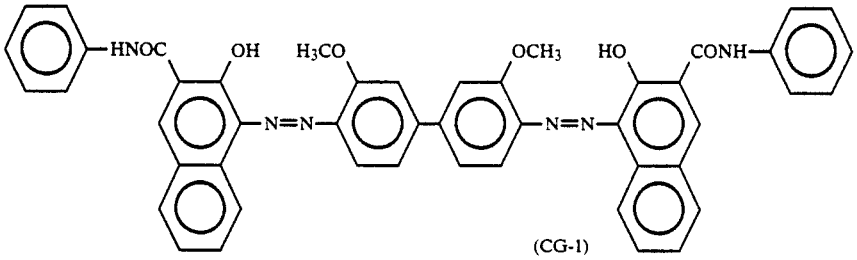

(CG-1)

| | |
|---|---|
| 2% tetrahydrafuran solution of a polyester resin (Vylon 200 made by Toyobo Co., Ltd.) | 1,260 |
| Tetrahydrafuran | 3,700 |

This charge generating layer coating liquid was coated by a doctor blade on the aluminum-evaporated surface of an aluminum-evaporated polyester base film, which served as an electroconductive support, so that a charge generating layer, with a thickness of about 1 μm when dried at room temperature, was formed on the electroconductive support.

Then the following components were mixed and dissolved, so that a charge transporting layer coating liquid was prepared:

| | Parts by Weight |
|---|---|
| Amino Compound (I)-4-27 in Table 4 | 2 |
| Polycarbonate resin (Panlite K 1300 made by Teijin Limited.) | 2 |
| Tetrahydrofuran | 16 |

The thus prepared charge transporting layer coating liquid was coated on the aforementioned charge generating layer by a doctor blade and dried at 80° C. for 2 minutes and then at 105° C. for 5 minutes, so that a charge transporting layer with a thickness of about 20 μm was formed on the charge generating layer; thus, an electrophotographic photoconductor No. 4-1 according to the present invention was prepared.

The electrophotographic photoconductor No. 1-1 was charged negatively in the dark under application of −6 kV of corona charge for 20 seconds and then allowed to stand in the dark for 20 seconds without applying any charge thereto. At this moment, the surface potential $V_{po}$ (V) of the photoconductor was measured by a Paper Analyzer (Kawaguchi Electro Works, Model SP-428). The photoconductor was then illuminated by a tungsten lamp in such a manner that the illuminance on the illuminated surface of the photoconductor was 20 lux, and the exposure $E_{1/2}$ (lux·seconds) required to reduce the initial surface potential $V_{po}$ (V) to ½ the initial surface potential $V_{po}$ (V) was measured. The results showed that $V_{po}$ (V) = −930 V and $E_{1/2}$ = 3.8 lux·seconds.

EXAMPLES 4-2 THROUGH 4-27

Example 4-1 was repeated except that the charge generating material and the amino compound which worked as the charge transporting material employed in Example 4-1 were respectively replaced by the charge generating materials and the amino compounds as listed in Table 12, whereby electrophotographic photoconductors No. 4-2 through No. 4-27 according to the present invention were prepared.

$V_{po}$ and $E_{1/2}$ of those electrophotographic photoconductors were measured in the same manner as in Example 4-1. The results are shown in Table 13.

TABLE 12
| Photo-Conductor | Charge Generating Material | Charge Transporting Material (Amino Compound in Tables 4 & 5) |
|---|---|---|
| No. 4-2 | 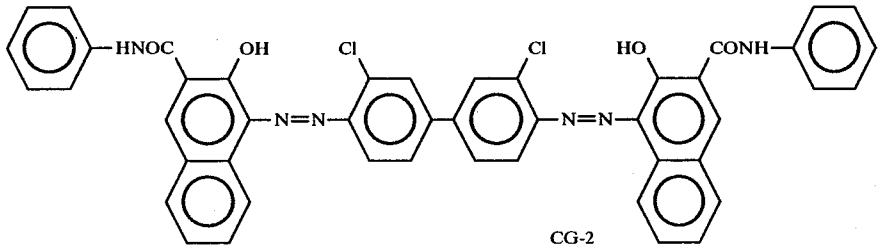 CG-2 | (I)-4-27 |
| No. 4-3 | 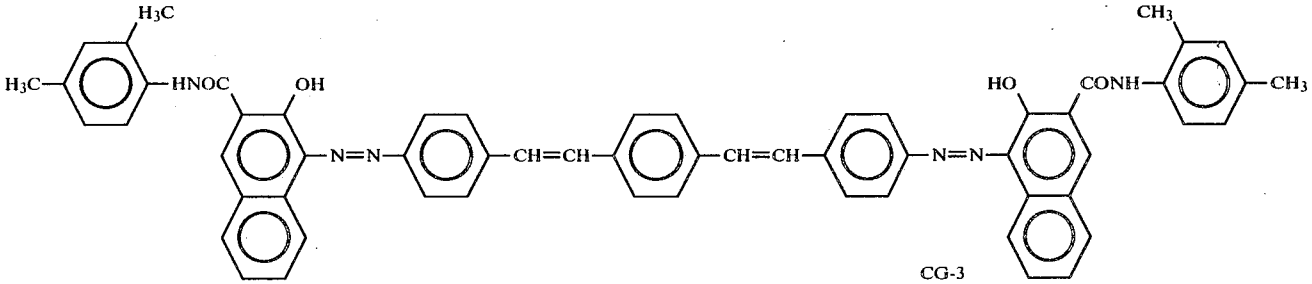 CG-3 | (I)-4-27 |
| No. 4-4 | 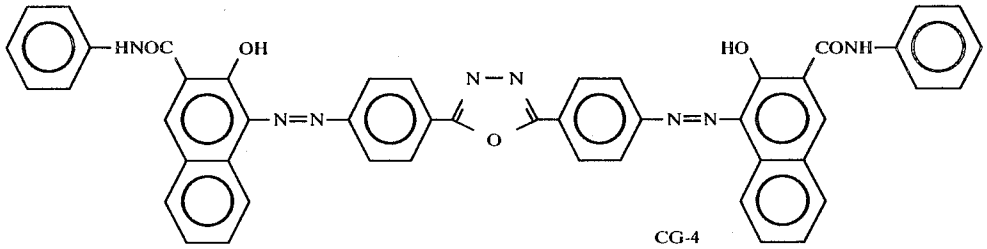 CG-4 | (I)-4-27 |

TABLE 12-continued
| Photo-Conductor | Charge Generating Material | Charge Transporting Material (Amino Compound in Tables 4 & 5) |
|---|---|---|
| No. 4-5 | 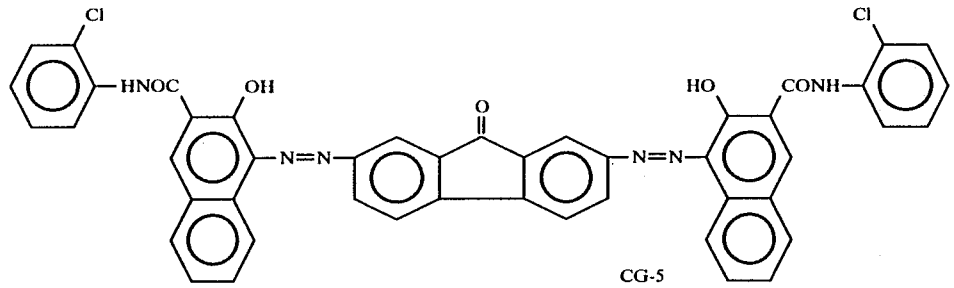 CG-5 | (I)-4-27 |
| No. 4-6 | 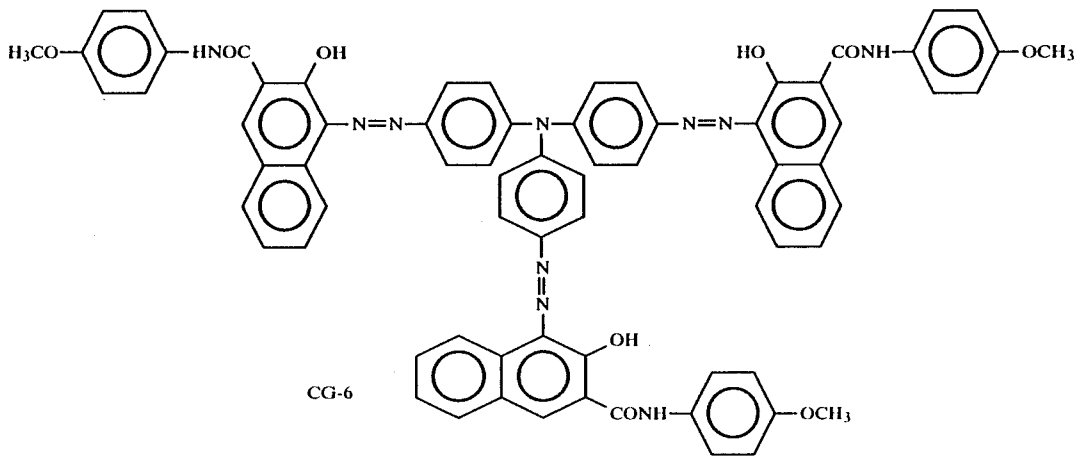 CG-6 | (I)-4-27 |
| No. 4-7 | β-type copper phthalocyanine | (I)-4-27 |

TABLE 12-continued
| Photo-Conductor | Charge Generating Material | Charge Transporting Material (Amino Compound in Tables 4 & 5) |
|---|---|---|
| No. 4-8 | 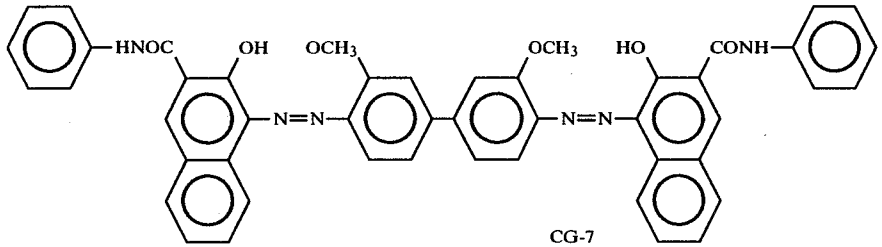 CG-7 | (I)-4-26 |
| No. 4-9 | CG-2 | (I)-4-26 |
| No. 4-10 | CG-3 | (I)-4-26 |
| No. 4-11 | CG-5 | (I)-4-26 |
| No. 4-12 | CG-3 | (I)-4-32 |
| No. 4-13 | CG-5 | (I)-4-32 |
| No. 4-14 | CG-3 | (I)-4-28 |
| No. 4-15 | CG-5 | (I)-4-28 |
| No. 4-16 | CG-3 | (I)-4-6 |
| No. 4-17 | CG-5 | (I)-4-6 |
| No. 4-18 | CG-3 | (I)-4-5 |
| No. 4-19 | CG-5 | (I)-4-5 |
| No. 4-20 | CG-3 | (I)-4-3 |
| No. 4-21 | CG-5 | (I)-4-3 |
| No. 4-22 | CG-3 | (I)-4-43 |
| No. 4-23 | CG-5 | (I)-5-2 |
| No. 4-24 | CG-3 | (I)-4-19 |
| No. 4-25 | CG-5 | (I)-4-19 |
| No. 4-26 | CG-3 | (I)-4-47 |
| No. 4-27 | CG-5 | (I)-4-47 |

EXAMPLE 4-28

Selenium was vacuum-evaporated with a thickness of about 1.0 μm on an about 300 μm thick aluminum plate so that a charge generating layer was formed on the aluminum plate.

A charge transporting layer coating liquid was prepared by mixing and dispersing the following components:

| | Parts by Weight |
|---|---|
| Amino Compound (I)-4-27 in Table 4 | 2 |
| Polyester resin (Polyester Adhesive 49000 made by Du Pont Co.) | 3 |
| Tetrahydrofuran | 45 |

The thus prepared charge transporting layer coating liquid was coated on the aforementioned selenium charge generating layer by a doctor blade, dried at room temperature and then dried under reduced pressure, so that a charge transporting layer about 10 μm thick was formed on the charge generating layer; thus, an electrophotographic photoconductor No. 4-28 according to the present invention was prepared.

$V_{po}$ and $E_{1/2}$ were measured. The results showed that $V_{po}=-1290$ $V$ and $E_{1/2}=3.9$ lux·seconds.

EXAMPLE 4-29

A perylene pigment C.I. Vat Red 23 (C.I. 71130) of the following formula was vacuum-evaporated with a thickness of about 0.3 μm on an about 300 μm thick aluminum plate so that a charge generating layer was formed on the aluminum plate:

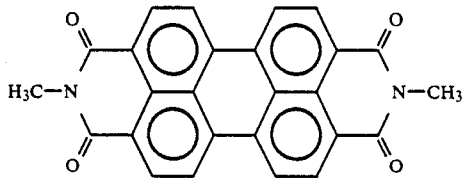

A charge transporting layer coating liquid was prepared by mixing and dispersing the following components:

| | Parts by Weight |
|---|---|
| Amino Compound (I)-4-26 in Table 4 | 2 |
| Polyester resin (Polyester Adhesive 49000 made by Du Pont Co.) | 3 |
| Tetrahydrofuran | 45 |

The thus prepared charge transporting layer coating liquid was coated on the aforementioned charge generating layer by a doctor blade, dried at room temperature and then dried under reduced pressure, so that a charge transporting layer about 10 μm thick was formed on the charge generating layer; thus, an electrophotographic photoconductor No. 4-29 according to the present invention was prepared.

$V_{po}$ and $E_{1/2}$ were measured The results showed that $V_{po}=-1010$ $V$ and $E_{1/2}=2.9$ lux·seconds.

EXAMPLE 4-30

One part by weight of Diane Blue (C.I. Pigment Blue 25, C.I. 21180) which was the same as that employed in Example 4-1 was added to 158 parts by weight of tetrahydrofuran, and the mixture was ground and dispersed in a ball mill. To this mixture, 12 parts by weight of the amino compound (I)-4-27 in Table 4 and 18 parts by weight of a polyester resin (Polyester Adhesive 49000 made by Du Pont Co.) were added and mixed, whereby a photoconductive layer coating liquid was prepared.

The thus prepared photoconductive layer coating liquid was coated on an aluminum-evaporated polyester film by a doctor blade and dried at 100° C. for 30 minutes, so that a photoconductive layer with a thickness of about 16 μm was formed on the aluminum-evaporated polyester film, thus, an electrophotographic photoconductor No. 4-30 according to the present invention was prepared.

The electrophotographic photoconductor No. 4-30 was charged positively in the dark under application of +6 kV of corona charge for 20 seconds and was then allowed to stand in the dark for 20 seconds without applying any charge thereto. At this moment, the surface potential $V_{po}$ (V) of the photoconductor was measured by a Paper Analyzer (Kawaguchi Electro Works, Model SP-428). The photoconductor was then illuminated by a tungsten lamp in such a manner that the illuminance on the illuminated surface of the photoconductor was 20 lux, so that the exposure $E_{1/2}$ (lux·seconds) required to reduce the initial surface potential $V_{po}$ (V) to ½ the initial surface potential $V_{po}$ (V) was measured. The results showed that $V_{po}$ (V)=+1280 $V$ and $E_{1/2}=5.1$ lux·seconds.

The charge generating material, the charge transporting material, $V_{po}$ and $E_{1/2}$ of each of the electrophotographic photoconductors No. 4-1 through No. 4-30 are summarized in the following Table 13:

TABLE 13

| Photoconductor | $V_{po}$ (volts) | $E_{\frac{1}{2}}$ (lux · sec) |
|---|---|---|
| No. 4-1 | −930 | 3.8 |
| No. 4-2 | −1320 | 2.3 |
| No. 4-3 | −1025 | 1.0 |
| No. 4-4 | −1220 | 4.0 |
| No. 4-5 | −985 | 0.9 |
| No. 4-6 | −940 | 2.1 |
| No. 4-7 | −735 | 3.1 |
| No. 4-8 | −1210 | 4.2 |
| No. 4-9 | −890 | 1.7 |
| No. 4-10 | −1210 | 1.0 |
| No. 4-11 | −1040 | 0.6 |
| No. 4-12 | −1250 | 2.1 |
| No. 4-13 | −1050 | 4.3 |
| No. 4-14 | −1120 | 0.7 |
| No. 4-15 | −910 | 0.8 |
| No. 4-16 | −1320 | 2.0 |
| No. 4-17 | −985 | 1.8 |
| No. 4-18 | −1000 | 1.9 |
| No. 4-19 | −1310 | 3.1 |
| No. 4-20 | −1110 | 1.1 |
| No. 4-21 | −765 | 1.3 |
| No. 4-22 | −680 | 0.5 |
| No. 4-23 | −430 | 0.7 |
| No. 4-24 | −970 | 0.9 |
| No. 4-25 | −830 | 0.8 |
| No. 4-26 | −1250 | 1.2 |
| No. 4-27 | −1000 | 1.0 |
| No. 4-28 | −1290 | 3.9 |
| No. 4-29 | −1010 | 2.9 |
| No. 4-30 | +1280 | 5.1 |

Each of the electrophotographic photoconductors No. 4-1 through No. 4-29 prepared in Examples 4-1 through 4-29 was negatively charged, while the electrophotographic photoconductor No. 4-30 prepared in Example 4-30 was positively charged by a commercially available copying machine, so that a latent electrostatic image was formed on each photoconductor and was developed with a dry type developer. The developed images were transferred to a high quality transfer sheet and were fixed to the transfer sheet. As a result, clear images were obtained from each of the electrophotographic photoconductors. Preparation of Amino Compound (I)-5-13 in Table 5

3.91 g of 1-phenyl-4-[4-N,N-bis(4-methylphenyl-)amino]phenyl-1,3-butadiene was dissolved in 100 ml of dioxane. To this solution, 0.20 g of a 5% palladium-carbon was added and the 1-phenyl-4-[4,N,N-bis(4-methylphenyl)amino]phenyl-1,3-butadiene in the mixture was hydrogenated at a pressure of 1 atm at 25° C. in a shaker hydrogenation apparatus. After the hydrogenation, the reaction mixture was filtered together with sellaite to obtain a filtrate. The filtrate was distilled under reduced pressure to remove dioxane therefrom, so that white crystals were obtained. The white crystals were recrystallized from ethanol, whereby 2.60 g of 1-phenyl-4-[4-N,N-bis(4-methylphenyl)amino]phenylbutane was obtained in the form of white needles in a 86% yield, with a melting point of 52.0°-53° C.

The results of the elemental analysis of the thus obtained amino compound (I)-5-13 were as follows:

| | % C | % H | % N |
|---|---|---|---|
| Found | 89.00 | 7.64 | 3.66 |
| Calculated | 88.83 | 7.72 | 3.45 |

The above calculation was based on the formula for 4-phenethyltriphenylamine of $C_{30}H_{31}N$.

An infrared spectrum of the 1-phenyl-4-[4-N,N-bis(-4methylphenyl)amino]phenylbutane, taken by use of a KBr pellet, indicated the disappearance of the absorption at 990 $cm^{-1}$, based on the out-of-plane vibrations of the butadiene, which is the starting material of this product.

Preparation of embodiments of an electrophotographic photoconductor according to the present invention will now be explained in detail by referring to the following examples.

EXAMPLE 5-1

The following components were ground and dispersed in a ball mill to prepare a charge generating layer coating liquid:

| | Parts by Weight |
|---|---|
| Diane Blue (C.I. Pigment Blue 25, C.I. 21180) (a charge generating pigment of the following formula (CG-1)) | 76 |
| 2% tetrahydrafuran solution of a polyester resin (Vylon 200 made by Toyobo Co., Ltd.) | 1,260 |
| Tetrahydrafuran | 3,700 |

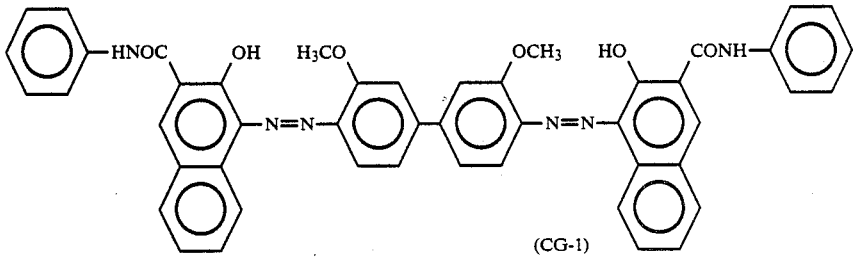

(CG-1)

This charge generating layer coating liquid was coated by a doctor blade on the aluminum-evaporated surface of an aluminum-evaporated polyester base film, which served as an electroconductive support, so that a charge generating layer, with a thickness of about 1 μm when dried at room temperature, was formed on the electroconductive support.

Then the following components were mixed and dissolved, so that a charge transporting layer coating liquid was prepared:

| | Parts by Weight |
|---|---|
| Amino Compound (I)-5-13 in Table 5 | 2 |
| Polycarbonate resin (Panlite K 1300 made by Teijin Limited.) | 2 |
| Tetrahydrofuran | 16 |

The thus prepared charge transporting layer coating liquid was coated on the aforementioned charge generating layer by a doctor blade and dried at 80° C. for 2 minutes and then at 105° C. for 5 minutes, so that a charge transporting layer with a thickness of about 20 μm was formed on the charge generating layer; thus, an electrophotographic photoconductor No. 5-1 according to the present invention was prepared.

The electrophotographic photoconductor No. 5-1 was charged negatively in the dark under application of −6 kV of corona charge for 20 seconds and then allowed to stand in the dark for 20 seconds without applying any charge thereto. At this moment, the surface potential $V_{po}$ (V) of the photoconductor was measured by a Paper Analyzer (Kawaguchi Electro Works, Model SP-428). The photoconductor was then illuminated by a tungsten lamp in such a manner that the illuminance on the illuminated surface of the photoconductor was 20 lux, and the exposure $E_{1/2}$ (lux·seconds) required to B reduce the initial surface potential $V_{po}$ (V) to ½ the initial surface potential $V_{po}$ (V) was measured. The results showed that $V_{po}$ (V) = −1020 V and $E_{1/2}$ = 2.54 lux·seconds.

EXAMPLES 5-2 THROUGH 5-27

Example 5-1 was repeated except that the charge generating material and the amino compound which worked as the charge transporting material employed in Example 5-1 were respectively replaced by the charge generating materials and the amino compounds as listed in Table 14, whereby electrophotographic photoconductors No. 5-2 through No. 5-27 according to the present invention were prepared.

$V_{po}$ and $E_{1/2}$ of those electrophotographic photoconductors were measured in the same manner as in Example 5-1. The results are shown in Table 14.

TABLE 14
| Photo-Conductor | Charge Generating Material | Charge Transporting Material (Amino Compound in Table 5) |
|---|---|---|
| No. 5-2 | 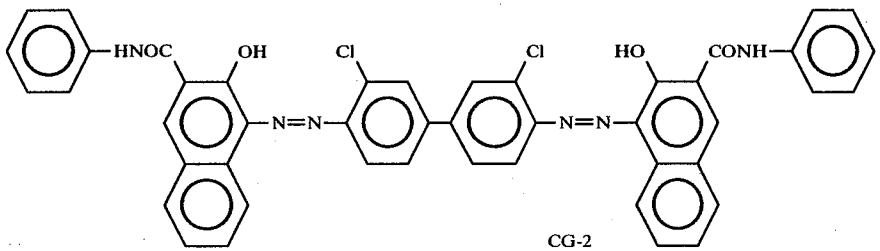 CG-2 | (I)-5-13 |
| No. 5-3 | 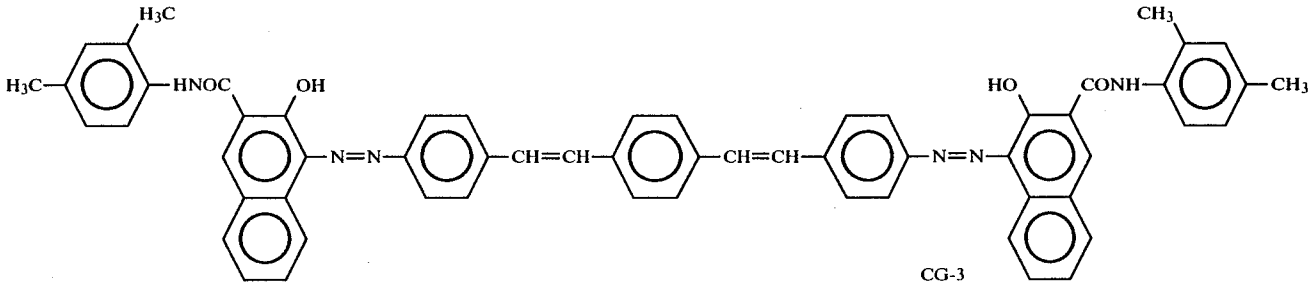 CG-3 | (I)-5-13 |
| No. 5-4 | 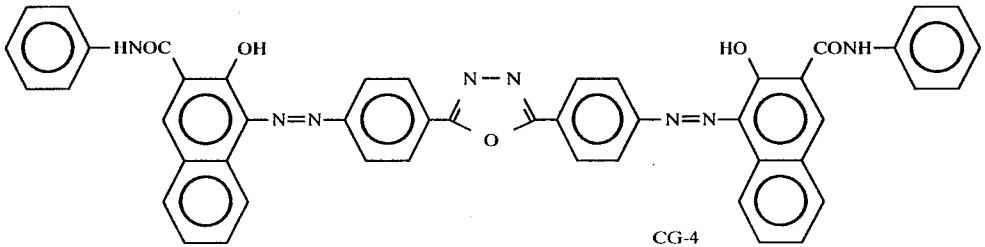 CG-4 | (I)-5-13 |

TABLE 14-continued
| Photo-Conductor | Charge Generating Material | Charge Transporting Material (Amino Compound in Table 5) |
|---|---|---|
| No. 5-5 | 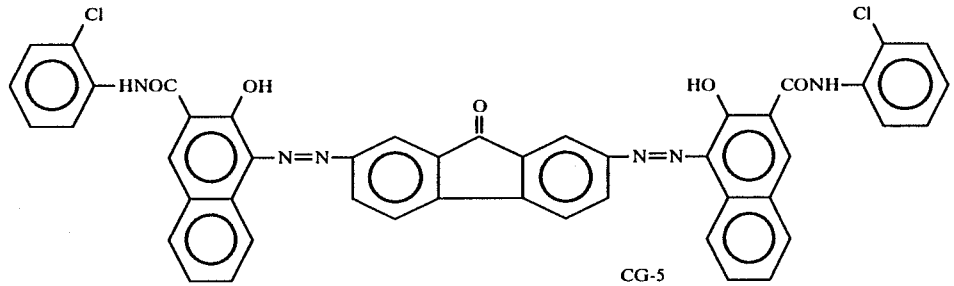 CG-5 | (I)-5-13 |
| No. 5-6 | 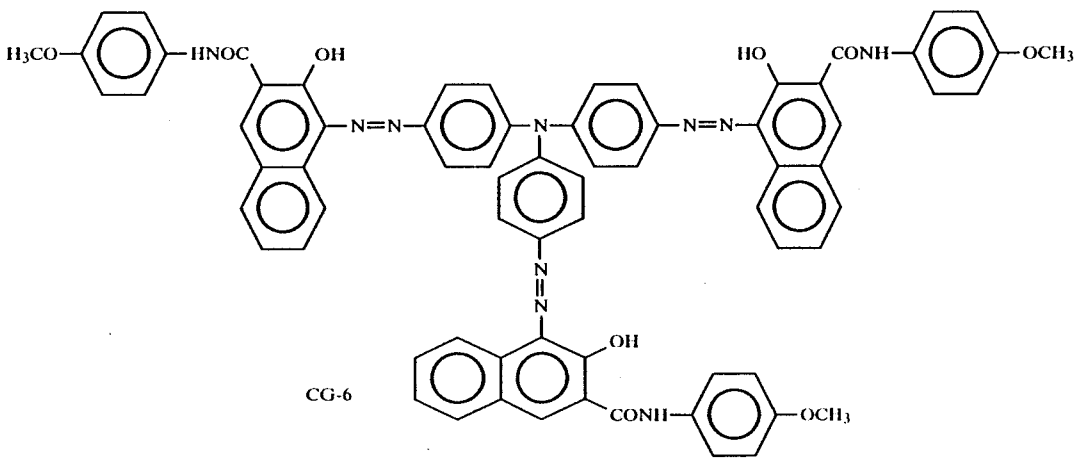 CG-6 | (I)-5-13 |
| No. 5-7 | β-type copper phthalocyanine | (I)-5-13 |

TABLE 14-continued
| Photo-Conductor | Charge Generating Material | Charge Transporting Material (Amino Compound in Table 5) |
|---|---|---|
| No. 5-8 | 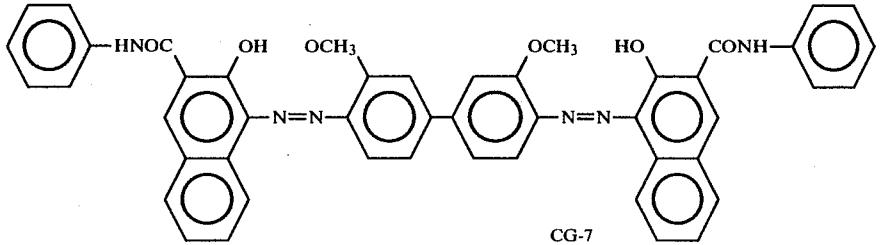 CG-7 | (I)-5-6 |
| No. 5-9 | CG-2 | (I)-5-6 |
| No. 5-10 | CG-3 | (I)-5-6 |
| No. 5-11 | CG-5 | (I)-5-6 |
| No. 5-12 | CG-3 | (I)-5-23 |
| No. 5-13 | CG-5 | (I)-5-23 |
| No. 5-14 | CG-5 | (I)-5-29 |
| No. 5-15 | CG-5 | (I)-5-29 |
| No. 5-16 | CG-3 | (I)-5-36 |
| No. 5-17 | CG-5 | (I)-5-36 |
| No. 5-18 | CG-3 | (I)-5-45 |
| No. 5-19 | CG-5 | (I)-5-45 |
| No. 5-20 | CG-3 | (I)-5-60 |
| No. 5-21 | CG-5 | (I)-5-60 |
| No. 5-22 | CG-3 | (I)-5-73 |
| No. 5-23 | CG-5 | (I)-5-73 |
| No. 5-24 | CG-3 | (I)-5-76 |
| No. 5-25 | Cg-5 | (I)-5-76 |
| No. 5-26 | CG-3 | (I)-5-85 |
| No. 5-27 | CG-5 | (I)-5-85 |

EXAMPLE 5-28

Selenium was vacuum-evaporated with a thickness of about 1.0 μm on an about 300 μm thick aluminum plate so that a charge generating layer was formed on the aluminum plate.

A charge transporting layer coating liquid was prepared by mixing and dispersing the following components:

| | Parts by Weight |
|---|---|
| Amino Compound (I)-5-13 in Table 5 | 2 |
| Polyester resin (Polyester Adhesive 49000 made by Du Pont Co.) | 3 |
| Tetrahydrofuran | 45 |

The thus prepared charge transporting layer coating liquid was coated on the aforementioned selenium charge generating layer by a doctor blade, dried at room temperature and then dried under reduced pressure, so that a charge transporting layer about 10 μm thick was formed on the charge generating layer; thus, an electrophotographic photoconductor No. 5-28 according to the present invention was prepared.

$V_{po}$ and $E_{1/2}$ were measured. The results showed that $V_{po}=-944$ $V$ and $E_{1/2}=2.95$ lux·seconds.

EXAMPLE 5-29

A perylene pigment C.I. Vat Red 23 (C.I. 71130) of the following formula was vacuum-evaporated with a thickness of about 0.3 μm on an about 300 μm thick aluminum plate so that a charge generating layer was formed on the aluminum plate:

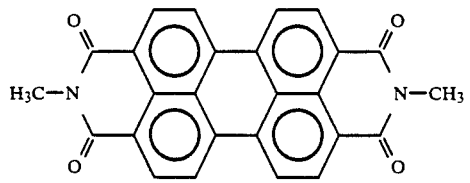

A charge transporting layer coating liquid was prepared by mixing and dispersing the following components:

| | Parts by Weight |
|---|---|
| Amino Compound (I)-5-6 in Table 5 | 2 |
| Polyester resin (Polyester Adhesive 49000 made by Du Pont Co.) | 3 |
| Tetrahydrofuran | 45 |

The thus prepared charge transporting layer coating liquid was coated on the aforementioned charge generating layer by a doctor blade, dried at room temperature and then dried under reduced pressure, so that a charge transporting layer about 10 μm thick was formed on the charge generating layer; thus, an electrophotographic photoconductor (I)-1-29 according to the present invention was prepared.

$V_{po}$ and $E_{1/2}$ were measured. The results showed that $V_{po}=-1066$ $V$ and $E_{1/2}=2.77$ lux·seconds.

EXAMPLE 5-30

One part by weight of Diane Blue (C.I. Pigment Blue 25, C.I. 21180) which was the same as that employed in Example 5-1 was added to 158 parts by weight of tetrahydrofuran, and the mixture was ground and dispersed in a ball mill. To this mixture, 12 parts by weight of the amino compound (I)-5-13 in Table 5 and 18 parts by weight of a polyester resin (Polyester Adhesive 49000 made by Du Pont Co.) were added and mixed, whereby a photoconductive layer coating liquid was prepared.

The thus prepared photoconductive layer coating liquid was coated on an aluminum-evaporated polyester film by a doctor blade and dried at 100° C. for 30 minutes, so that a photoconductive layer with a thickness of about 16 μm was formed on the aluminum-evaporated polyester film, thus, an electrophotographic photoconductor No. 5-30 according to the present invention was prepared.

EXAMPLE 5-31

The following components were mixed and dissolved, so that a charge transporting layer coating liquid was prepared, which is the same charge transporting layer coating liquid as that employed in Example 5-1:

| | Parts by Weight |
|---|---|
| Amino Compound (I)-5-13 in Table 5 | 2 |
| Polycarbonate resin (Panlite K 1300 made by Teijin Limited.) | 2 |
| Tetrahydrofuran | 16 |

The thus prepared charge transporting layer coating liquid was coated by a doctor blade on the aluminum-evaporated surface of an aluminum-evaporated polyester base film, which served as an electroconductive support, so that a charge transporting layer was formed on the electroconductive support, with a thickness of about 20 μm when dried at room temperature.

Then the following components were ground and dispersed in a ball mill to prepare a dispersion:

| | Parts by Weight |
|---|---|
| Biaso Pigment (a charge generating pigment of the following formula (CG-5)) | 13.5 |

-continued

| | Parts by Weight |
|---|---|
| 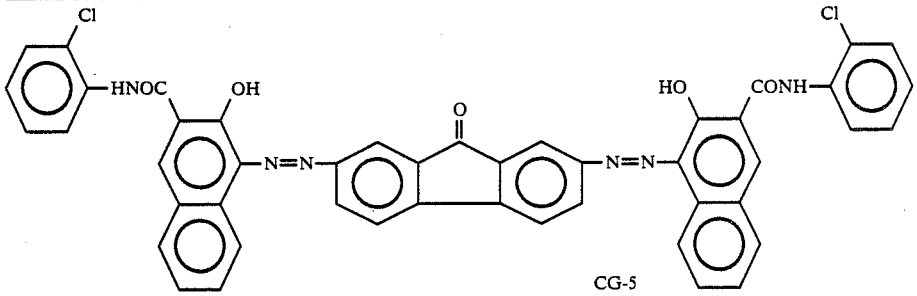 CG-5 | |
| Polyvinyl butyral(Trademark "XYHL" made by Union Carbide Plastic Co., Ltd.) | 5.4 |
| Tetrahydrofuran | 680 |
| Ethyl cellosolve | 1020 |

To the above dispersion, 1700 parts by weight of ethyl cellosolve were further added and the mixture was dispersed, whereby a charge generating layer coating liquid was prepared.

The thus prepared charge generating layer coating liquid was coated on the aforementioned charge transporting layer by spray coating and dried at 100° C. for 10 minutes, whereby a charge generating layer having a thickness of about 0.2 μm was formed on the charge transporting layer.

Then a methanol/n-buthanol solution of a polyamide resin (Trademark "CM-8000" made by Toray Industries, Inc.) was coated on the charge generating layer by spray coating and dried at 120° C. for 30 minutes, whereby a protective layer having a thickness of about 0.5 μm was formed on the charge generating layer. Thus an electrophotographic photoconductor No. 5-31 according to the present invention was prepared.

The electrophotographic photoconductors Nos. 5-30 and 5-31 were charged positively in the dark under application of +6 kV of corona charge for 20 seconds and then allowed to stand in the dark for 20 seconds without applying any charge thereto. At this moment, the surface potential $V_{po}$ (V) of each photoconductor was measured by a Paper Analyzer (Kawaguchi Electro Works, Model SP-428). Each photoconductor was then illuminated by a tungsten lamp in such a manner that the illuminance on the illuminated surface of the photoconductor was 20 lux, so that the exposure $E_{1/2}$ (lux·seconds) required to reduce the initial surface potential $V_{po}$ to ½ the initial surface potential $V_{po}$ (V) was measured.

The $V_{po}$ and $E_{1/2}$ of each of the electrophotographic photoconductors No. 5-1 through No. 5-31 are shown in the following Table 15:

TABLE 15

| Photoconductor | $V_{po}$ (Volt) | $E_{\frac{1}{2}}$ (lux sec) |
|---|---|---|
| No. 5-1 | −1020 | 2.54 |
| No. 5-2 | −1285 | 2.01 |
| No. 5-3 | −1276 | 1.20 |
| No. 5-4 | −1310 | 3.01 |
| No. 5-5 | −1284 | 1.38 |
| No. 5-6 | −1210 | 1.54 |
| No. 5-7 | −982 | 2.10 |
| No. 5-8 | −1266 | 3.24 |
| No. 5-9 | −1296 | 2.58 |
| No. 5-10 | −1327 | 1.31 |
| No. 5-11 | −1298 | 1.40 |
| No. 5-12 | −1141 | 1.30 |

TABLE 15-continued

| Photoconductor | $V_{po}$ (Volt) | $E_{\frac{1}{2}}$ (lux sec) |
|---|---|---|
| No. 5-13 | −1082 | 1.38 |
| No. 5-14 | −1282 | 1.54 |
| No. 5-15 | −1244 | 1.66 |
| No. 5-16 | −1291 | 1.43 |
| No. 5-17 | −1151 | 1.54 |
| No. 5-18 | −1042 | 1.44 |
| No. 5-19 | −1011 | 1.57 |
| No. 5-20 | −981 | 1.10 |
| No. 5-21 | −962 | 1.15 |
| No. 5-22 | −920 | 1.05 |
| No. 5-23 | −886 | 1.22 |
| No. 5-24 | −1280 | 2.05 |
| No. 5-25 | −1196 | 1.94 |
| No. 5-26 | −1367 | 1.78 |
| No. 5-27 | −1296 | 1.79 |
| No. 5-28 | −944 | 2.95 |
| No. 5-29 | −1066 | 2.77 |
| No. 5-30 | +1155 | 3.12 |
| No. 5-31 | +1280 | 1.52 |

Each of the electrophotographic photoconductors No. 5-1 through Nos. 5-29 prepared in Examples 5-1 through 5-29 was negatively charged, while the electrophotographic photoconductors No. 5-30 and No. 5-31 prepared in Examples 5-30 and 5-31 were positively charged by a commercially available copying machine, so that a latent electrostatic image was formed on each photoconductor and developed with a dry type developer. The developed images were transferred to a high quality transfer sheet and were fixed to the transfer sheet. As a result, clear images were obtained from each of the electrophotographic photoconductors.

What is claimed is:

1. An electrophotographic photoconductor comprising an electroconductive support and a photoconductive layer formed thereon comprising at least one amino compound of the formula:

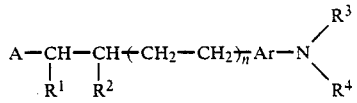

wherein A represents a substituted or unsubstituted aromatic hydrocarbon group; $R^1$ and $R^2$ each represent hydrogen, a substituted or unsubstituted alkyl group, a substituted or unsubstituted aryl group, or a substituted or unsubstituted aralkyl group; Ar represents a substituted or unsubstituted aromatic hydrocarbon group, or a substituted or unsubstituted heterocyclic ring; $R^3$ and $R^4$ each represent a substituted or unsubstituted alkyl group, a substituted or unsubstituted aralkyl group, or a substituted or unsubstituted aryl group, and n is an integer of 0, 1 or 2.

2. The electrophotographic photoconductor as claimed in claim 1, wherein said photoconductive layer further comprises a binder agent which constitutes a charge transporting medium in combination with said amino compound; and a charge generating material dispersed within said charge transporting medium.

3. The electrophotographic photoconductor as claimed in claim 1, wherein said photoconductive layer comprises a charge generating layer containing a charge generating material, and a charge transporting layer containing said amino compound as a charge transporting material.

4. The electrophotographic photoconductor as claimed in claim 1, wherein the thickness of said photoconductive layer is in the range of 3 μm to 50 μm.

5. The electrophotographic photoconductor as claimed in claim 1, wherein the amount of said amino compound is in the range of 30 wt.% to 70 wt.% of the entire weight of said photoconductive layer.

6. The electrophotographic photoconductor as claimed in claim 2, wherein the thickness of said photoconductive layer is in the range of 3 μm to 50 μm.

7. The electrophotographic photoconductor as claimed in claim 2, wherein the amount of said amino compound is in the range of 10 wt.% to 95 wt.% of the entire weight of said photoconductive layer, and the amount of said charge generating material is in the range of 0.1 wt.% to 50 wt.% of the entire weight of said photoconductive layer.

8. The electrophotographic photoconductor as claimed in claim 3, wherein the thickness of said charge generating layer is not more than 5 μm and the thickness of said charge transporting layer is in the range of 3 μm to 50 μm.

9. The electrophotographic photoconductor as claimed in claim 3, wherein the amount of said charge generating material is in the range of 10 wt.% to 95 wt.% of the entire weight of said charge generating layer, and the amount of said amino compound is in the range of 10 wt.% to 95 wt.% of the entire weight of said photoconductive layer.

10. An electrophotographic photoconductor comprising an electroconductive support and a photoconductive layer formed on said electroconductive support comprising at least one amino compound of the formula:

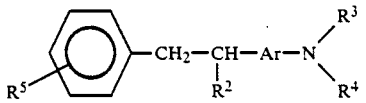

wherein $R^5$ represents hydrogen, an alkyl group, an alkoxy group, an aryloxy group, or halogen; $R^2$ represents hydrogen, a substituted or unsubstituted alkyl group, or a substituted or unsubstituted phenyl group; Ar represents a substituted or unsubstituted aromatic hydrocarbon group; and $R^3$ and $R^4$ each represent a substituted or unsubstituted alkyl group, a substituted or unsubstituted aryl group, or a substituted or unsubstituted aralkyl group.

11. An electrophotographic photoconductor comprising an electroconductive support and a photoconductive layer formed on said electroconductive support comprising at least one amino compound of the formula:

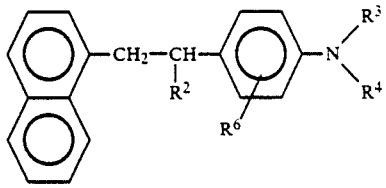

wherein $R^2$ represents hydrogen, or a substituted or unsubstituted phenyl group; $R^6$ represents hydrogen, an alkyl group, an alkoxy group, or halogen; and $R^3$ and $R^4$ each represent a substituted or unsubstituted alkyl group, or a substituted or unsubstituted aralkyl group, or a substituted or unsubstituted aryl group.

12. An electrophotographic photoconductor comprising an electroconductive support and a photoconductive layer formed on said electroconductive support comprising at least one amino compound of the formula:

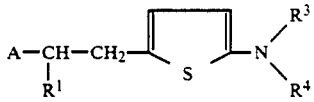

wherein A represents a substituted or unsubstituted aromatic hydrocarbon; $R^1$ represents hydrogen, an alkyl group, or a substituted or unsubstituted phenyl group; and $R^3$ and $R^4$ each represent an alkyl group, a substituted or unsubstituted aralkyl group, or a substituted or unsubstituted aryl group.

13. An electrophotographic photoconductor comprising an electroconductive support and a photoconductive layer formed on said electroconductive support comprising at least one amino compound of the formula:

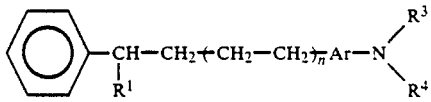

wherein $R^1$ represents an alkyl group, a substituted or unsubstituted aralkyl group, or a substituted or unsubstituted aryl group; Ar represents a substituted or unsubstituted aromatic hydrocarbon group; $R^3$ and $R^4$ each represent a substituted or unsubstituted alkyl group, a substituted or unsubstituted aralkyl group, or a substituted or unsubstituted aryl group; and n is an integer of 0 or 1.

14. An electrophotographic photoconductor comprising an electroconductive support and a photoconductive layer formed on said electroconductive support comprising at least one amino compound of the formula:

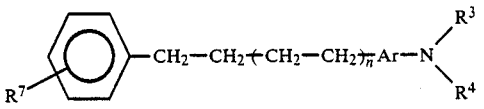

wherein $R^7$ represents hydrogen, an alkyl group having 1 to 4 carbon atoms, an alkoxy group having 1 to 4 carbon atoms, an aryloxy group, a dialkylamino group having 2 to 8 carbon atoms, a diarylamino group, or halogen; Ar represents a substituted or unsubstituted aromatic hydrocarbon group or a substituted or unsubstituted heterocyclic ring; and $R^3$ and $R^4$ each represent an alkyl group having 1 to 4 carbon atoms, an aralkyl group, or a substituted or unsubstituted aryl group; and n is an integer of 1 or 2.

15. The electrophotographic photoconductor as claimed in claim 1, in which A, Ar, $R_3$ and $R_4$ are

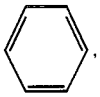

and $R_1$ $R_2$ are hydrogen.

* * * * *